US009421681B2

(12) United States Patent
Zhang et al.

(10) Patent No.: US 9,421,681 B2
(45) Date of Patent: Aug. 23, 2016

(54) POWER TOOL AND OPERATION METHOD FOR THE POWER TOOL

(71) Applicant: Positec Power Tools (Suzhou) Co., Ltd., Suzhou, Jiangsu (CN)

(72) Inventors: Shisong Zhang, Suzhou (CN); Hongfeng Zhong, Suzhou (CN); Xiaoli Pang, Suzhou (CN); Jingtao Xu, Suzhou (CN); Paolo Andriolo, Vicenza (IT); Kelvin Wang, Suzhou (CN); Zhi Chen, Suzhou (CN)

(73) Assignee: POSITEC POWER TOOLS (SUZHOU) CO., LTD., Suzhou, Jiangsu (CN)

( * ) Notice: Subject to any disclaimer, the term of this patent is extended or adjusted under 35 U.S.C. 154(b) by 799 days.

(21) Appl. No.: 13/628,580

(22) Filed: Sep. 27, 2012

(65) Prior Publication Data

US 2013/0032368 A1 Feb. 7, 2013

Related U.S. Application Data

(63) Continuation of application No. PCT/CN2012/079689, filed on Aug. 3, 2012.

(30) Foreign Application Priority Data

| | | |
|---|---|---|
| Aug. 6, 2011 | (CN) | 2011 1 0224257 |
| Aug. 6, 2011 | (CN) | 2011 1 0224280 |
| Aug. 6, 2011 | (CN) | 2011 1 0224641 |
| Aug. 6, 2011 | (CN) | 2011 1 0224642 |
| Aug. 6, 2011 | (CN) | 2011 1 0224925 |
| Nov. 14, 2011 | (CN) | 2011 1 0359632 |
| May 25, 2012 | (CN) | 2012 1 0166387 |
| May 25, 2012 | (CN) | 2012 1 0166388 |
| Jun. 20, 2012 | (CN) | 2012 1 0203955 |
| Jun. 20, 2012 | (CN) | 2012 1 0204006 |
| Jun. 20, 2012 | (CN) | 2012 1 0204007 |
| Jun. 20, 2012 | (CN) | 2012 1 0204008 |
| Jul. 6, 2012 | (CN) | 2012 1 0233946 |
| Jul. 6, 2012 | (CN) | 2012 1 0233947 |
| Jul. 6, 2012 | (CN) | 2012 1 0233948 |
| Jul. 20, 2012 | (CN) | 2012 1 0252591 |
| Jul. 20, 2012 | (CN) | 2012 1 0259921 |
| Jul. 20, 2012 | (CN) | 2012 1 0259922 |

(51) Int. Cl.

| | |
|---|---|
| ***B25B 21/00*** | (2006.01) |
| ***B25F 1/04*** | (2006.01) |
| ***B25F 5/02*** | (2006.01) |

(52) U.S. Cl.

CPC ..... *B25F 1/04* (2013.01); *B25F 5/029* (2013.01); *Y10T 483/1798* (2015.01)

(58) Field of Classification Search

USPC ..... 173/1, 217; 81/439, 177.4; 483/57, 61, 483/54, 49, 51, 44, 45, 46; 408/35

See application file for complete search history.

(56) References Cited

U.S. PATENT DOCUMENTS

| | | | |
|---|---|---|---|
| 4,976,175 | A | 12/1990 | Hung |
| 5,065,498 | A | 11/1991 | McKenzie |

(Continued)

FOREIGN PATENT DOCUMENTS

| | | |
|---|---|---|
| CN | 2683290 | 3/2005 |
| CN | 2748230 | 12/2005 |

(Continued)

*Primary Examiner* — Robert Long
*Assistant Examiner* — Chinyere Rushing-Tucker
(74) *Attorney, Agent, or Firm* — Hauptman Ham, LLP

(57) ABSTRACT

A power tool, including: a housing, a motor, arranged in the housing and outputting rotary force, a connecting shaft, adapted to one of a plurality of tool bits, a transmission mechanism, arranged between the motor and the connecting shaft and transmitting the rotary force from the motor to the connecting shaft, a cartridge, the cartridge includes a tool chamber for receiving the plurality of tool bits, the connecting shaft being capable of moving axially between a working position wherein the connecting shaft is adapted to the tool bits and a release position wherein the connecting shaft is separated from one of the plurality of tool bits, and a restricting member, the restricting member operable to move between two positions; at a first position, the restricting member limits the movement of the connecting shaft; and at a second position, the restricting member allows the connecting shaft to move.

17 Claims, 37 Drawing Sheets

(56) References Cited

U.S. PATENT DOCUMENTS

| | | | | |
|---|---|---|---|---|
| 5,346,453 | A * | 9/1994 | Rivera-Bottzeck | 483/1 |
| 5,597,275 | A * | 1/1997 | Hogan | 408/239 R |
| 5,893,685 | A * | 4/1999 | Olson et al. | 408/35 |
| 6,007,277 | A * | 12/1999 | Olson et al. | 483/51 |
| 6,928,908 | B1 | 8/2005 | Yu | |
| 7,237,458 | B2 | 7/2007 | Shiao | |
| 8,413,549 | B2 * | 4/2013 | Chen | 81/62 |
| 2010/0279839 | A1 * | 11/2010 | Moser et al. | 483/36 |
| 2013/0244845 | A1 * | 9/2013 | Nagy et al. | 483/12 |
| 2015/0021061 | A1 * | 1/2015 | Nagy | B25F 5/029 173/29 |

FOREIGN PATENT DOCUMENTS

| | | | |
|---|---|---|---|
| CN | 2772736 | | 4/2006 |
| CN | 201055983 | | 5/2008 |
| CN | 101204742 | | 6/2008 |
| CN | 201086280 | | 7/2008 |
| CN | 201086280 | Y * | 7/2008 |
| CN | 101563192 | | 10/2009 |
| CN | 201960511 | | 9/2011 |
| WO | 99/56919 | | 11/1999 |
| WO | 20081074536 | | 6/2008 |

* cited by examiner

POWER TOOL AND OPERATION METHOD FOR THE POWER TOOL

CROSS REFERENCE TO RELATED APPLICATION

Related Applications

The present application is a continuation of International Application Number PCT/CN2012/079689 filed Aug. 3, 2012, the disclosure of which is hereby incorporated by reference herein in their entirety. Further, this application claims the priority of Chinese Patent Application No. 201110224257.1, filed on Aug. 6, 2011; Chinese Patent application number 201110224280.0, filed on Aug. 6, 2011; Chinese Patent application number 201110224925.0, filed on Aug. 6, 2011; Chinese Patent application number 201110224642.6, filed on Aug. 6, 2011; Chinese Patent application number 201110224641.1, filed on Aug. 6, 2011; Chinese Patent application number 201110359632.3, filed on Nov. 14, 2011; Chinese Patent application number 201210166388.3, filed on May 25, 2012; Chinese Patent application number 201210166387.9, filed on May 25, 2012; Chinese Patent application number 201210204008.0, filed on Jun. 20, 2012; Chinese Patent application number 201210204007.6, filed on Jun. 20, 2012; Chinese Patent application number 201210204006.1, filed on Jun. 20, 2012; Chinese Patent application number 201210203955.8, filed on Jun. 20, 2012; Chinese Patent application number 201210233948.2, filed on Jul. 6, 2012; Chinese Patent application number 201210233947.8, filed on Jul. 6, 2012; Chinese Patent application number 201210233946.3, filed on Jul. 6, 2012; Chinese Patent application number 201210252591.2, filed on Jul. 20, 2012; Chinese Patent application number 201210259922.5, filed on Jul. 20, 2012; and Chinese Patent application number 201210259921.0, filed on Jul. 20, 2012 in the SIPO (State Intellectual Property Office—Chinese Patent Office), the disclosure of which are incorporated herein in their entirety by reference.

BACKGROUND OF THE INVENTION

1. Field of the Invention

The present invention relates to a power tool, in particular to a gun drill-type power tool capable of realizing storage of tool bits and quick replacement. The invention also relates to an operation method for said power tool.

2. Description of Related Art

The current gun drill type power tools usually include electric drills, electric screwdrivers and percussion drills.

The electric screwdriver is a common electric tool for fastening screws on workpieces. To fasten screws of different specifications, the tool bits shall be changed according to the specifications of the screws, which means the originally mounted tool bit shall be taken down and replaced by one with another structure. On occasions with the need for frequent replacement of tool bits, great inconvenience is brought to operators; on one hand, the replacement of the tool bits is inconvenient, and on other hand, the tool bits are easy to lose if not kept safely. Although, some of manual tools can realize storage and quick replacement of the tool bits, the inherent defects in the manual tools, namely small torque and difficulty in operation, usually makes the operator, cause low efficiency and therefore is unsuitable to be used as a professional tool in the industrial production.

A CN patent of utility model numbered CN201086280Y discloses a multi-bit electric tool which comprises an electric tool main body and a multi-bit rotating drum-like magazine structure, wherein the multi-bit rotating drum-like magazine structure comprises a drum-like magazine capable of receiving a plurality of tool bits; the drum-like magazine is capable of being connected with the tool main body in a axial sliding way; when the drum-like magazine slides to a position away from the tool main body, the required tool bit can be selected via the drum-like magazine. However, the number of the bits stored in the cylinder is limited, and it is inconvenient for replacement of other required bits by the operator.

Besides, when the drum-like magazine leaves the main body of the tool, the connecting shaft is exposed outside; dust and powder can enter the tool or the drum-like magazine when the drum-like magazine slides, and after a long time, the drum-like magazine will fail to rotate and select the bit or the electric tool cannot be used. During working, the tool bit is pressed against the workpiece, and the connecting shaft shall bear the action force in the reverse direction and apply pressure onto the transmission mechanism such that the transmission mechanism cannot transmit the torque to the connecting shaft. With such structure, the transmission of the electric multi-bit power tool is also not reliable.

Moreover, if the operator powers off the motor and manually rotates the bit, it is likely to trigger the bit that drives the connecting shaft to rotate so as to enable the motor to rotate. This may damage the motor. Failure to manual operation for fastening the screw brings great inconvenience to the operator.

When the bit is replaced, the bit shall be moved back to the drum-like magazine. To prevent the bit is absorbed by the magnet to leave the drum-like magazine when the drum-like magazine axially moves, the CN patent of utility model numbered CN201086280Y discloses an approach for preventing the bit from leaving the drum-like magazine by installing a fixed ring on the bit. However, this kind of bit shall be particularly customized, which limits the use of the tool. Moreover, it is unstable if the connecting shaft drives the bit to rotate because the longer connecting shaft shakes at a larger amplitude and causes some potential risks to the user of the tool. Furthermore, the drum-like magazine is required to axially move to be separated from the connecting shaft, so foreign matters such as dust can easily enter the drum-like magazine easily and are difficult to clean.

Due to the random movement of the electric tool in use, the angle of the cylinder wall of the connecting shaft for installing the tool bit is underdetermined, and the angle at which the tool bit moves back to the drum-like magazine is also underdetermined, so the angle of the cylinder wall of the connecting shaft and the angle of the tool bit may be staggered in the process of replacing the tool bit, which causes the situation that the tool bit cannot correctly and smoothly enter the connecting shaft. The CN patent of utility model numbered CN201086280Y also discloses linkage between the multi-bit drum-like magazine and the trigger. When the multi-bit drum-like magazine slides at a position away from the main body of the tool, the required tool bit can be selected by rotating the multi-bit drum-like magazine; when sliding back to the main body of the tool, the multi-bit drum-like magazine drives the linkage rod to move; the linkage rod contacts with and presses the trigger to power on the motor; and the motor rotate a certain angle such that the angle of the sleeve and the angle of the bit are matched. On one hand, regular short-time start of the motor usually reduces the service life of the motor or damages the motor; on the other hand, the linkage between the multi-bit drum-like magazine and the trigger requires precise location and control, which costs much.

Usually, the operator cannot observe the specific shape of the tool bit received in the drum-like magazine from the housing. To find the required tool bit, the operator needs to push or pull the tool bits for several times by the operating mechanism. The operations are inconvenient, so the working efficiency is low.

SUMMARY OF THE INVENTION

To overcome the defects in the prior art, the present invention provides a power tool which is reliable in work.

The present invention also provides an operation method for said power tool.

The present invention adopts the following technical scheme to solve the problem: A power tool, comprising: a housing, a motor, arranged in the housing and outputting rotary force, a connecting shaft, adapted to one of a plurality of tool bits and driving one of the plurality of tool bits to rotate, a transmission mechanism, arranged between the motor and the connecting shaft and transmitting the rotary force output from the motor to the connecting shaft, a cartridge, arranged in the housing, said cartridge comprising a tool chamber for receiving the plurality of tool bits which are arranged in parallel, said connecting shaft being capable of moving axially between a working position wherein the connecting shaft is adapted to the plurality of tool bits by passing through the tool chamber and a release position wherein the connecting shaft is separated from one of the plurality of tool bits, and a restricting mechanism arranged between the housing and the connecting shaft; said restricting mechanism comprises a restricting member operable to move between two positions; at a first position, said connecting shaft is at the working position, and said restricting member limits the movement of the connecting shaft in a direction away from the tool bit; and at a second position, said connecting shaft is at the release position and said restricting member allows the connecting shaft to move in a direction away from the tool bit.

The other technical solution of the present invention is to provide a power tool comprising: a housing, a motor, arranged in the housing and outputting rotary force, an output shaft, having holes formed axially to receive tool bits, a transmission mechanism, arranged between the motor and the output shaft and transmitting the rotary force output from the motor to the output shaft, a cartridge, arranged in the housing, said cartridge comprising a tool chamber for receiving a plurality of tool bits arranged in parallel, a connecting shaft, said connecting shaft being capable of moving axially between a working position where the connecting shaft is adapted to one of the plurality of tool bits by passing through the tool chamber and a release position wherein the connecting shaft is separated from one of the plurality of tool bits, and a restricting mechanism arranged between the housing and the connecting shaft; said restricting mechanism comprises a restricting member operable to move between two positions; at a first position, said connecting shaft is at the working position, and said restricting member limits the movement of the connecting shaft in a direction away from the tool bit; and at a second position, said connecting shaft is at the release position and said restricting member allows the connecting shaft to move in a direction away from the tool bit.

Preferably, the power tool further comprising an operating member which is arranged on the housing and is capable of moving along the axial direction of the connecting shaft; and said operating member drives said connecting shaft to move axially.

Preferably, said operating member is provided with a release portion against the restricting member; said operating member drives the restricting member to move between the first position and the second position by said release portion; besides, at the second position, said operating member can drive sad connecting shaft to move axially.

Preferably, one part of said cartridge is received in said housing, and the other part is covered by said operating member and exposed along with the movement of said operating member.

Preferably, either said operating member or said housing is provided with a guide slot along the axial direction of the connecting shaft, and the other is provided with a guide rail matched with the guide rail; and said operating member moves axially along the connecting shaft with respect to the housing by sliding of said guide rail in the guide slot.

Preferably, said operating member is provided with a first protrusion and a second protrusion inside at an interval along the axial direction of said connecting shaft; one end, away from said cartridge, of said connecting shaft is provided with a fixed member; said fixed member is axially fixed with respect to said connecting shaft and located between said first protrusion and said second protrusion and is capable of axially moving there-between.

Preferably, said housing can be divided into a motor portion with a motor, a transmission portion with a transmission mechanism and a storage portion with a cartridge along the axial direction of said connecting shaft; when said connecting shaft is located at the working position, said operating member is axially overlapped with said transmission portion and said storage portion; and when said connecting shaft is at the release position, said operating member is axially overlapped with said motor portion and partly overlapped with said transmission portion.

Preferably, said restricting member rotates around a pivot in parallel to the axial direction for said connecting shaft.

Preferably, said restricting member rotates around a pivot vertical to the axial direction of said connecting shaft.

Preferably, said restricting member moves linearly in a direction vertical to the axial direction of said connecting shaft.

Preferably, said power tool also comprises an output shaft for connecting said tool bit; one end of said connecting shaft is connected with said transmission mechanism in a torque transmission way, while the other end of said connecting shaft can be connected with said output shaft and drive said tool bit to rotate via said output shaft.

Preferably, one end of said connecting shaft is connected with said transmission mechanism in torque transmission way, while the other end of said connecting shaft is capable of connecting with said output shaft and driving said tool bit to rotate via said output shaft.

Preferably, said restricting mechanism also comprises an elastic member resisting against said restricting member towards the first position.

Preferably, said housing is provided with a gear case inside; said transmission mechanism is received in said gear case; and a gear case cover plate is arranged between said gear case and said cartridge.

Preferably, said cartridge is rotationally supported between said housing and said gear case cover plate.

Preferably, said transmission mechanism comprises a planetary gear mechanism driven by the motor and a gear mechanism driven by the planetary gear mechanism. a partition is arranged in the gear case between said planetary gear mechanism and said gear mechanism.

Preferably, said gear mechanism comprises a first gear connected with said planetary gear mechanism, a third gear connected with said connecting shaft, and a second gear engaged with the first and third gears simultaneously.

An operation method for a power tool, said power tool according to above two technical solution, said operation method comprising the following steps: operating the restricting member at the second position, releasing the restriction on axial movement of the connecting shaft by the restricting member; moving said connecting shaft to the release position; operating the cartridge, selecting a needed tool bit; and moving said connecting shaft back to the working position.

Preferably, said power tool also comprises an operating member which is arranged on the housing and is capable of moving along the axial direction of said connecting shaft; said operating member drives said connecting shaft to move axially and is provided with a release member against said restricting member; said operating member drives said restricting member to move between the first position and the second position by said release member; said operation method also comprises: moving said operating member axially to put said restricting at the second position and then continuously moving said operating member to drive said connecting shaft to move to the release position.

Preferably, said operation method also comprises: after moving said operating member to drive said connecting shaft to move to the release position, one part of said cartridge is exposed along with the movement of said operating member.

Preferably, said restricting mechanism also comprises an elastic member pressing against said restricting member towards the first position; said operation method also comprises: after said connecting shaft moves back to the working position, said restricting member is pressed by said elastic member to move back to the first position.

Preferably, the method can be rotating the cartridge for selecting a needed tool bit.

Compared with the prior art, the present invention has the following benefits: The connecting shaft of the power tool is restricted from moving backward in procession of work, thus ensuring high reliability.

The present invention adopts the following technical scheme to solve the problem: A power tool comprising; a housing; a motor, arranged in the housing and outputting rotary force; a connecting shaft, adapted to one of a plurality of tool bits and driving one of the plurality of tool bits to rotate; a transmission mechanism, arranged between the motor and the connecting shaft and transmitting the rotary force output from the motor to the connecting shaft; a cartridge, arranged in the housing, said tool chamber comprising a tool chamber for receiving the plurality of tool bits which are arranged in parallel, said connecting shaft being capable of moving axially between a working position where the connecting shaft is adapted to one of the plurality of tool bits by passing through the tool chamber and a release position wherein the connecting shaft is separated from one of the plurality of tool bits; said power tool also comprises a restricting mechanism arranged between the housing and the connecting shaft; said restricting mechanism comprises a restricting member operable to move between two positions; at a first position, said connecting shaft is at the working position, and said restricting member allows the axial movement of said connecting shaft; and at a second position, said connecting shaft is at the release position and said restricting member stops the tool bit to leave the tool chamber.

The other technical solution of the present invention is to provide a power tool comprising: a housing; a motor, arranged in the housing and outputting rotary force; an output shaft, having holes formed axially to receive tool bits; a transmission mechanism, arranged between the motor and the output shaft and transmitting the rotary force output from the motor to the output shaft; a cartridge, arranged in the housing, said cartridge comprising a tool chamber for receiving a plurality of tool bits arranged in parallel; a connecting shaft, said connecting shaft being capable of moving axially between a working position where the connecting shaft is adapted to one of the plurality of tool bits by passing through the tool chamber and a release position wherein the connecting shaft is separated from one of the plurality of tool bits; said power tool also comprises a restricting mechanism arranged between the housing and the connecting shaft; said restricting mechanism comprises a restricting member operable to move between two positions; at a first position, said connecting shaft is at the working position, and said restricting member allows the axial movement of said connecting shaft; and at a second position, said connecting shaft is at the release position and said restricting member stops the tool bit to leave the tool chamber.

Preferably, a pressure plate is arranged between said cartridge and said transmission mechanism; one position, corresponding to one of tool chambers, of said pressure plate is formed with a hole through which said connecting shaft passes; and said restricting member is arranged on said pressure plate and is partly overlapped with said hole.

Preferably, said restricting member is a U-shaped spring axially fixed on said pressure plate. Said U-shaped spring can deform elastically along the radial direction of said hole.

Preferably, said restricting member is a spring plate of which one end is axially fixed on said pressure plate and the other end is partly overlapped with said hole.

Preferably, said connecting shaft is provided with an annular recess. When said connecting shaft is at the working position, said annular recess is axially corresponding to the position of said restricting member.

Preferably, said housing is slidably connected with an operating member. One part of said cartridge is received in said housing, while the other part is overlapped by said operating member and exposed along with the movement of said operating member.

Preferably, one end of said connecting shaft is connected with said transmission mechanism in torque transmission way, while the other end of said connecting shaft is capable of connecting with said output shaft and driving said tool bit to rotate via said output shaft.

Compared with the prior art, the present invention has the following benefits: The tool bit is restricted from moving backward with the connecting shaft when the power tool is changing the tool bit, thus ensuring high reliability.

To overcome the defects in the prior art, the present invention provides a power tool which is reliable in work and low in cost.

The present invention adopts the following technical scheme to solve the problems: A power tool comprising; a housing; a motor, arranged in the housing and outputting rotary force; an output shaft, having holes formed axially to receive tool bits; a tool bit support mechanism, arranged in the housing and having a plurality of tool chambers arranged in parallel for receiving tool bits, said tool bit support mechanism capable of being adjusted to a position, axially corresponding to the output shaft, of one of the tool chambers; a connecting shaft, arranged in the housing, said connecting shaft capable of moving between two positions, wherein at the first position, said connecting shaft is adapted to one of the tool bits and puts the tool bit at the working position in the hole, while at the second position, said connecting shaft puts the tool bit at the receiving position of the tool bit support mechanism and can be separated from the tool bit; said power tool also comprises a return guide device adjacent to the tool bit support mechanism by which the tool bit is axially separated from the connecting shaft and kept at the receiving position when said connecting shaft moves from the first position to the second position.

Preferably, said return guide device comprises a support face contacting with the tool bit support mechanism and a guide face connected with the support face. The movement of said tool bit support mechanism can drive the tool bit that is adapted to the connecting shaft to separate from the connecting shaft by the action of the guide face.

Preferably, said tool bit support mechanism and said transmission mechanism are provided with a cover plate on which said support face and guide face are located.

Preferably, said cover plate is provided with a step-like protrusion along with the track of the tool bit moving with the position adjustment of the tool bit support mechanism. Said support face and said guide face are located on said step-like protrusion.

Preferably, a position, corresponding to the connecting shaft, of said cover plate is formed with a through-hole. Said guide face rises progressively from the position of the through-hole to the outside.

Preferably, there are two guide faces located on the track of the tool bit moving with the position adjustment of the tool bit support mechanism and distributed on two sides of the through-hole.

Preferably, said guide face is arranged to surround said through-hole.

Preferably, said guide face is an inclined plane.

Preferably, said inclined angle between said inclined plane and the end face of the cartridge ranges from 10 degrees to 30 degrees.

Preferably, said tool bit support mechanism is rotationally supported between said housing and said cover plate.

Preferably, one end of said connecting shaft is connected with said transmission mechanism in torque transmission way, while the other end of said connecting shaft is capable of connecting with said output shaft and driving said tool bit to rotate via said output shaft.

Compared with the prior art, the present invention has the following benefits: The power tool enables the connecting shaft to separate from the tool bit by a simple structure and keeps the tool bit in the tool bit support mechanism, thus ensuring high reliability and reducing cost.

To overcome the defects in the prior art, the present invention provides a highly reliable and universal power tool.

The present invention adopts the following technical scheme to solve the problem: A power tool comprising; a housing; a motor, arranged in the housing and outputting rotary force; an output shaft, having a tool chamber axially formed to receive one of a plurality of tool bits, said output shaft being rotationally supported on said housing and axially fixed with respect to said housing; a transmission mechanism, arranged between said motor and said output shaft and transmitting the rotary force output from said motor to said output shaft; a cartridge, arranged in the housing, said cartridge comprising a tool chamber for receiving a plurality of tool bits arranged in parallel; and a connecting shaft, said connecting shaft being capable of moving axially between a working position where the connecting shaft is adapted to one of the plurality of tool bits by passing through the tool chamber and a release position where the connecting shaft is separated from one of the plurality of tool bits, wherein one end of said connecting shaft is connected with said transmission mechanism in a torque transmission way, while the other end of said connecting shaft is connected with said output shaft and drives said output shaft to rotate.

Compared with the prior art, the present invention has the following benefits: The way that the power tool indirectly drives the tool bit to rotate via the connecting shaft reduces the torque transmission distance, ensure high reliability, and is applicable to standard tool bits and highly universal.

To overcome the defects in the prior art, the present invention provides a power tool which is convenient to operate and highly tight.

The present invention adopts the following technical scheme to solve the problem: A power tool comprising; a housing; a motor, arranged in the housing and outputting rotary force; an output shaft, having holes formed axially to receive tool bits; a transmission mechanism, arranged between the motor and the output shaft and transmitting the rotary force output from the motor to the output shaft; a cartridge, arranged in the housing, said cartridge comprising a tool chamber for receiving a plurality of tool bits arranged in parallel; a connecting shaft, said connecting shaft being capable of moving axially between a working position where the connecting shaft is adapted to one of the plurality of tool bits by passing through the tool chamber and a release position wherein the connecting shaft is separated from one of the plurality of tool bits; said power tool also comprises an operating member moveably connected to the housing, wherein said operating member can move between two positions; at the first position, said connecting shaft is located at the working position, said operating member is pressed against said housing and covers a part of said cartridge; at the second position, said connecting shaft is located at the release position, and said operating member is arranged in a way of keeping a clearance from said housing and exposes one part of said cartridge.

Preferably, the upper part of said housing is provided with an open portion from which a part of said cartridge is exposed.

Compared with the prior art, the present invention has the following benefits: The power tool is effectively sealed during working, and by said operating member the said connecting shaft is conveniently operable to move.

To overcome the defects in the prior art, the present invention provides a power tool which is easy to operate.

The present invention adopts the following technical scheme to solve the problem: A power tool comprising; a housing; a motor, arranged in the housing and outputting rotary force; an output shaft, having holes formed axially to receive tool bits; a transmission mechanism, arranged between the motor and the output shaft and transmitting the rotary force output from the motor to the output shaft; a tool bit support mechanism, arranged in said housing and having a plurality of tool chambers arranged in parallel to supporting said tool bits, said tool bit support mechanism capable of being adjusted to a position, axially corresponding to said output shaft, of one of the tool chambers; and a connecting shaft, arranged in said housing, said connecting shaft being capable of moving between two positions to bring the tool bit to the working position in the hole or the receiving position in the tool bit support mechanism, wherein said transmission mechanism comprises a self-locking device for non-return transmission of the rotary power from said motor to said output shaft.

Preferably, said transmission mechanism comprises a planetary gear mechanism driven by the motor and a gear mechanism driven by the planetary gear mechanism. Said self-locking device is arranged between said planetary gear mechanism and said gear mechanism.

Preferably, said self-locking device comprises a plate adaptor connected with said planetary gear mechanism for driving said gear mechanism, a fixed plate which is fixedly connected with respect to said housing, and an intermediate transmission mechanism for connecting said plate adaptor and said fixed plate for realizing one-way transmission.

Preferably, said planetary gear mechanism comprises an output planet carrier. Said plate adaptor is provided with external splines which are connected with internal splines on the output planet carrier.

Preferably, said external splines are in loose fit with said internal splines along the circumference.

Preferably, said intermediate transmission mechanism comprises at least one plane arranged on the outer surface of the plate adaptor along the circumference, the inner round face of the fixed plate, and at least one pin roller located between said plane and the inner round face of said fixed plate.

Preferably, said output planet carrier comprises a plurality of supporting legs extending to a position between said plane and said inner round face. Said pin roller is located between two adjacent supporting legs.

Preferably, the outer surface of said fixed plate is provided with a projection for fixed connection with said housing.

Preferably, said gear mechanism comprises a first gear connected with said planetary gear mechanism, a third gear for driving said output shaft, and a second gear engaged with the first and third gears simultaneously.

Compared with the prior art, the present invention has the following benefits: By the self-locking device, the power tool is applicable to operation of multiple modes, which brings convenience to the operators to use the power tool in many occasions.

To overcome the defects in the prior art, the present invention provides a highly reliable power tool with a long service life.

The present invention adopts the following technical scheme to solve the problem: A power tool comprising; a housing; a motor, arranged in the housing and outputting rotary force; an output shaft, having holes formed axially to receive tool bits; a transmission mechanism, arranged between the motor and the output shaft and being capable of transmitting the rotary force from the motor to the output shaft; a tool supporting mechanism, arranged in said housing and having a plurality of tool chambers arranged in parallel to support said tool bits, said tool bit support mechanism capable of being adjusted to a position, axially corresponding to said output shaft, of one of the tool chambers; and a connecting shaft, arranged in said housing, said connecting shaft being capable of moving between two positions to bring the tool bit to the working position in the hole or the receiving position in the tool supporting mechanism, and said connecting shaft having a working end adapted to the tool bit and a supporting end opposite to the working end; said power tool also comprises a supporting member for being axially pressed against said supporting end when the tool bit is at the working position, wherein said tool bit and working end or said supporting member and supporting end have point contact.

Preferably, said supporting member is axially fixed at said supporting end that is rotationally supported on said supporting member.

Preferably, said connecting shaft can move axially. Said power tool also comprises an operating member which is connected to said housing and is operable to drive said connecting shaft to move axially.

Preferably, said operating member is connected with said operating member. Said operating member drives said connecting shaft by said supporting member.

Preferably, the axial movement of said operating member along said connecting shaft at least has two journeys; within the first journey, said operating member drives said connecting shaft to move together; and within the second journey, said connecting shaft is fixed with respect to said housing, while said operating member moves with respect to said housing.

Preferably, the axial movement of said operating member along said connecting shaft is provided with a first projection and a second projection located on two sides of said supporting member; said supporting member can move axially along said connecting shaft between the first projection and the second projection.

Preferably, said supporting member is a square member.

Preferably, said operating member is fixedly provided with a projection extending to the middle part of said square member, and said projection can move axially on two sides of said square member with respect to said connecting shaft.

Preferably, said power tool also comprises a restricting member arranged between the housing and the connecting shaft. Said restricting member is operable to move between two positions; at the first position, said restricting member is pressed against said supporting member and restricts the movement of the connecting shaft in the direction away from the tool bit; and at the second position, said restricting member is separated from said supporting member and allows the movement of the connecting shaft in the direction away from the tool bit.

Compared with the prior art, the present invention has the following benefits: The power tool reduces the friction between the tool bit and the connecting shaft or between the connecting shaft and the supporting member in a way mean of point contact of the rotary support, thus ensuring the long service life of the tool and meanwhile reducing the cost.

To overcome the defects in the prior art, the present invention provides a highly reliable and compact power tool.

The present invention adopts the following technical scheme to solve the problem: A power tool comprising; a housing; a motor, arranged in the housing and outputting rotary force; an output shaft, having holes axially formed for receiving tool bits; a transmission mechanism, arranged between the motor and the output shaft and capable of transmitting the rotary force from the motor to the output shaft; a tool supporting mechanism, arranged in the housing and having a plurality of tool chambers arranged in parallel for supporting the tool bits, said tool supporting mechanism capable of being adjusted to a position, axially corresponding to the output shaft, of one of the tool chambers; and a connecting shaft, arranged in the housing, said connecting shaft being capable of moving between two positions to bring the tool bit to the working position in the hole or to the receiving position in the tool supporting mechanism; wherein said transmission mechanism comprises a planetary gear mechanism driven by the motor and a gear mechanism driven by the planetary gear mechanism; said planetary gear transmission comprises an output planet carrier for driving said gear mechanism; said gear mechanism comprises a first gear arranged to be coaxial with the rotating axis of said output planet carrier, a third gear arranged to be coaxial with the rotating shaft of said output shaft, and a second gear engaged with the first and second gears simultaneously.

Preferably, the rotating centers of said first gear, second gear and third gear are located on the same straight line.

Preferably, the rotating centre of said second gear is eccentrically located with respect to the rotating centers of the said first gear and said third gear.

Preferably, the eccentric scope of said second gear with respect to the connecting line of the rotating centers of the first and third gear is 0.1-0.3 times the diameter of the pitch circle of the first gear.

Preferably, the diameter of the pitch circle of said first gear is smaller than half of the distance from the rotating axis of the output shaft to the rotating shaft of the motor.

Preferably, the diameter of the pitch circle of said second gear is smaller than the diameter of the pitch circle of the first gear.

Preferably, the diameter of the pitch circle of said first gear is 1.1 to 1.5 times the diameter of the pitch circle of the second gear.

Preferably, the drive from said first gear to said second gear is step-up drive, and the drive from said second gear to said third gear is step-down drive.

Preferably, the drive ratio of said first gear to said third gear is 1:1.

Preferably, the connecting shaft is arranged between the third gear and the output shaft, the rotary torque of the motor transmitted to the output shaft via the third gear and the connecting shaft.

Compared with the prior art, the present invention has the following benefits: By rational arrangement of the gear mechanism, the power tool ensures high reliability during transmission meanwhile, the power tool is minimized because of the compact structure.

The present invention adopts the following technical scheme to solve the problem: A power tool comprising; a housing; a motor, arranged in the housing and outputting rotary force; an output shaft, having holes axially arranged for receiving tool bits, the cross section of the handle portion of said tool bit being polygonal; and a transmission mechanism, arranged between the motor and the output shaft and being capable of transmitting the rotary force from the motor to the output shaft; wherein said hole is provided with a torque transmission portion and a correction portion; said torque transmission portion is at least one radial protrusion; said at least one radial protrusion is pressed against one of the faces of said tool bit and restricts the rotation of the tool bit with respect to the output shaft; said correction portion is an inclined plane located in the hole; and said tool bit contacts with said inclined plane, and the output shaft or the tool bit is driven by the inclined plane to rotate so as to adapt said hole to said tool bit.

Preferably, said radial protrusion extends along the axial direction of the output shaft and is connected with said inclined plane.

Preferably, there are 12 radial protrusion uniformly distributed along the circumference of said output shaft.

Preferably, said radial protrusion is at least one of 12 corners internally connected with said hole.

Preferably, one end, close to said inclined plane, of said hole is provided with a guide portion. Said guide portion is an inner step with an inner diameter bigger than that of the hole. The axial height of said inner step is equal to that of the inclined plane.

Preferably, said hole is also provided with a channel inside which is opposite to said radial protrusion and has a bottom surface in connection with said hole and two lateral surfaces, and said two lateral surfaces are inclined along the circumference.

Preferably, said channel is communicated with said inner step along the axial direction of said output shaft.

Preferably, the power tool further comprising a cartridge, arranged in the housing, said cartridge comprising a tool chamber for receiving a plurality of tool bits arranged in parallel; and a connecting shaft, said connecting shaft being capable of moving axially between a working position where the connecting shaft is adapted to one of the plurality of tool bits by passing through the tool chamber and a release position wherein the connecting shaft is separated from one of the plurality of tool bits Preferably, one end of said connecting shaft is connected with said transmission mechanism in torque transmission way, while the other end of said connecting shaft is capable of connecting with said output shaft and driving said tool bit to rotate via said output shaft.

The present invention adopts another technical scheme to solve the technical problem: A power tool, comprising: a housing; a motor, arranged in the housing and outputting rotary force; an output shaft, having holes formed axially for receiving tool bits, the cross section of said tool bit being a polygonal stressed portion; a transmission mechanism, arranged between the motor and the output shaft and being capable of transmitting the rotary force from the motor to the output shaft; a tool supporting mechanism, arranged in the housing and having a plurality of tool chambers arranged in parallel for supporting the tool bits; a connecting shaft, arranged in the housing and enabling the tool bit to be located at the working position in the hole or located at the receiving position in the tool supporting mechanism; wherein said hole comprises a torque transmission portion and a correction portion; said torque transmission portion can restrict the rotation of the tool bit with respect to the output shaft; the output shaft is provided with an elastic pressing device which at least partly extends into said correction portion; and when the tool bit enters the torque transmission portion from the correction portion, said tool bit can rotate with respect to the output shaft by the action of the elastic pressing device.

Preferably, said torque transmission portion comprises at least one radial protrusion that is pressed against said torque stressed portion and restricts the rotation of the tool bit with respect to the output shaft.

Preferably, said torque transmission portion comprises 12 radial protrusions that are uniformly arranged. Said 12 radial protrusions contact with said torque stressed portion and restrict the rotation of the tool bit with respect to the output shaft. The part of said elastic pressing device extending into said correction portion and the joint of adjacent two of said 12 radial protrusions are aligned along the axial extension line.

Preferably, said torque transmission portion comprises 6 radial protrusions. Said 6 radial protrusions are 6 dodecagonal corners which are opposite in the radial direction and arranged uniformly. The part of said elastic pressing device extending into said correction portion is axially aligned with one of the 6 radial protrusions.

Preferably, every two of said 6 radial protrusions are in curve transition.

Preferably, said torque transmission portion is a regular polygon of which the cross section is matched with that of said torque stressed portion. The part of said elastic pressing device extending into said correction portion is aligned with at least one surface of said torque stressed portion along the axial extension surface.

Preferably, the cross section of said torque transmission portion and the cross section of said torque stressed portion are matched regular hexagons.

Preferably, said elastic pressing device comprises a pressing member which partly extends into said correction portion and an elastic member which presses said pressing member inwards along the radial direction of the output shaft.

Preferably, said elastic member is a C-shaped spring plate arranged around said output shaft, and said pressing member is arranged on two sides of the opening of said C-shaped spring plate.

Preferably, said elastic component is a spring plate arranged along the axial direction of the output shaft; and one end of said spring plate is fixed with respect to the housing, while the other end of said spring plate presses said pressing member.

Preferably, said elastic pressing device comprises an elastic member that has a pressing portion extending into said correction portion. Said pressing portion can move in the radial direction along the output shaft between the free state and pressed state of said elastic member.

Preferably, said elastic member comprises at least one C-shaped steel wire arranged around said output shaft, and said pressing member is arranged on two sides of the opening of said C-shaped steel wire.

Preferably, there are two said C-shaped steel wires distributed at an interval along the axial direction of the output shaft.

Preferably, two pressing portions of said two C-shaped steel wires are arranged in a staggered way along the circumference.

Preferably, said elastic component is a spring plate arranged along the axial direction of the output shaft; and one end of said spring plate is fixed with respect to the housing, while said pressing portion is arranged at the other end of said spring plate.

The present invention adopts another technical scheme to solve the technical problem: A power tool comprising; a housing; a motor, arranged in the housing and outputting rotary force; an output shaft, having holes formed axially for receiving tool bits, the cross section of said tool bit being a polygonal stressed portion; a transmission mechanism, arranged between the motor and the output shaft and being capable of transmitting the rotary force from the motor to the output shaft; a tool supporting mechanism, arranged in the housing and having a plurality of tool chambers arranged in parallel for supporting the tool bits; a connecting shaft, arranged in the housing and enabling the tool bit to be located at the working position in the hole or located at the receiving position in the tool supporting mechanism; wherein said output shaft is provided with a tool groove in radial communication with said hole; said tool groove receives a locking member which at least partly extends to said hole; said output shaft can axially move between a first position and a second position; at the first position, said locking member can move along the radial direction of the output shaft and thereby allow the rotation of the tool bit with respect to the output shaft; and at the second position, said locking member is restricted from moving along the radial direction of the output shaft and thereby restricts the rotation of the tool bit with respect to the output shaft.

Preferably, said power tool also comprises an elastic member pressing against said output shaft towards the second position.

Preferably, said output shaft is fixedly sleeved with the restricting member outside with respect to the axial position of the housing. Said restricting member is provided with a clamping portion and a release portion that are adjacently arranged and are matched with said locking member. Said locking member can be engaged with the release portion at the first position and engaged with the clamping portion at the second position.

Preferably, said elastic member is sleeved on said output shaft and axially located between said output shaft and said restricting member.

Preferably, said tool groove comprises a first tool groove and a second tool groove that are arranged at an interval along the axial direction of said output shaft. Said locking member comprises a first locking member received in the first tool groove and a second locking member received in the second tool groove. At the first position, said first locking member allows the tool bit to rotate with respect to said output shaft, while said second locking member allows said connecting shaft to rotate with respect to said output shaft; and at the second position, said first locking member restricts the tool bit from rotating with respect to said output shaft, while said second locking member restricts said connecting shaft from rotating with respect to said output shaft.

Preferably, one end, adjacent to said output shaft, of said connecting shaft is provided with a magnet.

Preferably, said housing is provided with an operating member that is operable to drive said connecting shaft to move axially such that the tool bit is located at the working position or the receiving position.

Preferably, said operating member is moveably connected to said hosing and can move along the axial direction of said output shaft with respect to said housing.

Compared with the prior art, the present invention has the following benefits: The power tool enables the tool bit to smoothly enter the output shaft in the process of tool bit replacement by a simple structure, thus ensuring high reliability and reducing cost at the same time.

Aiming at the defects in the prior art, the objective of the present invention provides a power tool which is simple to operate and high in efficiency.

The present invention adopts the following technical scheme to solve the technical problem: A power tool comprising; a housing; a motor, arranged in the housing and outputting rotary force; a connecting shaft, adapted to one of a plurality of tool bits and driving one of the plurality of tool bits to rotate; a transmission mechanism, arranged between the motor and the connecting shaft and being capable of transmitting the rotary force from the motor to the connecting shaft; a cartridge, partly received in the housing, said tool chamber comprising a tool chamber for receiving the plurality of tool bits which are arranged in parallel, said connecting shaft being capable of moving axially between a working position where the connecting shaft is adapted to one of the plurality of tool bits by passing through the tool chamber and a release position where the connecting shaft is separated from one of the plurality of tool bits; wherein said housing is provided with an open portion; and when said connecting shaft is located at the release position, said cartridge can be removed from said housing via said open portion.

Preferably, said power tool also comprises an operating member arranged on the housing. Said operating member can drive said connecting shaft to axially rotate; and the other end of said cartridge is covered said operating member and exposed along with said operating member.

Preferably, the inner wall of said housing is provided with a support rod extending axially along said connecting shaft. Said cartridge is rotationally supported on said support rod.

Preferably, said housing is provided with a through-hole radially opposite to said open portion.

Preferably, said housing is installed with a spring plate for sealing said through-hole.

Preferably, said elastic plate is a rubber cushion.

Preferably, said through-hole is provided with a button inside which can move radially with respect to said connecting shaft.

Preferably, the end face, close to the transmission mechanism, of said cartridge is provided with a plurality of locating grooves that are distributed along the circumference of said cartridge. Said housing is provided with an elastic locating member inside which can be matched with one of a plurality of locating grooves. Said elastic locating member is arranged at the bottom of said housing and at a position radially opposite to said open portion.

Preferably, at least one of the plurality of locating grooves is communicated with the circumferential face of said cartridge along the radial direction of said cartridge.

Preferably, said power tool also comprises an output shaft that has holes axially arranged for receiving the tool bits. The cross section of the handle portion of said tool bit is a regular polygon. Said connecting shaft is connected with said output shaft and drives said output shaft to put said tool bit in rotary motion.

Preferably, said housing is provided with a gear case inside. Said transmission mechanism is received in said gear case. The diameter of said cartridge is smaller than the radial dimension of said gear case.

Compared with the prior art, the present invention has the following benefits: The cartridge for the tool bits of the power tool can be directly removed from the housing; the operation is simple; it is quick to replace different tool bits, and thus, the working efficiency is high.

Aiming at the defects in the prior art, one objective of the present invention is to provide a cartridge which makes distinguishing of the positions of tool bits easy.

Another objective of the present invention is to provide a power tool that is simple in operation and high in efficiency.

The present invention adopts the following technical scheme to solve the technical problem: A cartridge for receiving tool bits comprises a main body; said main body has a rotation axis; said main body is provided with a plurality of tool chambers for receiving tool bits; the plurality of tool chambers are parallel to said rotation axis and are uniformly arranged around said rotation axis; said main body has a circumferential wall surrounding the plurality of tool chambers; said circumferential wall is provided with identification means for different tool bits; and said identification means is corresponding to the position of said tool chamber.

Preferably, said identification means comprises characters, symbols, patterns or combinations thereof for representing different tool bits.

Preferably, said identification means comprises characters, symbols, patterns or combinations thereof for representing models of different tool bits.

Preferably, said identification means is fixed on the outer circumferential wall of said main body in a way of printing, molding, embedding or sticking.

Preferably, the peripheral wall of said main body is provided with a plurality of protrusions or recesses in parallel to the axial directing of said main body.

Preferably, said identification means is located at one end of said peripheral wall with respect to the axial direction of said main body, and said protrusions or recesses are located at the other end of said peripheral wall with respect to the axial direction of said main body.

Preferably, said identification means is removably installed on the peripheral wall of said main body.

Preferably, the end face of said main body is provided with a plurality of locating grooves corresponding to a plurality of tool chambers.

Preferably, any one of a plurality of locating grooves is communicated with the peripheral wall of said main body along the radial direction of said main body.

The present invention adopts another technical scheme to solve the technical problem: A cartridge for receiving tool bits comprises a main body; said main body has a rotation axis; said main body is provided with a plurality of tool chambers for receiving tool bits; the plurality of tool chambers are parallel to said rotation axis and are uniformly arranged around said rotation axis; said main body has a peripheral wall surrounding the plurality of the tool chambers; and said peripheral wall is at least partly made from a transparent material.

Preferably, the part of said peripheral wall that encloses the plurality of tool chambers is made from a transparent material.

Preferably, the transparent part made from the transparent material is located at the axial end of said main body.

Preferably, the length of said transparent part along the axial direction of the main body is less than half of the length of the main body.

Preferably, said transparent part is detachably installed on the main body.

Preferably, said transparent part is shaped as a circular ring.

Preferably, all said peripheral wall is made from the transparent material.

Preferably, all said main body is made from a transparent material.

Preferably, the peripheral wall of said main body is provided with a plurality of protrusions or recesses in parallel to the axial directing of said main body.

Preferably, the end face of said main body is provided with a plurality of locating grooves corresponding to a plurality of tool chambers.

Preferably, any one of a plurality of locating grooves is communicated with the peripheral wall of said main body along the radial direction of said main body.

The present invention adopts another technical scheme to solve the technical problem: A cartridge for receiving tool bits comprises a main body; said main body has a rotation axis; said main body is provided with a plurality of tool chambers for receiving tool bits; the plurality of tool chambers are parallel to said rotation axis and are uniformly arranged around said rotation axis; said main body has a peripheral wall surrounding the plurality of the tool chambers; characterized in that: said peripheral wall is provided with a view hole which extends from one end of the peripheral wall along the axial direction of the main body;

and said view hole is corresponding to the position of said tool chamber and is radially communicated with the tool chamber.

Preferably, the length of said view hole along the axial direction of the main body is less than half of the length of the main body.

Preferably, the length of said view hole along the axial direction of the main body is 0.3~0.4 times the length of the main body.

Preferably, the width of said view hole along the circumference of the main body is 0.7~0.9 times the diameter of the tool chamber.

Preferably, said main body is provided with a through-hole concentric with the rotating centre of the main body.

Preferably, the peripheral wall of said main body is provided with a plurality of protrusions or recesses in parallel to the axial directing of said main body.

Preferably, the other end face, opposite to said view hole, of said main body is provided with a plurality of locating grooves corresponding to a plurality of tool chambers.

Preferably, any one of a plurality of locating grooves is communicated with the peripheral wall of said main body along the radial direction of said main body.

The present invention adopts another technical scheme to solve the technical problem: A power tool comprising; a housing; a motor, arranged in the housing and outputting rotary force; an output shaft, having holes formed axially to receive tool bits; a transmission mechanism, arranged between the motor and the output shaft and being capable of transmitting the rotary force from the motor to the output shaft; a connecting shaft, arranged in the housing, said connecting shaft is adapted to one of the tool bits and puts the tool bit at the working position in the hole; wherein the power tool further comprising a cartridge according to above three technical solution, said connecting shaft is adapted to one of the tool bits and puts the tool bit at the receiving position in the cartridge.

Compared with the prior art, the present invention has the following benefits: The cartridge of the present invention can quickly identify the type of the tool bits installed in the tool chambers by the identification means, the transparent part or the view hole to facilitate use by the operator; with the cartridge on the power tool of the present invention, the required tool bits for replacement can be selected quickly, so the working efficiency is high.

BRIEF DESCRIPTION OF THE DRAWINGS

The above and other objects, features and advantages of the invention will become more apparent from the following description of embodiments in conjunction with the accompanying drawings in which.

DETAILED DESCRIPTION OF THE INVENTION

In the preferred embodiment of the power tool of the present invention, the power tool is a power screwdriver. In terms of power source, the screwdriver can be classified into a pneumatic screwdriver, hydraulic screwdriver and electric screwdriver. The electric screwdriver also can be classified into direct-current type and alternating-current type. In the present invention, the DC electric screwdriver is preferably selected as an example for description.

Figure 1:
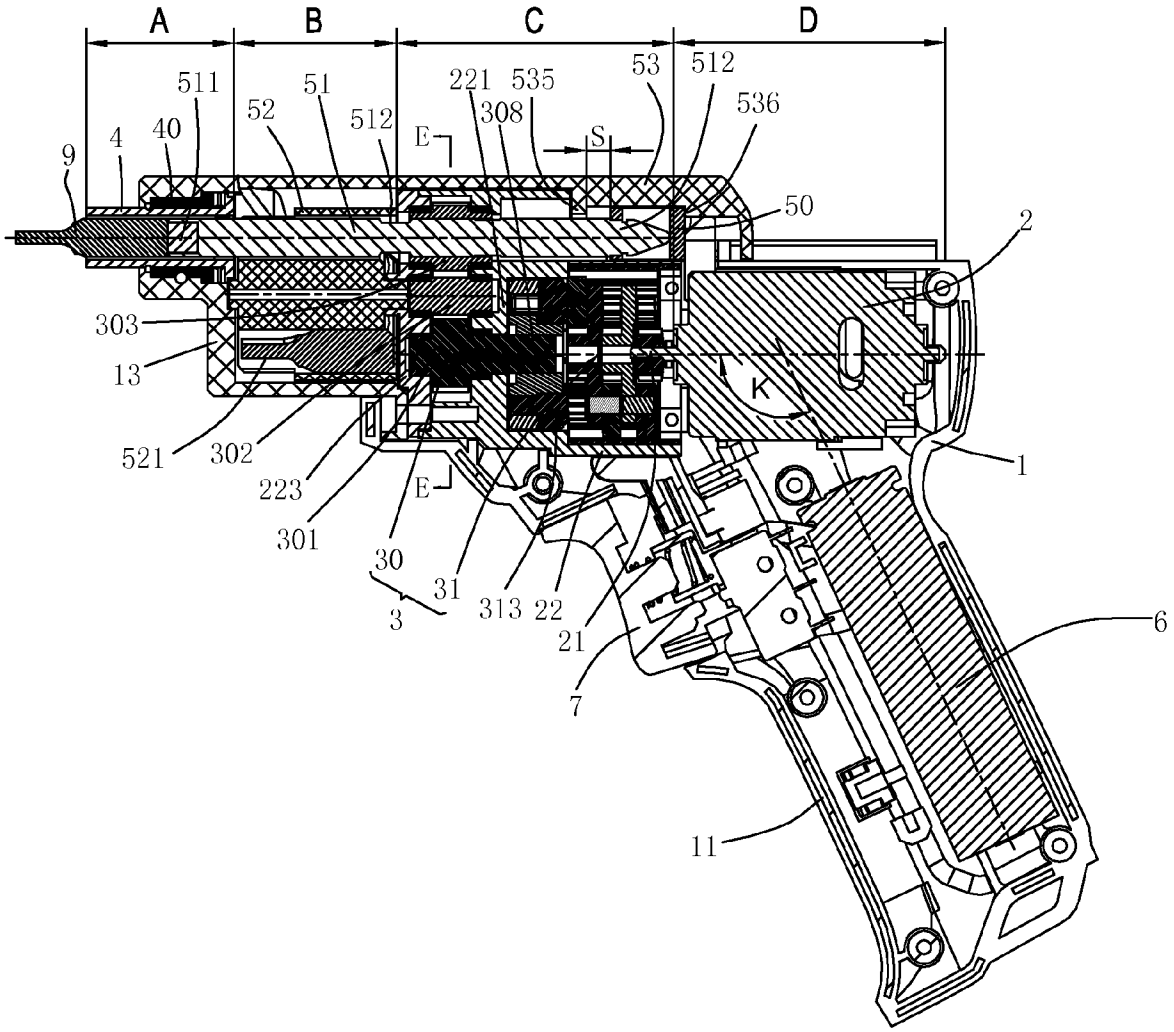
FIG. 1 is a cross-sectional view of a power tool such that the power tool is located at the working position according to a first preferred embodiment of the present invention.
Figure 2:
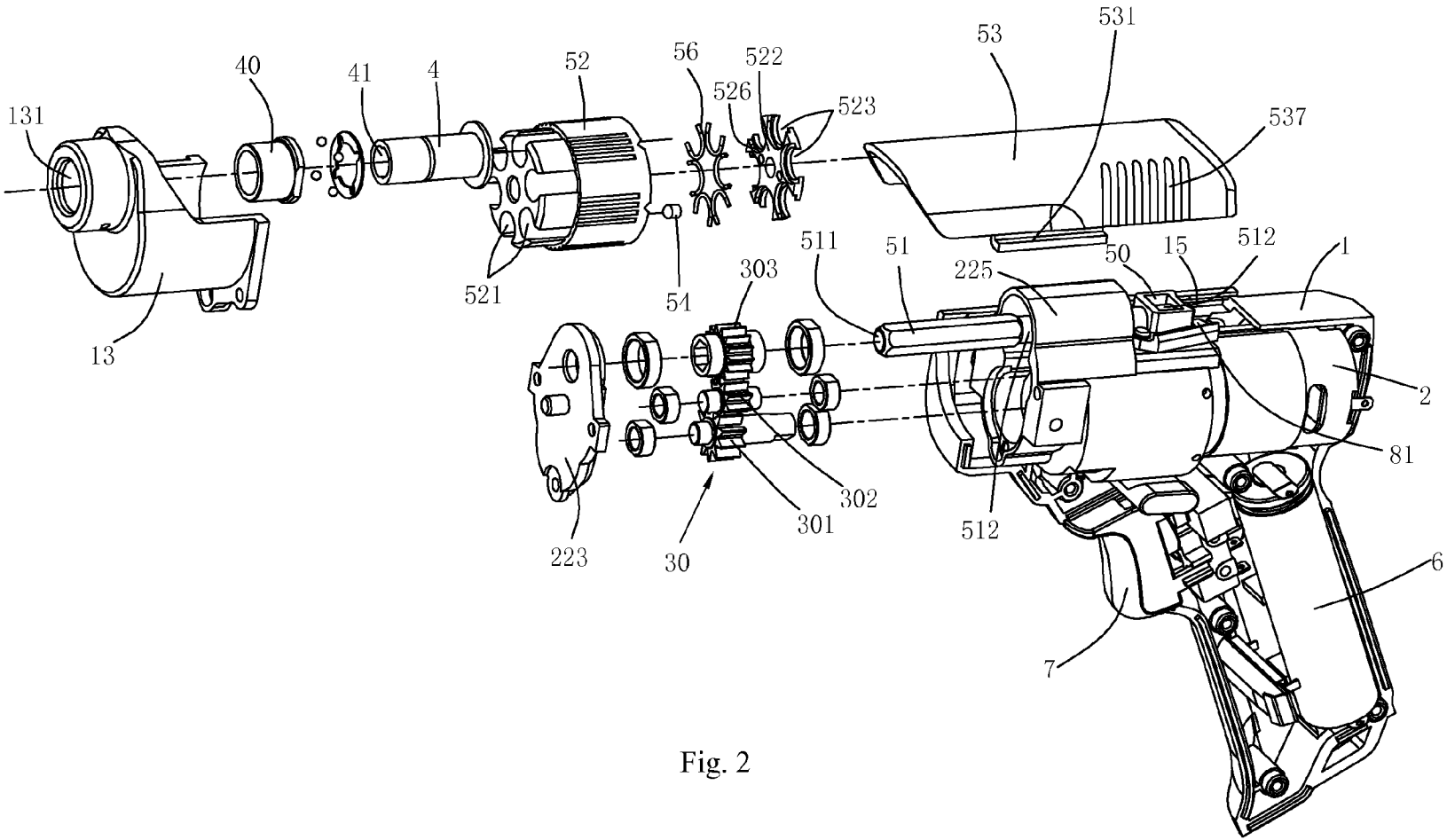
FIG. 2 is a partial exploded view of FIG. 1.

As shown in FIG. 1 and FIG. 2, the DC electric screwdriver comprises a housing 1, a motor 2, a battery 6, a transmission mechanism 3, a connecting shaft 51, a tool supporting mechanism and an output shaft 4. The housing 1 is assembled by gathering together left and right two symmetric semi-housings by screws (not shown in the figure), which has a horizontal part and a handle 11 arranged at an angle of K to the horizontal part. The preferred angle K of the present invention ranges from 100 degrees to 130 degrees, so that it is comfortable to hold the handle 11 during operation. The upper part of the handle 11 is provided with a button switch 7. The battery 6 is fixed at the rear part of the handle 11. The transmission mechanism 3 is received in the horizontal part of the housing 1. As the preferred embodiment, the battery 6 may be a lithium-ion battery. It should be noted that, the lithium-ion battery is a generic term of rechargeable batteries with lithium element as the material for the negative electrode; according to different materials for the positive electrode, the lithium-ion battery can be classified into different types, such as "lithium-magnesium" battery and "lithium-iron" battery. In this embodiment, the lithium-ion battery is a singe lithium-ion cell with a rated voltage of 3.6V. Of course, the battery 6 may also be other battery types known by those skilled in this field, such as nickel-chromium battery and nickel-hydrogen battery.

The transmission mechanism 3 comprises a planetary gear mechanism 31 and a gear mechanism 30 driven by the motor 2 from the rear side to the front side (the right side of the figure is taken as the rear side), wherein the gear mechanism 30 is connected with the connecting shaft 51 and transmits the rotary power of the motor 2 to the output shaft 4 by the connecting shaft 51. The tool supporting mechanism is used for receiving different tool bits. Here, the tool bits mainly refer to cross screwdriver bits, straight screwdriver bits, drill bits, etc. usually used by the electric screwdriver. By operating the connecting shaft 51 to move axially to pass or leave the tool supporting mechanism, and adjusting the position of the tool supporting mechanism, different tool bits can be quickly replaced when the electric screwdriver fastens or unfastens different screws.

According to the composition of the above electric screwdriver, the electric screwdriver can be divided into a motor portion D with a motor, a transmission portion C with a transmission mechanism 3, a cartridge portion B with a cartridge and an output portion A with an output shaft from the rear side to the front side (the right side of the figure is taken as the rear side).

In the preferred embodiment of the invention, the motor 2 is electric motor having a motor shaft 21 extending forwards from the motor housing. The motor is fixed in the housing 1; a gear case 22 is fixed in the housing 1 and located at the front portion of the motor; the gear case 22 is used for receiving the planetary gear mechanism 31 and the gear mechanism 30 which are divided by a partition 221 there-between; a gear case cover plate 223 is arranged between the gear case 22 and the tool supporting mechanism; thus, the transmission mechanism 3 and the tool supporting mechanism can be partitioned, which means that the transmission mechanism 3 and the tool supporting mechanism are mutually independently. The gear mechanism 30 comprises a first gear 301 which is connected with the planetary gear mechanism 31 in a torque transmission way via a gear shaft 308, a third gear 303 connected with the connecting shaft 51, and a second gear 302 engaged with the first gear 301 and the third gear 303 at the same time, wherein the gear shaft 308 can be integrally arranged with the first gear 301; the second gear 302 transmits the rotation of the first gear 301 to the third gear 303; and the two ends of each gear are supported by shaft sleeves. The middle part of the partition 221 is provided with a hole through which the shaft of the first gear 301 passes; the end face of the partition 221 is provided with a groove for installing the shaft sleeve; the rear shaft sleeve for supporting the gear mechanism 30 is fixed on the partition 221, while the front shaft sleeve is fixed on the gear case cover plate 223; the gear case cover plate 223 can be fixedly connected with the gear case 22 by screws, fasteners, etc.; thus, the gear mechanism 30 and the planetary gear 31 can be separated and then sealed at the same time to prevent dust, powder, etc. from entering the transmission mechanism 3 and also avoid leakage of the lubricating oil.

Figure 3:
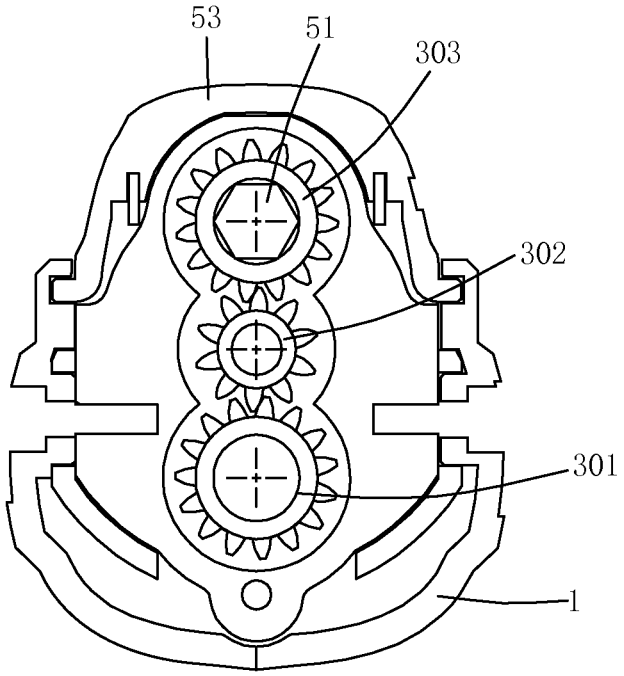
FIG. 3 is a schematic cross-sectional view taking along line E-E of FIG. 1.
Figure 4:
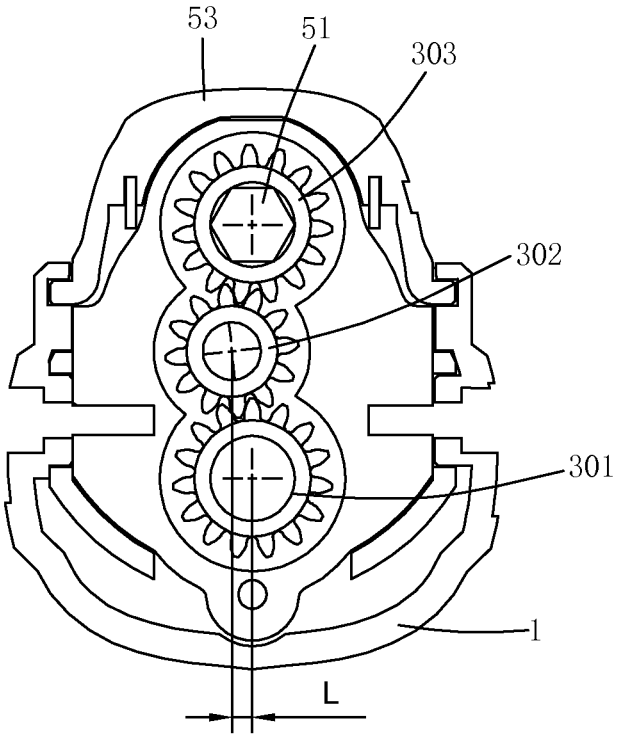
FIG. 4 is a schematic cross-sectional view of the other gear mechanism of the power tool of FIG. 3.

As shown in FIG. 3, the central lines of the first gear 301, the second gear 302 and the third gear 303 are located on the same straight line. To make the transmission more stable, the transmission ratio of the first gear 301 to the third gear 303 is 1:1 such that the transmission from the first gear 301 to the second gear 302 is step-up drive and that the transmission from the second gear 302 to the third gear 303 is step-down drive. If the pitch diameters of the first gear 301 and the third gear 303 are identical, then the pitch diameter of the second gear 302 is less than those of the first gear 301 and the third gear 303, thus ensuring optimal arrangement of the three gears when the centre are coaxial, and the minimum space. However, if the electric screwdriver is minimized, the small second gear 302 may need less gear teeth and therefore causes reduction of engaged teeth of the gears. The strength decline of the transmission pair makes the transmission unstable. If the second gear 302 is cancelled, the first gear 301 and the third gear 303 are arranged to be directly engaged. This also can transmit the motion, but the diameters of the first gear 301 and the third gear 303 must be increased; and thus, the large first gear 301 and the large third gear 303 inevitably increase the volume of the electric screwdriver. Therefore, as shown in FIG. 4, the second gear 302 can be eccentrically arranged with respect to the connecting line of the rotating centers of the first gear 301 and the third gear 303, which ensures that the dimensions of the second gear 302 are not too small and that the dimensions of the three gears in the parallel arrangement direction are not too large, such that the stable transmission among the three gears is guaranteed. The preferable eccentric scope L is 0.1-0.3 times of the pitch diameter of the first gear 301, and the pitch diameter of the first gear 301 is 1.1-1.5 times the pitch diameter of the second gear 302, thus ensuring high carrying capacity, high efficiency and long service life of the three gears. Besides, with the three gears, the internal space of the tool is more compact such that the good-looking appearance is not affected.

Of course, two gears can be arranged according to demands, one connected with the planetary gear mechanism 31 and the other connected with the connecting shaft 51. Moreover, the transmission mechanism 3 is not limited to the above types. The transmission mechanism 3 may exclusively include the planetary gear mechanism 31 or the gear mechanism 30, or other rotary motion transmission mechanism such as the ratchet mechanism or turbine mechanism. The planetary gear mechanism 31 has a three-stage deceleration system. The motor shaft 21 extends to engage with the planetary gear mechanism 31; the planetary gear mechanism 31 transmits the rotary motion to the gear mechanism 30; the gear mechanism 30 drives the connecting shaft 51 to rotate; and then the connecting shaft 51 drives the output shaft to rotate. Thus, the rotary motion of the motor 2 is transmitted by the planetary gear mechanism 31 and the gear transmission mechanism 30 and finally output by the output shaft 4. It can be seen that the transmission chain in this embodiment is: Motor-transmission mechanism-connecting shaft-output shaft, which means that the connecting shaft is the connecting shaft is part of the transmission chain. Besides, the deceleration mechanism obtains the required output rotation speed by the composition of the three-stage planetary deceleration and two-stage parallel shaft deceleration system. In other embodiment, the deceleration mechanism may only include a two-stage planetary deceleration system or other deceleration system according to the required rotation speed to be output.

Figure 5:
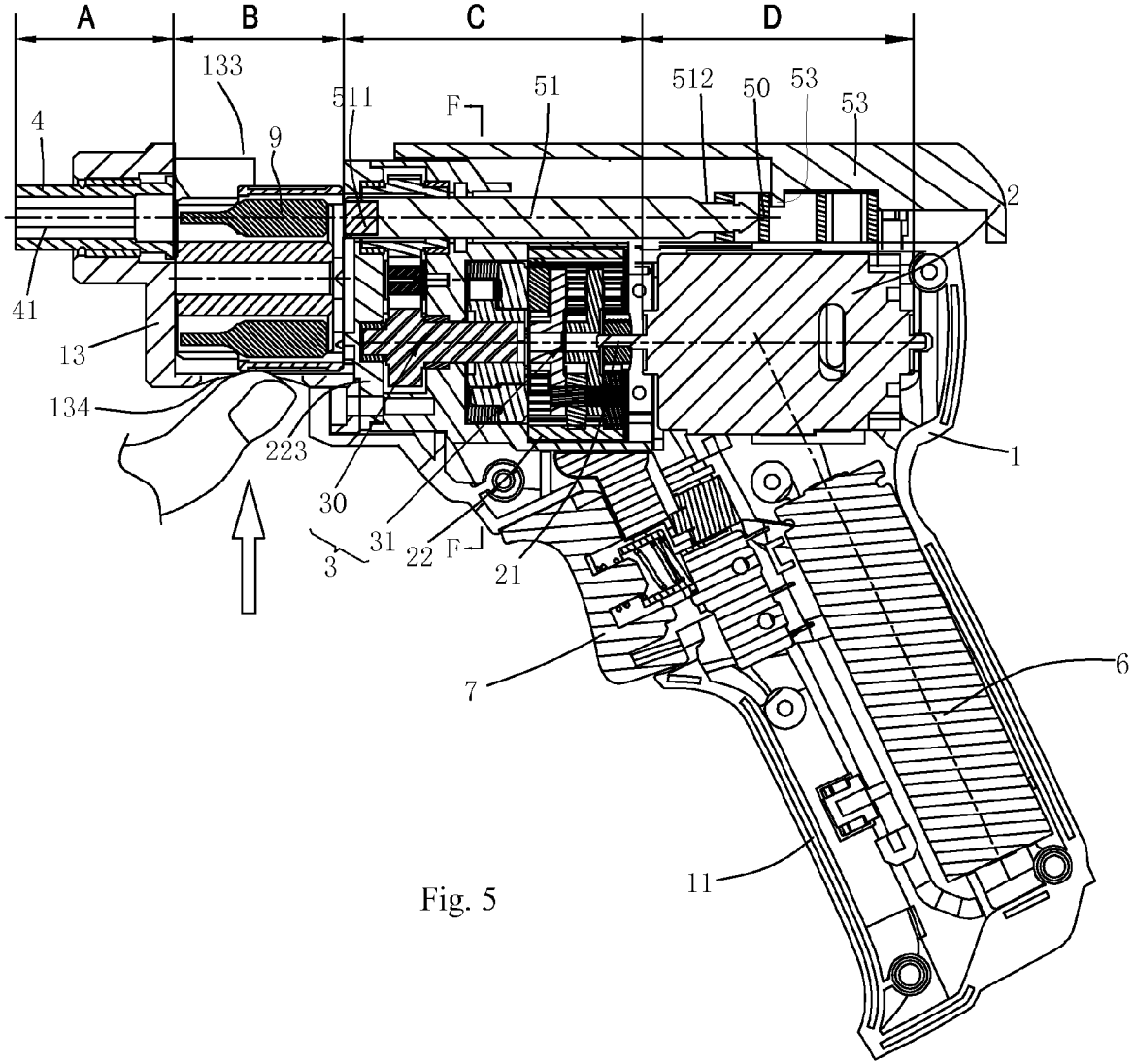
FIG. 5 is a cross-sectional view of a power tool when the tool bit of the power tool is being replaced according to a second preferred embodiment of the present invention.
Figure 6:
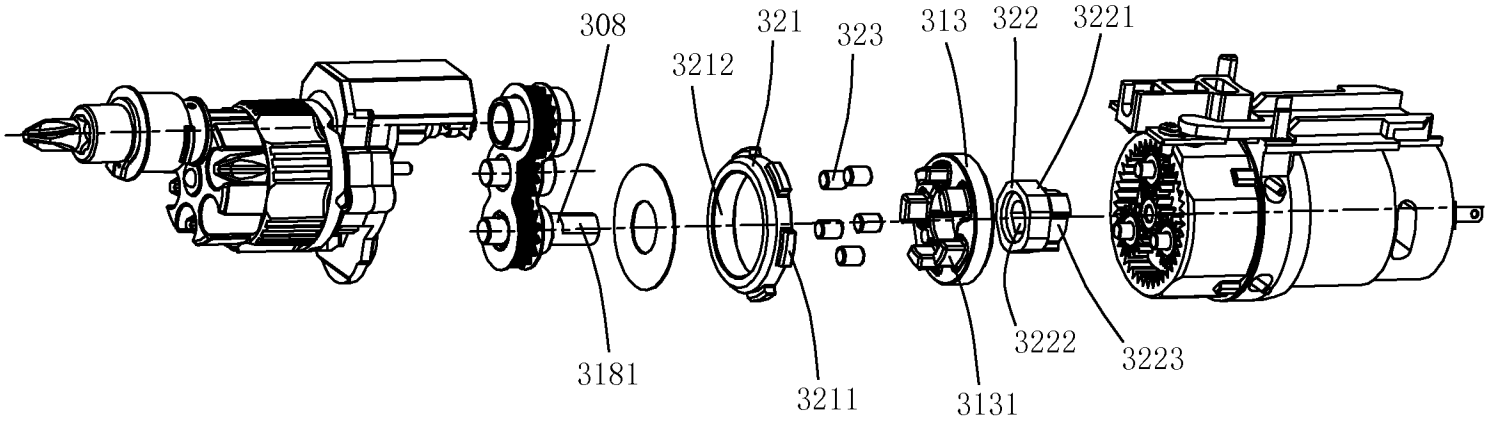
FIG. 6 is a partial exploded view of a self-locking device of the power tool of FIG. 5.
Figure 7:
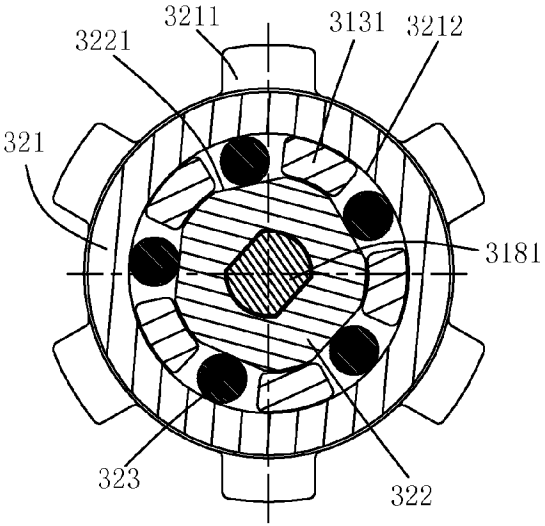
FIG. 7 is a schematic cross-sectional view taking along line F-F of FIG. 5.

As shown in FIG. 5, FIG. 6 and FIG. 7, the planetary gear mechanism 31 comprises an output planet carrier 313. The electric screwdriver has a self-locking device arranged between the planetary gear mechanism 31 and the gear mechanism 30. The self-locking device comprises a fixed plate 321; a plurality of fixed pins 3211 are uniformly arranged on the outer side of the circumference of the fixed plate 321; the fixed pins 3211 are closely connected together with the gear case 22 such that the fixed pin 321 is static with respect to the housing 1 and the gear case 22; and the inner side of the circumference of the fixed plate 321 is formed with inner circular face 3212. Within the scope of the inner circular face 3212, a plate adaptor 322 is arranged, and the central portion of the plate adaptor 322 is formed with a flat square hole 3222. One end of the gear shaft 308 is connected with the first gear 301, while the other end is set to be a flat portion 3181. The plate adaptor 322 is integrally connected with the gear shaft 308 via the flat square hole 3222 and the flat portion 3181 and therefore can rotate together with the gear shaft 308, wherein the adopted connection means may be a spline connection commonly used by those skilled in this field or other common connection means. The self-locking device also comprises a plurality of supporting legs 3131 which protrude from the end face of the output plant carrier 313 towards the first gear 301 and are fixedly arranged on the output planet carrier 313.

The outer side of the circumference of the plate adaptor 322 is formed into a plurality of planes 3221. One end, close to the output planet carrier 313, of the plate adaptor 322 is provided with a connection portion which has spline teeth 3223. The plate adaptor 322 is in loose fit with the output planet carrier 313 by the spline teeth 3223. Roller pins 323 are arranged between the fixed plate 321 and the plate adaptor 322, more specifically between the inner circular face 3212 of the fixed plate 321 and the plane 3221 of the plate adaptor 322. The pin rollers 323 are pressed against the inner circular face 3212 and the plane 3221 and can roll thereat. Besides, each pin roller 323 is inserted by the supporting legs 3131 of the output planet carrier 313, which means that the supporting legs 3131 are arranged between the inner circular face 3212 of the fixed plate 321 and the outside circular side of the plate adaptor 322. The supporting legs 3131 all are in clearance fit with the inner circular face 3212 of the fixed plate 321 and plate adaptor 322 and therefore can rotate around the centre of the plate adaptor 322.

Figure 8:
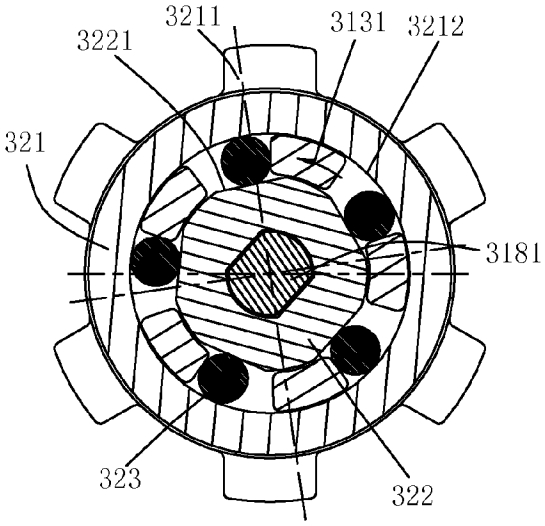
FIG. 8 is similar to FIG. 7, but the difference lies that the rotary of the output planet carrier is anticlockwise.

Further as shown in FIG. 8, when the button switch 7 is triggered, providing that the rotary output of the motor 2 is anticlockwise, the rotary torque generated by the motor 2 is transmitted to the output planet carrier 313; the output planet carrier 313 rotates at a certain angle to the plate adaptor 322 matched with the splines thereof; and this moment, the supporting legs 3131 of the output planet carrier rotate along with the output planet carrier 313 in corresponding direction, wherein when the supporting legs 3131 are pressed against the pin rollers 323 after rotating a micro displacement; because the pin rollers 323 move from the small end to the large end of the wedge plane formed between the inner circular face 3212 and the plane 3221 of the plate adaptor 322, the pin rollers 323 can be pushed by the supporting legs 3131 of the output planet carrier to follow the rotation of the output planet carrier 313 until the output planet carrier 313 contacts with the lateral sides of the spline teeth 3223 of the plate adaptor 322; and at this moment, the supporting legs 3131 of the output planet carrier and the pin rollers 323 drive the plate adaptor 322 to rotate together. Thus, the rotary torque of the motor 2 will be transmitted to the gear shaft 308 which is fixedly connected with the plate adaptor 322, further transmitted to the first gear 301 and then to the output shaft 4 via the second gear 302, the third gear 303 and the connecting shaft 51, and then the output shaft 4 drives the tool bit 9 to rotate.

Figure 9:
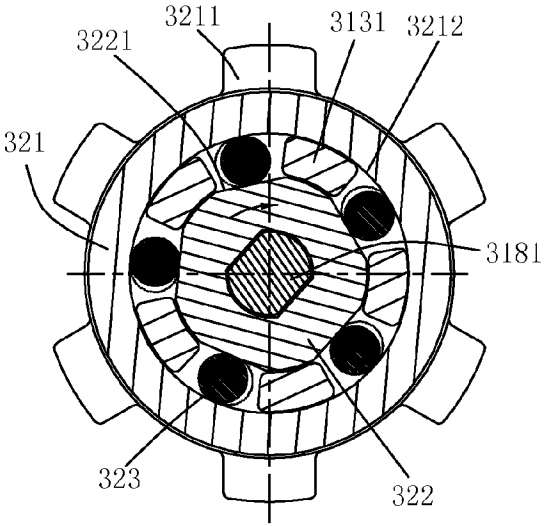
FIG. 9 is similar to FIG. 7, but the difference lies that the rotary of the adapter plate is clockwise.

Further as shown in FIG. 9, when the button switch 7 is turned off, the motor 2 stops rotation and then has no rotary torque output. At this moment, regardless of whether the operator clockwise or anticlockwise twists the output shaft 4 or the tool bit 9 received in the output shaft 4, the gear shaft 308 generates micro rotation in corresponding direction, and because the gear shaft 308 and the plate adaptor 322 are connected integrally via the flat square hole, the plate adaptor 322 rotates in corresponding direction along with the gear shaft 308. The pin rollers 323 roll from the position shown by the dotted line to the position shown by the full line. Because the pin rollers 323 move from the large end to the small end of the wedge plane formed by the inner circular face 3212 and the plane 3221 of the plate adaptor 322, the plane 3221 of the fixed plate 321, the inner circular face 3212 and the planet 3221 of the plate adaptor 322 are closely wedged together, so the gear shaft 308 fails to drive the the output planet carrier 313 to rotate, which means that the gear shaft 308 is self-locked; in other words, the rotary motion cannot be transmitted to the output planet carrier 313 via the output shaft 4. With the self-locking structure, the operator can select to manually rotate the electric screwdriver to fasten the screws. In particular when the electric screwdriver is in the electric mode, the motor 2 can be stopped by pressing the button switch 7 on condition that the screw is fastened basically in place; in the manual mode, the electric screwdriver can be rotated to fasten the screw in place, thus avoiding screw slippage caused by over fastening the screw in the electric mode. This electric screwdriver is a manual and electric integrated screwdriver which is convenient to operate and portable.

In the above embodiment, the self-locking device is arranged between the planetary gear mechanism 31 and the gear mechanism 30. Those skilled in this technical field can easily understand that the self-locking device located at other position between the motor 2 and the output shaft 4 can also realize the one-way transmission from the motor 2 to the output shaft 4, such as between the motor 2 and the planetary gear mechanism 31, or between the gear mechanism 30 and the connecting shaft 51. The structure of the self-locking is not limited to those in the above embodiments. Any self-locking device capable of realizing one-way transmission can be applied to the preferable electric screwdriver of the present invention.

Further as shown in FIG. 1 and FIG. 2, the housing 1 is slidably connected with a slip cover 53 which can drive the connecting shaft 51 to move axially. The edge of the slip cover 53 is provided with a guide rail 531; the corresponding housing 1 is provided with a guide slot 15; the slip cover 53 is installed in the guide slot 15 via the guide rail 531 thereof and can slide axially with respect to the housing 1. Of course, the slip cover 53 may be provided with a guide slot, and the housing 1 is provided with a guide rail to make the slip cover 53 to move.

The cross section of the handle of the common standard tool bit is a regular hexagon, which means that the handle is formed into the torque stressed portion of the tool bit; while the output shaft 4 has a axially through tool hole 41 which is as regularly hexagonal hole matched with the torque stressed portion of the tool bit; the tool bit is installed in the tool hole 41 such that the tool bit is located at the working position, thus realizing torque transmission. Of course, the tool bit may be non-standard, which means that the cross section of the torque stressed portion is polygonal; correspondingly, the tool hole is set as a polygon matched with the torque stressed portion; and both can realize torque transmission. The output shaft 4 is supported in the axial open pore 131 of a front housing 13 by a shaft sleeve 40. The shaft sleeve 40 provides radial support for the output shaft 4. Of course, the radial support for the output shaft 4 may also be realized by a bearing. The connecting shaft 51 of the present invention is also hexagonal. The third gear 303 is provided with a hexagonal hole inside for being adapted to the connecting shaft 51 and transmitting the rotary power to the connecting shaft 51. In this way, the connecting shaft 51 inserted into the output shaft 4 can drive the output shaft 4 to rotate so as to drive the tool bit 9 to rotate by the output shaft 4. Thus, the standard tool bit 9 can be used, and the connecting shaft 51 does not need a hole for receiving the tool bit 9 so as to avoid increase of weight and volume of the whole machine due to too large diameter of the connecting shaft 51. The output shaft directly drives the tool bit 9 to rotate, which shortens the torque transmission distance and makes the use of the tool more reliable. The above description refers to the way that the connecting shaft indirectly drives the tool bit to rotate by the output shaft. However, those skilled in this field shall easily figure out other transmission means as substitutes: For example, the connecting shaft directly drives the tool bit to rotate, which means that the connecting shaft is directly connected with the tool bit in a torque transmission way; or the output shaft is driven by the gear and the connecting shaft is only used for pushing the tool bit and bringing the tool bit back to the cartridge, that is to say the transmission chain is motor-transmission mechanism-output shaft, which means the connecting shaft is not part of the transmission chain.

As shown in FIG. 1, FIG. 2, FIG. 5 and FIG. 6, the connecting shaft 51 is a regularly hexagonal shaft. The connecting shaft 51 is fixedly provided with a fixed member 50, and the slip cover 53 can drive the connecting shaft 51 to move in a way of connection with the fixed member 50. The interior of the slip cover 53 is provided with a first protrusion 535 and a second protrusion 536 at an axial interval along the connecting shaft 51. When the electric screwdriver is working, the first protrusion 535 and the fixed member 50 have an axial interval of S there-between; when the slip cover 53 slips backward, namely toward the motor 2, the first protrusion 535 is axially pressed against the fixed member 50 after sliding at a distance of S such that the slip cover 53 drives the fixed member 50 so as to drive the connecting shaft 51 to axially move backward; when the tool bit of the electric screwdriver is being replaced, the second protrusion 536 and the fixed member 50 have an axial interval of S there-between; when the slip cover 53 slips forward, namely toward the output shaft 4, the second protrusion 536 is axially pressed against the fixed member 50 after sliding at a distance of S such that the slip cover 53 drives the fixed member so as to drive the connecting shaft 51 to axially move forward. The front end of the connecting shaft 51 is provided with a magnet 511 for absorbing the tool bit 9. When the tool bit 9 is selected, the slip cover 53 can be operated to drive the connecting shaft 51 to pass through the tool supporting mechanism; and then the tool bit 9 is absorbed by the magnet 511 on the connecting shaft 51 is pushed by the connecting shaft 51 to leave the tool supporting mechanism to enter the output shaft 4. Of course, the slip cover 53 has many other ways to drive the connecting shaft 51 to move: for example, the connecting shaft 51 can be provided with a ring slot around the periphery and the slip cover 53 extends into the ring slot by a pin or steel wire to be connected with the connecting shaft 51, and thus, the rotation of the connecting shaft 51 and the movement of the connecting shaft 51 by the slip cover 53 are not influenced.

When the electric screwdriver is operated, the tool bit 9 is required to be axially pressed against the screw or the workpiece such that the tool bit 9 is stressed by a reverse axial force, which drives the connecting shaft 51 to move backward. The present invention puts forward three schemes to solve this problem. The following are detailed descriptions of the three schemes respectively.

Figure 10:
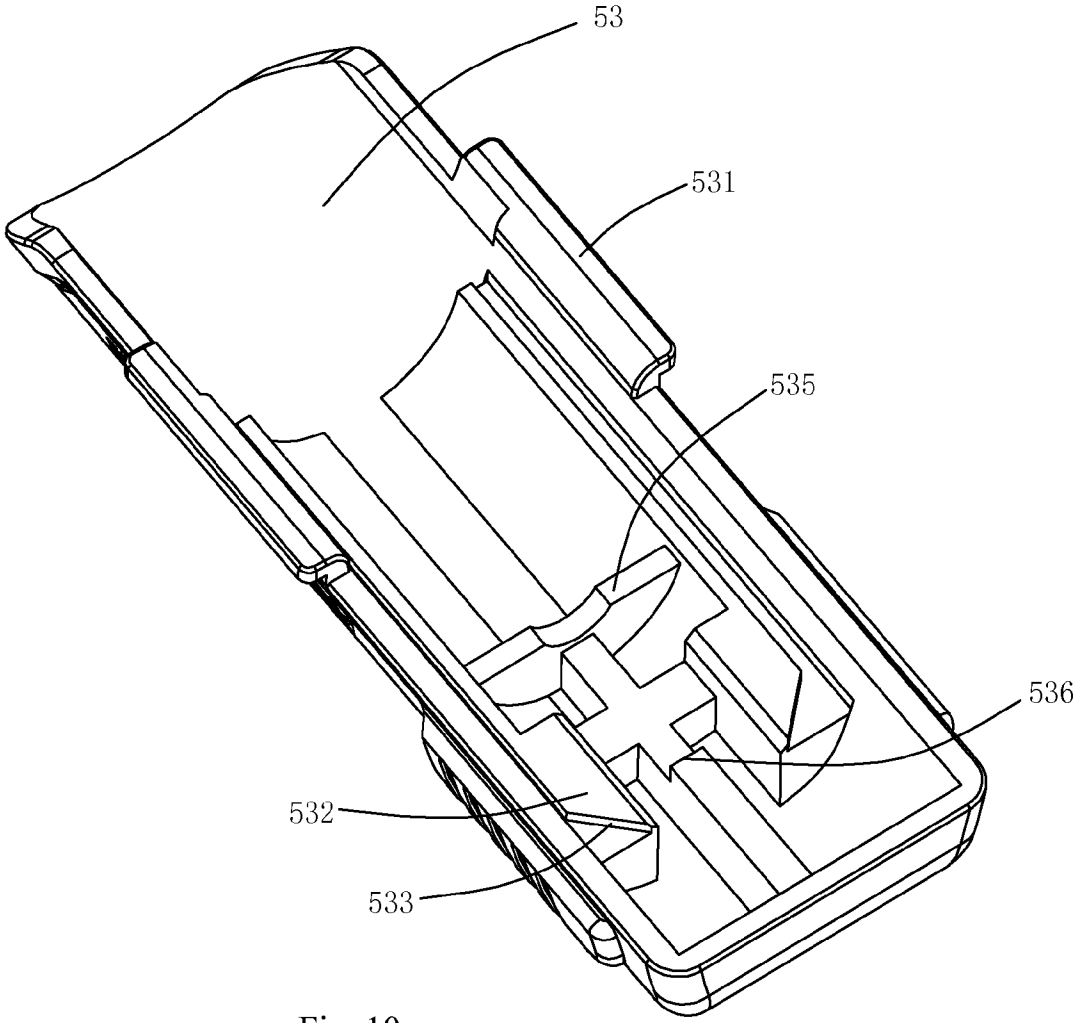
FIG. 10 is a perspective view of a slip cover of the power tool of FIG. 1.
Figure 11:
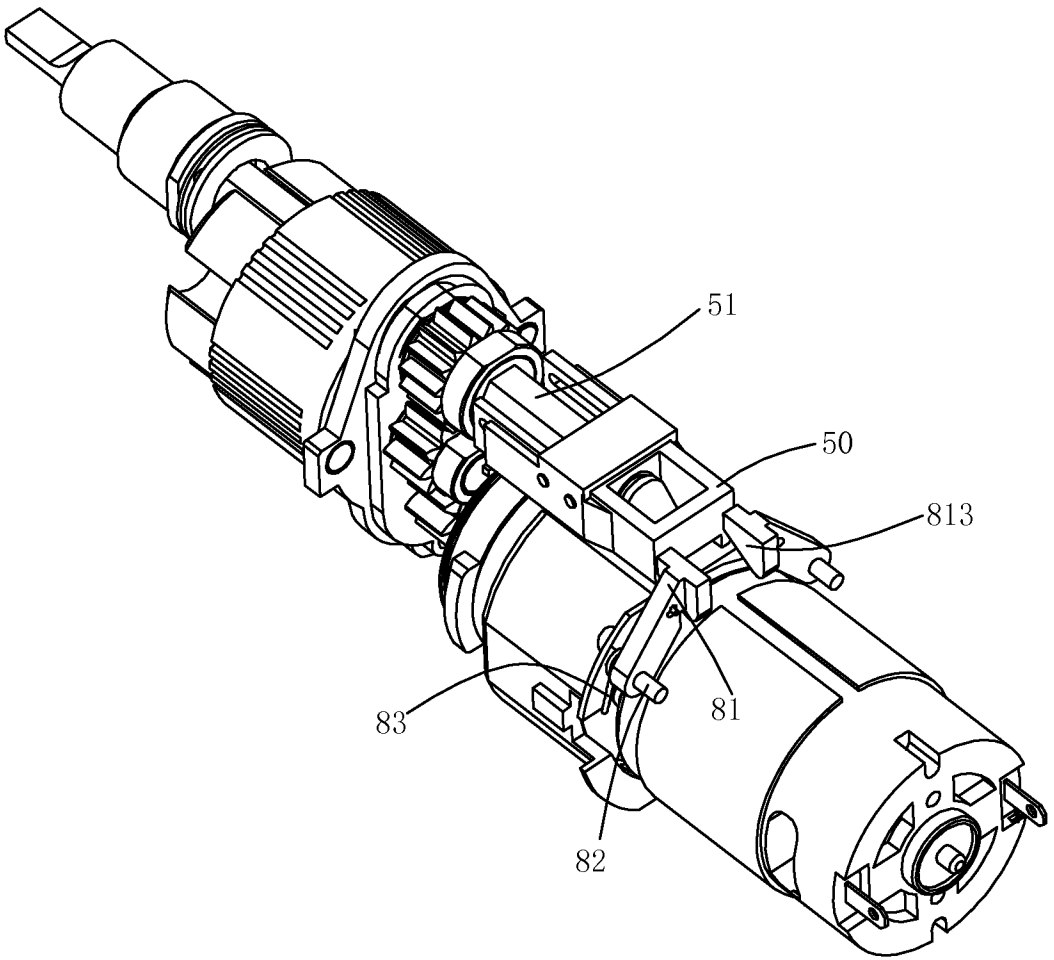
FIG. 11 is a schematic view of the first embodiment of the restricting mechanism of the power tool of FIG. 1, wherein the restricting mechanism is located at a locked position.
Figure 13:
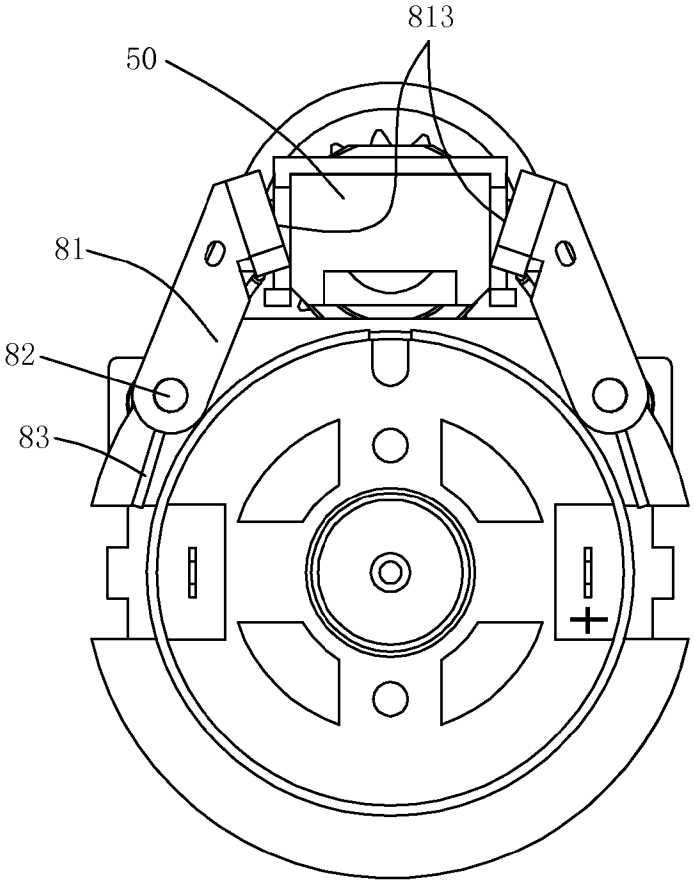
FIG. 13 is similar to FIG. 12, but the difference lies that the restricting mechanism is located at a released position.
Figure 12:
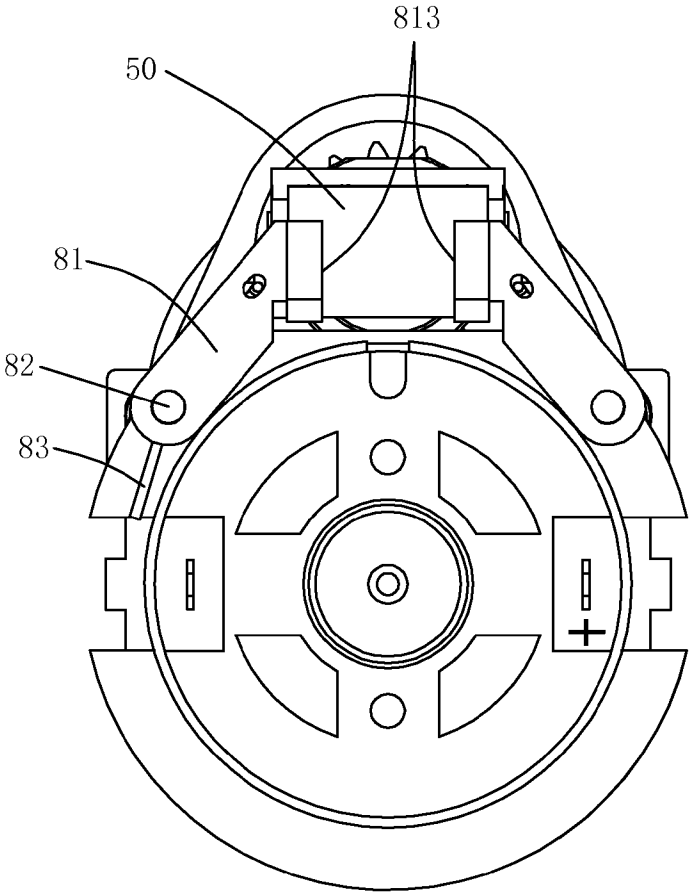
FIG. 12 is a right perspective schematic view of the restricting mechanism of the power tool of FIG. 11.

As shown in FIGS. 10-13, the position, close to the fixed member 50, of the rear end of the connecting shaft 51 is provided with a restricting mechanism 8 for preventing the connecting shaft 51 from moving backwards. The restricting mechanism 8 comprises a pivotal restricting member 81, and a torsional spring 83 eccentrically pressing said restricting member 81 along the pivotal direction of the restricting member 81, wherein one end of the restricting member 81 is pressed against the fixed member 50, while the other end is installed on the gear case 22 or the housing 1 by a pin shaft 82; the axis of the pin shaft 82 is parallel to that of the connecting shaft 51; the restricting member 81 can rotate in a certain angle scope around the pin shaft 82; one end of the torsional spring 83 is fixed on the restricting member 81, while the other end is pressed against the gear case 22 or the housing 1; and the spring force of the torsional spring 83 keeps the restricting member 81 at the first position wherein the restricting member 81 is axially pressed against the fixed member 50 (as shown in FIG. 11 and FIG. 12). Two such restricting mechanisms 8 are preferable, symmetrically distributed along the axis of the connecting shaft 51. In this way, the force is balanced such that the axial restriction of the connecting shaft 51 is more reliable. When the connecting shaft 51 is required to be moved, the restriction on the movement of the connecting shaft 51 can be canceled by sliding the slip cover 53. The slip cover 53 is provided with a release member 532 inside which is matched with the restricting member 81. The release member 532 is provided with an inclined plane 533. When the slip cover 53 moves backward, the inclined plane contacts with one lateral side 813 of the restricting member 81, and the restricting member 81 is driven by the inclined plane 533 to overcome the action of the spring force of the torsional spring 83 to rotate around the pin shaft 82 until the restricting member 81 is separated from the fixed member 50. Once the fixed member 50 is released, the restricting member 81 is located at the second position (as shown in FIG. 13) to allow the connecting shaft 51 to move axially. If the connecting shaft 51 continuously axially moves, the restricting member 81 will be clamped at two ends of the fixed member 50, and then the tool bit can be replaced at this moment. Thus it can be seen that, the slip cover 53 can slide at a distance of S to release the restriction on axial movement of the connecting shaft 51 by the restricting member 81 before driving the connecting shaft 51 to move, so the distance S is only required to meet the condition that the slip cover 53 can move to release restriction on axial movement of the connecting shaft 51 by the restricting member 81. After the tool bit is replaced, the slip cover 53 moves forward to drive the connecting shaft 51 and the fixed member 50 move forward; the inclined plane 533 of the release member 532 contacts with the lateral side 813 of the restricting member 81 again and is separated from the lateral side 813 along with the forward movement of the slip cover 53; by the action of the torsional spring 83, the restricting member 81 moves back to the position where the restricting member 81 is axially pressed against the fixed member 50 such that the front end of the connecting shaft 51 extends into the output shaft 4 and the fixed member 50 at the rear end of the connecting shaft 51 is axially pressed by the restricting member 81 when the electric screwdriver is working; and thus, the axial movement of the connecting shaft 51 is restricted, which means that the connecting shaft 51 fails to move back, and then the electric screwdriver can be used more stably.

Figure 14:
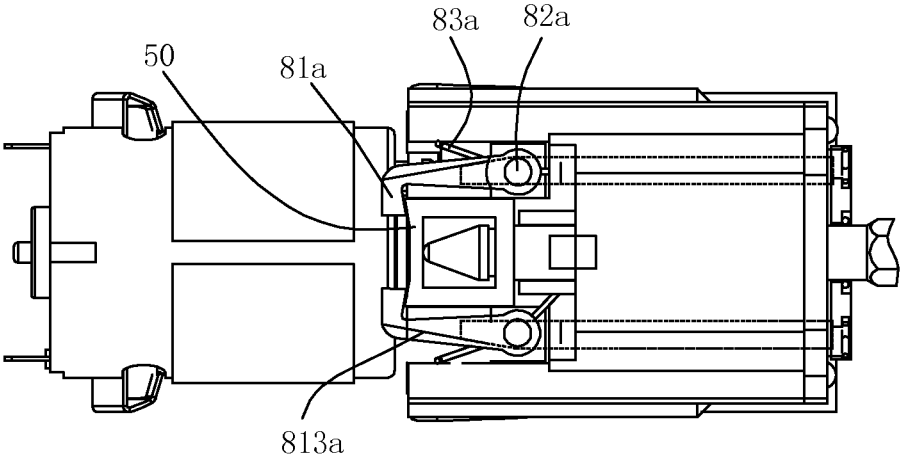
FIG. 14 is a schematic view of the second embodiment of the restricting mechanism of the power tool of FIG. 1, wherein the restricting mechanism is located at a locked position.
Figure 15:
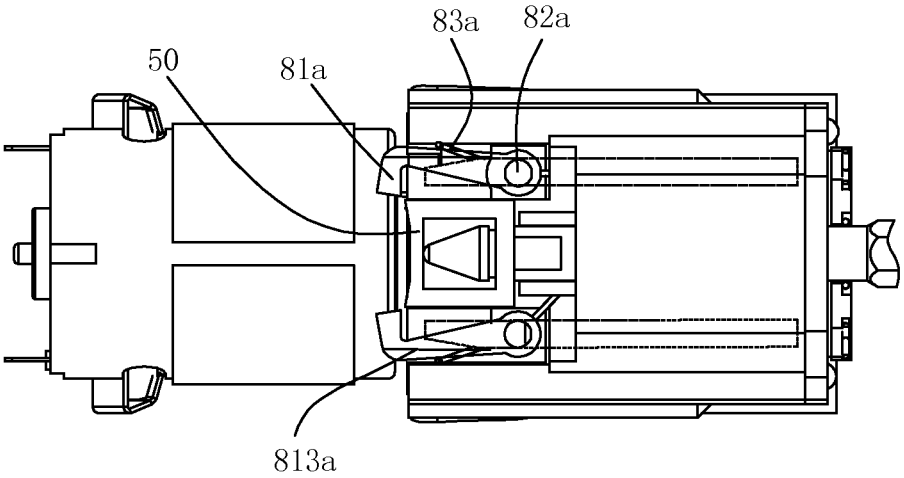
FIG. 15 is similar to FIG. 14, but the difference lies that the restricting mechanism is located at a released position.

FIG. 14 and FIG. 15 illustrate the second embodiment of the restricting mechanism 8. Different from the above restricting mechanism 8, the axis of the pin shaft 82*a* is vertical to the axis of the connecting shaft 51; one end of the restricting member 81*a* is pivotally connected with the pin shaft 82*a*, while the other end is formed into a hook, hooked on the fixed member 50; such that the fixed member 50 can be restricted to move backward, and then the restricting member 81*a* is located at the first position (as shown in FIG. 14) for restricting the axial movement of the connecting shaft 51. The slip cover 53 moves to enable the inclined plane 533 of the release member 532 to contact the restricting member 81*a;* the restricting member 81*a* is guided by the inclined plane 533 to rotate around the pin shaft 82*a* and release the fixed member 50, and then the restricting member 81*a* is located at the second position (as shown in FIG. 15) for allowing the connecting shaft 51 to move axially. In this embodiment, the action principle of the restricting member 8*a* is identical with that in the first embodiment and therefore the description thereof is omitted here.

Figure 17:
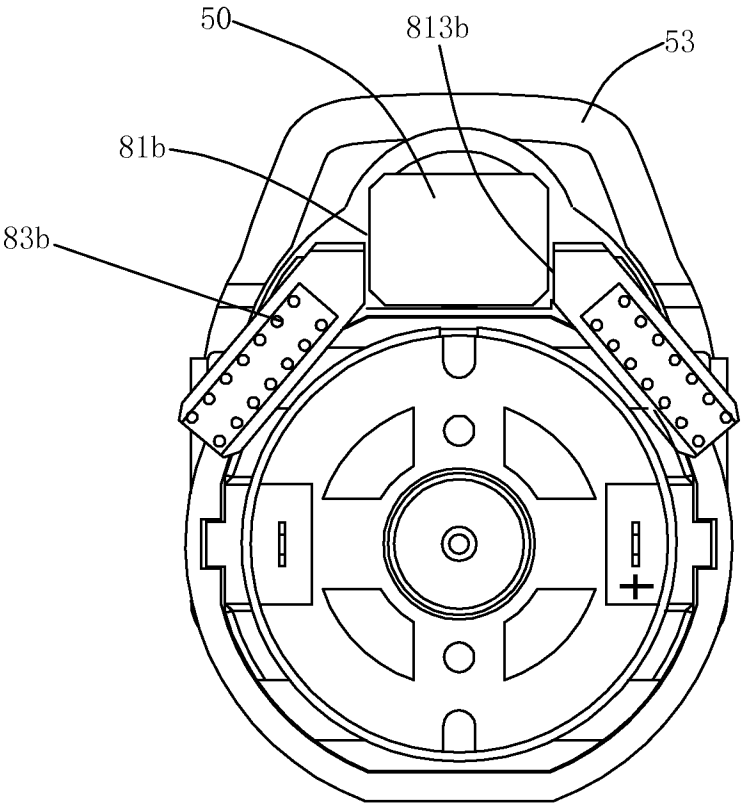
FIG. 17 is similar to FIG. 16, but the difference lies that the restricting mechanism is located at a released position.
Figure 16:
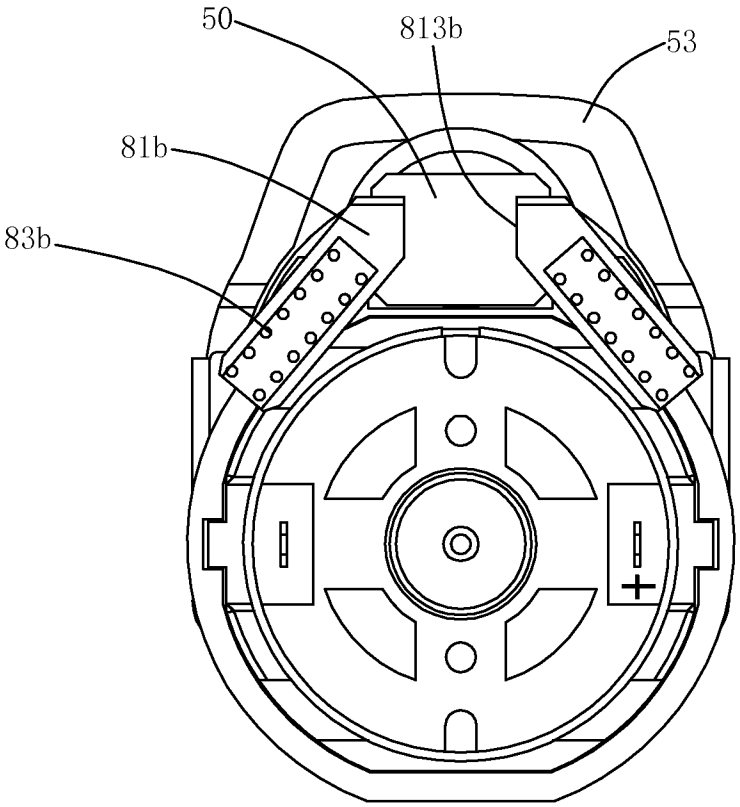
FIG. 16 is a schematic view of the third embodiment of the restricting mechanism of the power tool of FIG. 1, wherein the restricting mechanism is located at a locked position.

FIG. 16 and FIG. 17 illustrate the third embodiment of the restricting mechanism 8. The restricting mechanism 8*b* comprises a restricting member 81*b* and a spring 83*b*; the restricting member 81*b* is axially fixed with respect to the housing 1; the restricting member 81*b* can move linearly in a direction vertical to the axis of the connecting shaft 51; one end of the spring 83*b* is received in the restricting member 81*b*, while the other end is connected with the housing 1 or the gear case 22; and the spring 83*b* eccentrically presses the restricting member 81*b* to keep the restricting member at the first position (as shown in FIG. 16) where the restricting member is axially pressed against the fixed member 50. In this embodiment, the inclined plane 533 of the slip cover 53 interacts with the restricting member 81*b* to release the restriction on the axial movement of the fixed member 50; and the restricting member 81*b* overcomes the spring force of the spring 83*b* to move linearly to the second position (as shown in FIG. 17) where the connecting shaft 51 is released. Here, the inclination direction of the inclined plane 533 can be selected to the movement direction of the restricting member 81*b*, for example, if the restricting member 81*b* moves in the horizontal direction vertical to the axis of the connecting shaft 51, the inclined plane 533 inclines with respect to the plane formed in the axial direction of the connecting shaft 51 and the vertical direction; if the restricting member 81*b* moves in the vertical direction vertical to the axis of the connecting shaft 51, the inclined plane 533 inclines with respect to the plane formed in the axial direction of the connecting shaft and the horizontal direction; if the restricting member 81*b* moves in the horizontal direction vertical to the axis of the connecting shaft 51 and at a certain angle, the restricting member 81*b* has displacement in the horizontal direction and the vertical direction, so the inclined plane 533 has many options in the inclination direction, which can be easily figured out by those skilled in this field and therefore is omitted here.

The above three embodiments of the restricting mechanism 8 all release the restriction on the axial movement of the connecting shaft 51 by sliding the slip cover 53. The slip cover 53 drives the connecting shaft 51 to move axially and therefore is required to move at a distance in advance, which means that the restriction on the axial movement of the connecting shaft 51 by the restricting member 81 shall be released first and then the connecting shaft 51 can be driven to move axially. In the slip cover 53, the first protrusion 533 and the fixed member 50 driving the connecting shaft 51 to move are axially arranged at an interval, and the length of the interval can be determined by the inclination angle of the inclined plane 533 and the maximum distance of the radial superposition of the restricting member 81 and the fixed member 50. Those skilled in this field can easily figure out the means of realizing release of restriction on the axial movement of the connecting shaft 51 by the restricting member 81 without movement of the slip cover 53, for example: The housing 1 provided with a knob outside which is connected with the restricting member 81, and by rotating the knob the restricting member 81 can be driven to overcome the spring force to rotate or move; or the housing 1 is provided with a push-button or press-button outside which is connected with the restricting member 81, and by pushing the push-button or pressing the press-button the restricting member 81 also can be driven to overcome the spring force to rotate or move, etc.; all those means can realize release of the restriction on the axial movement of the connecting shaft 51 by the restricting member 81.

Besides, an elastic member can be arranged between the slip cover 53 and the housing 1 or the gear case 22; when moving back to the tail position, the slip cover 53 can be clamped by the lock catch on the housing 1; and when released, the slip cover 53 can automatically return to the working position by the action of spring force.

Further as shown in FIGS. 1, 2, 5 and 6, the fixed member 50 is square and hollow; the connecting shaft 51 has a supported end 512 connected with the fixed member 50; the supported end 512 is set to be cylinder; one lateral side of the fixed member 50 is formed with a round hole or U-shaped hole; the supported end 512 is rotationally supported on the fixed member 50 via the round hole or U-shaped hole; the part of the supported end 512 extending to the hollow part of the fixed member 50 can be formed with a ring slot which can be equipped with a retainer ring to restrict the axial movement of the connecting shaft 51. The diameter of the supported end 512 is better less than that of the hexagonal circumcircle of the connecting shaft 51, which can reduce the volume of the fixed member 50 and therefore makes the whole structure of the tool compacter. The other side, opposite to the round hole or U-shaped hole, of the fixed member 50 is pressed against the end portion of the supported end 512, wherein the end portion of the supported end 512 is set to be a cone such that the connecting shaft 51 and the fixed member 50 are in point contact. Because the tool bit 9 is required to be axially pressed against the workpiece when the electric screwdriver is working, the tool bit 9 is stressed by a reverse axial force which is transmitted to the connecting shaft 51, then the connecting shaft 51 and the fixed member 50 generate a large stressed friction therebetween; and point contact means can reduce the friction and increases the service life of the connecting shaft 51. Besides, both the connecting shaft 51 and the fixed member 50 can be made from metal to reduce the degree of friction between the connecting shaft 51 and the fixed member 50. The fixed member 50 can be formed by connecting a plurality of square hollow objects to enhance strength, for example: This embodiment preferably adopts two or three square hollow objects. The configuration of the fixed member 50 may also bring other advantages, for example: the connecting shaft 51 can be rotationally supported on the fixed member 50 without the bearing, which reduces the volume and cost of the tool; the area of lateral side of the fixed member 50 is large such that the restricting member 81 is conveniently pressed against the fixed member 50 to axially restrict the connecting shaft 51 and that the slip cover 53 can drive the connecting shaft 51 to move in a way of being pressed against the fixed member 50; the hollow part of the fixed member 50 also can provide a hollow journey for the slip cover 53 with respect to the connecting shaft 51 (which means that the slip cover 53 moves, but the connecting shaft 51 does not move along with the slip cover 53), and thus the slip cover 53 with only one protrusion can drive the connecting shaft 51 to move forward and backward and then can conveniently operate the restricting member 81 to lock or release the connecting shaft 51.

Besides, those skilled in the field can easily figured out that if the transmission chain of the power screwdriver does not include the connecting shaft, which means that the output shaft is directly driven by the gear mechanism to rotate, then the tool bit and the connecting shaft can rotate oppositely and will therefore inevitably generate friction; however, the reduction can be reduced if the working end, with the magnet, of the connecting shaft and the tool bit are in point contact, and then the service life of the tool can be prolonged.

The housing 1 comprises the front housing 13 connected to the front end thereof. One part of the tool supporting mechanism is received in the front housing 13, while the other part is covered by the slip cover 53 and exposed along with the movement of the slip cover 53. In the present invention, the preferable tool supporting mechanism is cylindrical cartridge 52 which is convenient to rotate and covers a small area. Of course, the cartridge also may be square, triangular, strip-like, bracket-like, etc. When the electric screwdriver is working, the slip cover 53 is pressed against the front housing 13 such that the cartridge 52 and the connecting shaft 51 both can be sealed. The gear case cover plate 223 is provided with a hole for penetration of the connecting shaft 51 at a position corresponding to the connecting shaft 51. The gear case 22 extends to form an arch member 225 around the axis of the connecting shaft 51; the arch member 225 and the gear case 22 can be integrated or separated; by setting the arch member 225, the connecting shaft 51 can be partly sealed; when the electric screwdriver replaces the tool bit 9, which means that the connecting shaft 51 is not exposed even if the slip cover 53 moves to the position of the tail end; and thus, dust, powder, etc., can be prevented from entering the tool. Besides, the gear case cover plate 223 extends to the end face of the arch member 225 so as to whole enclose the transmission mechanism 3 along the axial direction. During working, the slip cover 53 can enclose the cartridge to prevent entrance of the dust; when the tool bit is required to be replaced, the cartridge 52 can be exposed by moving the slip cover 53 away to facilitate selection of different tool bits, which requires the slip cover 53 to have a certain length; when the slip cover 53 moves to the working position where the slip cover 53 is pressed against the front housing 13, the slip cover 53 is axially overlapped with the cartridge portion B and the transmission portion C; when the slip cover 53 moves to the position where the tool bit can be replaced, the slip cover 53 is axially overlapped with the motor portion D and partly axially overlapped with the transmission portion C. Of course, there are many ways to move the slip cover 53, for example: The slip cover 53 can be rotationally installed on the housing 1, rotating between two positions where the cartridge 52 is covered and exposed respectively; or like a door, the slip cover 53 can be opened or closed; or the slip cover 53 is pivotally connected to the housing 1, etc.; and all can realize enclosure of the cartridge 52 during working and exposure of the cartridge 52 when the tool bit is required to be replaced.

In the present invention, the cartridge 52 of the tool bit is basically cylindrical; the cartridge 52 comprises 6 tool chambers 521 for receiving tool bits. In actual use, many tool bits are required; if all tool bits are placed in the cartridge, the volume of the tool is inevitably increased, which brings inconvenience to the operator; but if the tool bits are replaced one by one, it is very inconvenient. The present invention provides another embodiment for quick replacement of the tool bits, namely directly replacing the cartridge instead of replacing the tool bits; besides, the cartridge can be directly removed from the housing without tools.

Figure 18:
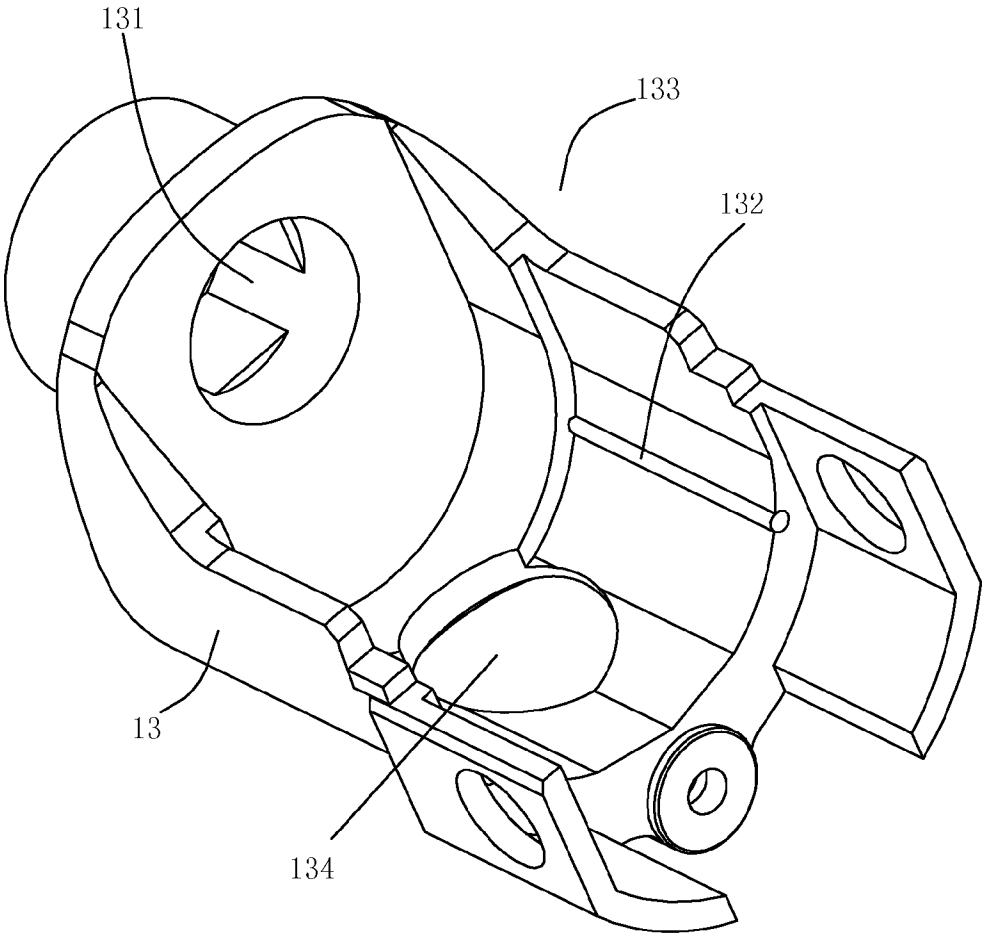
FIG. 18 is a perspective view of a front housing of the power tool of FIG. 5.

FIG. 5 and FIG. 18 illustrate the first embodiment of the removable cartridge. The upper part of the front housing 13 is provided with an open portion 133, and the bottom part of the front housing 13 is provided with a radial open pore 134 radially opposite to the open portion 133; when the cartridge 52 is required to be replaced, the slip cover 53 is operated to move toward the motor 2, and then the connecting shaft 51 moves with the slip cover 53 to the position where the connecting shaft 51 is separated from the cartridge 52; in this way, the cartridge 52 can be ejected and removed by directly sticking the radial open pore 134 with a finger, and then the cartridge provided with a different tool bit is installed into the housing from the open portion 133. The cartridge 52 is supported by contacting with the circular face of the front housing 13. Of course, to reduce the friction generated between the cartridge 52 and the front housing 13 when the cartridge is rotating, the inner wall of the front housing 13 can be provided with support rods which axially extend along the cartridge 52; the support rods 132 can be directly molded on the front housing or detachably installed on the cylindrical pin of the front housing; in this way, the cartridge 52 is supported on the support rods 132 and then is in linear contact with the front housing 13; and thus, the friction generated between the cartridge 52 and the front housing 13 when the cartridge 52 is rotating is reduced.

Figure 19:
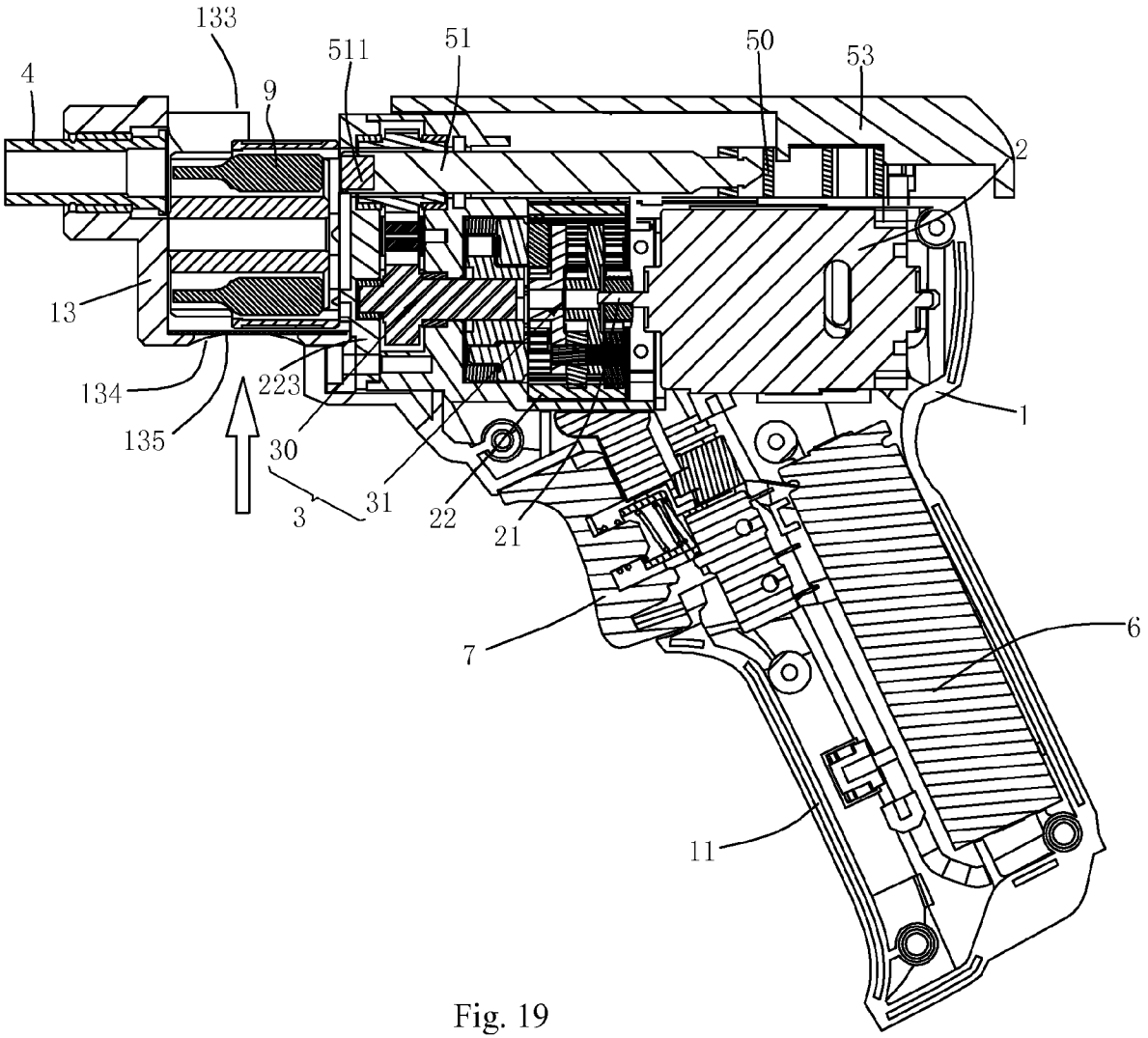
FIG. 19 is a schematic view of the second embodiment of the removable cartridge of the power tool of the present invention.

FIG. 19 illustrates the second embodiment of the removable cartridge. The bottom of the front housing 13 is provided with a rubber cushion 135 for sealing the radial open pore 134. The rubber cushion 135 has certain elasticity, so the operation that the cartridge 52 is ejected from the radial open pore 134 when the cartridge 52 is replaced is not influenced, and meanwhile the front housing 13 can be sealed to prevent foreign bodies such as dust from entering the housing. Of course, those skilled in this field can easily figure out that a spring plate at the open pore 134 can also achieve the same effect. Or, the button which can axially move with respect to the connecting shaft is directly installed in the radial open pore 134; when the cartridge is required to be ejected, the cartridge can be taken out by pressing the button, and the button can drop down by the action of the dead weight. Of course, a spring can be installed between the button and the front housing, and the button is kept separated from the cartridge 52 by the action of the spring.

Figure 20:
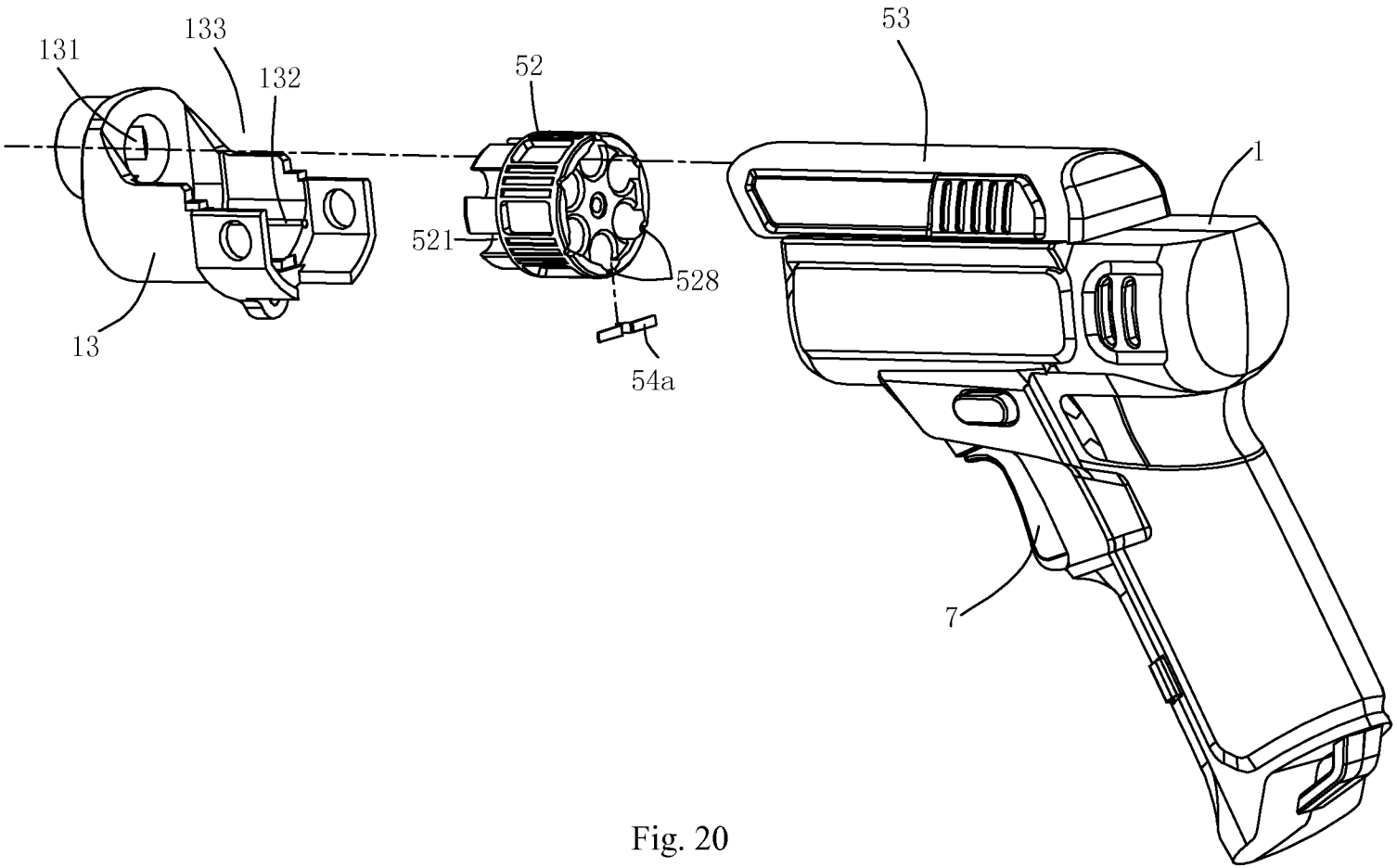
FIG. 20 is a schematic view of the third embodiment of the removable cartridge of the power tool of the present invention.

FIG. 20 illustrates the third embodiment of the removable cartridge. The end face, close to the transmission mechanism, of the cartridge 52 can be provided with locating grooves 528 of which the number is corresponding to that of the tool chambers 521. The housing 1 is provided with locating members 54 inside which are matched with the locating grooves 528. The locating members 54 may be spring plates, steel balls or steel caps stressed by the elastic force or other structures known among those skilled in this field; and thus, the voice prompt can be heard when the cartridge 52 is rotated, and the precise location can be realized. The locating members 54 are arranged at the bottom, at positions radially corresponding to the pen portion 133; the locating grooves 528 are located on the end face of the cartridge and communicated with the circumferential surface of the cartridge 52, or the locating grooves 528 penetrate through the circumferential surface of the cartridge 52 along the radial end of the cartridge 52. In this way, when the cartridge 52 is taken out from the housing via the open portion 133, the elastic force of the elastic locating members 54 does not exist in the movement direction of the cartridge 52, and the cartridge 52 can be easily taken out by reversing the electric screwdriver, so it is unnecessary to form the radial through-hole for ejecting the cartridge 52.

Figure 21:
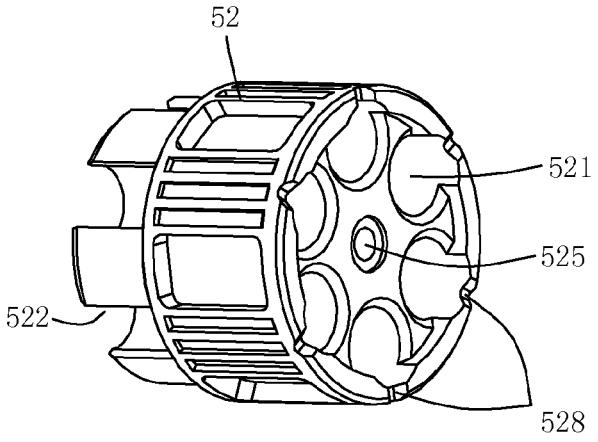
FIG. 21 is a perspective view of a cartridge according to a first preferred embodiment of the present invention.
Figure 22:
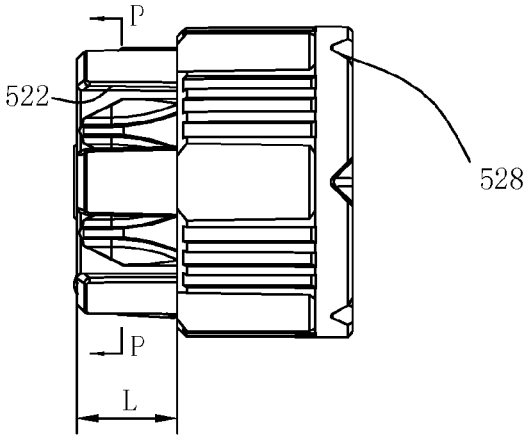
FIG. 22 is a front perspective view of the cartridge of the power tool of FIG. 21.
Figure 23:
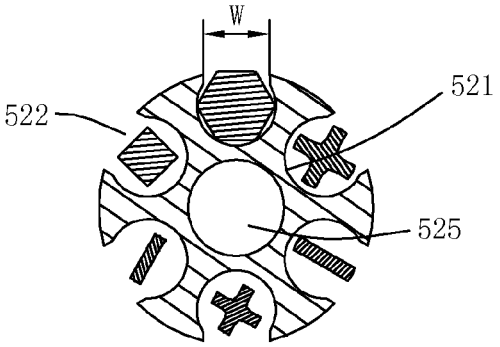
FIG. 23 is a schematic cross-sectional view taking along line P-P of FIG. 22.

As shown in FIGS. 21-23, in the preferably embodiments the present invention, the cartridge 52 has a main body which may be cylindrical or has a polygonal cross section and has a rotation axis X; the cartridge 52 is rotationally supported between the gear case cover plate 223 and the front housing 13; the main body is provided with a through-hole 525 concentric with the rotation axis such that the cartridge 52 can be rotationally supported via the through-hole 525 (if an elastic locating member capable of stretching into the through-hole 525 can be arranged on the housing). A plurality of tool chambers 521 for receiving tool bits are uniformly arranged around the rotation axis X of the main body and are parallel to the rotation axis X of the main body. Preferably, 6 tool chambers 521 are uniformly distributed around the rotation axis X of the main body. The longitudinal length of the tool bits 9 received in the tool chambers 521 is parallel to the rotation axis of the cartridge 52. Of course, 4, 5 or more tool chambers can be provided. However, no matter how many the tool chambers are, the diameter of the circumcircle of the cartridge shall be smaller than the maximum radial dimension of the gear case 22, it could be better that the diameter of the cartridge 52 is less than or equal to 5 cm such that the whole power tool can be small, compact and portable. The peripheral wall of the main body is provided with a plurality of protrusions or recesses in parallel to the axis of the main body such that when the cartridge 52 is placed in the electric screwdriver, the operator can manually rotate the cartridge 52 to increase the friction and the cartridge 52 can be easily rotated.

Generally, to keep the tool bit 9, the tool bit 9 shall be axially overlapped with the main body when the placed in the tool chamber 521, and then the type of the tool bit 9 placed in each tool chamber 521 cannot be identified from the circumferential direction of the main body. The present invention puts forward the following three embodiments to solve this problem.

In the first embodiment of the preferable cartridge of the present invention, the part, at least corresponding to the tool chamber 521, of the peripheral wall of the main body is provided with a view hole 522 which is radially communicated with the tool chamber 521 such that one part of the circumference of the tool chamber 521 around the axial direction of the cartridge 52 is sealed, and one part is open. Then, the operator can conspicuously see the shape of the head of the tool bit 9 from the open portion when selecting the tool bit 9 and quickly select the required tool bit 9. To effectively keep the tool bit 9 when the cartridge 52 is placed alone, the length L of the view hole 522 along the axial direction of the main body is less than half of the length of the main body. It is better that the length L of the view hole is 0.3-0.4 times the length of the main body, which can effectively show the shape of the tool bit and prevent the tool bit dropping from the view hole. Besides, if the width W of the view hole 522 along the circumference of the main body is too large, the tool bit may drop from the view hole when the cartridge 52 is placed in the housing; but if the width W is too small, it is difficult to distinguish the shape of the tool bit; the width W of the view hole 522 is preferably less than the diameter of the tool chamber 521, and is best 0.7-0.9 times the diameter of the tool chamber.

Figure 24:
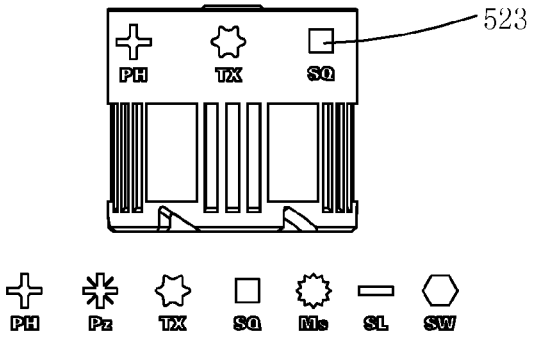
FIG. 24 is a perspective view of the second embodiment of the preferable cartridge of the present invention, wherein the cartridge is provided with a first structure identification means.
Figure 25:
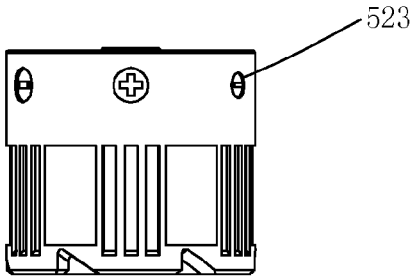
FIG. 25 is a perspective view of the second embodiment of the preferable cartridge of the present invention, wherein the cartridge is provided with a second structure identification means.

FIG. 24 and FIG. 25 illustrate the second embodiment of the preferable cartridge of the present invention. The tool chamber 521 may be circumferentially closed by the main body; the peripheral wall of the main body is provided with identification means 523 representing different tool bits; and the identification means 523 are located at positions corresponding to the tool chambers 521. Here, the identification means 523 is a generic term of identifying the tool bits. The best visual identification means 523 is the patterns which are arranged on the peripheral wall for representing the shapes of different tool bits, for example: the commonly used cross screwdriver is represented by the pattern "+"; the flat screwdriver is presented by the pattern "–", which facilitates operation of each operator. Of course, the peripheral wall also can be provided with letters representing the models of different tool bits, for example: the model of the cross screwdriver is presented by the letters "PH", the flat screwdriver by the letters "SL", the square screwdriver by the letters "SQ", the hexagonal screwdriver by the letter "SW", the hexagram-shaped screwdriver by the letters "TX", the dodeca-gram-shaped screwdriver by the letters "Ms", pozi screwdriver by the letters "Pz", etc., which suitable for use by professional operators. Moreover, the identification means 523 may also be characters, symbols, numbers, shapes and combinations thereof.

Identification means 523 can be arranged on the peripheral wall of the main body in many ways such as printing, molding, embedding or sticking, and thus, the installed tool bit shall be corresponding to the identification means. Of course, those skilled in this field can easily figure out that the identification means 523 may also be detachably installed on the peripheral wall of the main body. If the installed tool bit 9 is not corresponding to the identification means 523, the operator can adjust the installation position of the whole identification means 523 by himself.

Figure 26:
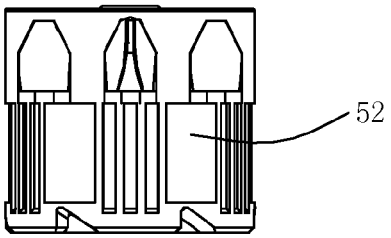
FIG. 26 is a perspective view of the third embodiment of the preferable cartridge of the present invention, wherein the cartridge is provided with a first structure transparent part.
Figure 27:
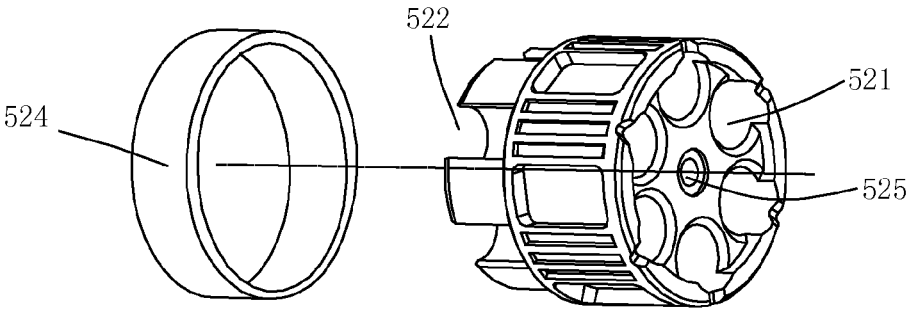
FIG. 27 is a perspective view of the third embodiment of the preferable cartridge of the present invention, wherein the cartridge is provided with a second structure transparent part.

FIG. 26 and FIG. 27 illustrate the third embodiment of the preferable cartridge of the present invention. The main body of the cartridge 52 is made from a transparent material. The shape of the identification means can be conveniently identified from the outside of the cartridge 52. Of course, all main body of the cartridge 52 is unnecessary made from the transparent material. The tool bit can be identified if the part corresponding to the head of the tool bit 9 is made from the transparent material. If the part of the peripheral wall of the main body for sealing the tool chamber 521 is made from the transparent material, it is best that the transparent part made from the transparent material is located at the axial end of the main body, and to save material, the length of the transparent part along the axial direction of the main body is less than half of the length of the main body. Besides, the cartridge 52 itself may be partly open just like the peripheral wall in the first embodiment, and only a transparent ring 524 is required to be sleeved on the outside of the view hole 522.

In actual use, many tool bits are required; if all tool bits are placed in the cartridge, the volume of the tool is inevitably increased, which brings inconvenience to the operator; but if the tool bits are replaced one by one, it is very inconvenient. The present invention provides an individual cartridge attachment. The tool bit can be quickly replaced by replacing the cartridge. Many cartridges can be prepared because they are small and portable.

When the electric screwdriver is required to work, the connecting shaft 51 is driven by the slip cover 53 to move forward so as to push the selected tool bit to enter the output shaft 4. When the tool bit is required to be replaced, the connecting shaft 51 is driven by the slip cover 53 to move backward, and because the connecting shaft 51 is provided with the magnet 511 at one end contacting with the tool bit, the connecting shaft 51 can drive the tool bit to move back to the tool chamber 521 of the cartridge. However, if the connecting shaft 51 continuously moves backward, the tool bit will be brought out of the tool chamber 521, so the replacement of the tool bit fails. If the operator rotates the cartridge before finding out the phenomenon, the tool bit certainly may be damaged. The present invention puts forward four schemes to solve this problem. The following are descriptions in details respectively.

Figure 29:
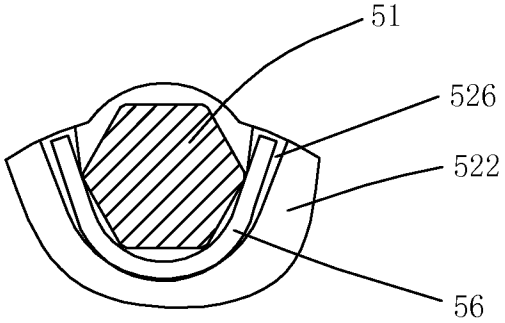
FIG. 29 is a schematic view illustrating the restriction member is located at the position where the connecting shaft is allowed to move of FIG. 28.
Figure 30:
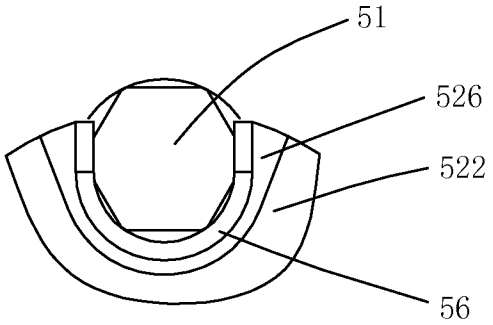
FIG. 30 is a schematic view illustrating the restriction member is located at the position where the tool bit is restricted from moving backward of FIG. 28.
Figure 28:
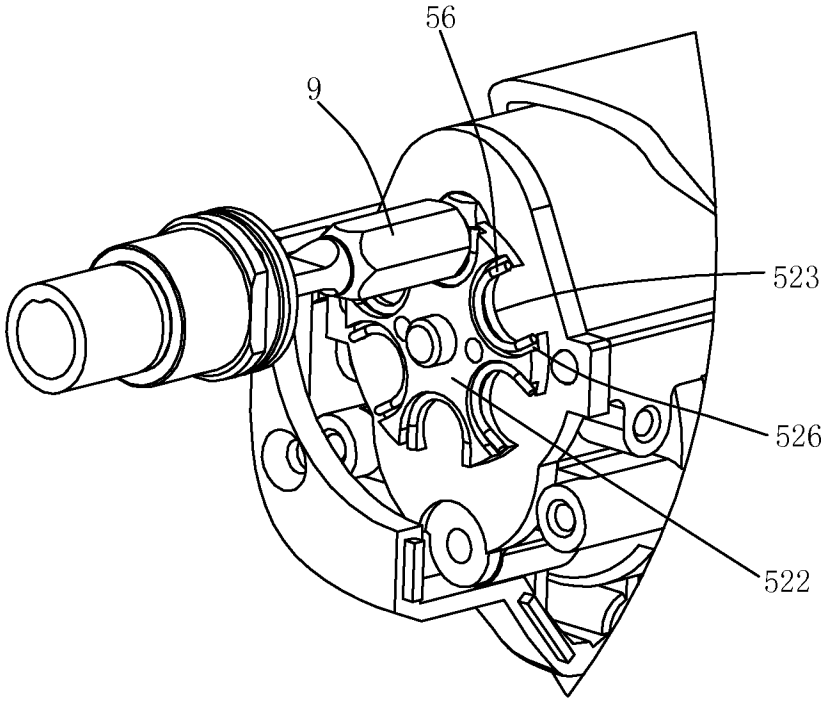
FIG. 28 is a schematic view illustrating the first embodiment of restricting the tool bit from moving backward with the connecting shaft when the power tool is changing the tool bit of FIG. 1.

FIGS. 28-30 illustrate the first embodiment of restricting the tool bit 9 from moving backward with the connecting shaft 51. The cartridge 52 is provided with a pressure plate 522 at one end facing the gear case 22. The pressure plate 522 can rotate together with the cartridge 52 and be integrated with the cartridge 52 or separated from the cartridge. The separation way is preferable in this embodiment, which is convenient for operation and assembly. The pressure plate 522 is provided with an opening 523 at a position corresponding to the tool chamber 521. The opening 523 is used for penetration of the connecting shaft 51. Opposite to the cartridge, the end face of the pressure plate 522 is formed with a U-shaped channel 526 for receiving the U-shaped spring 56. The U-shaped spring 56 is partly overlapped with the opening 523 in the free state. The design of the U-shaped channel 526 reserves space for the elastic deformation of the U-shaped spring 56. The preferable number of the tool chamber 521 in the present invention is 6, and then the number of the corresponding opening 523 shall also be 6, so do the U-shaped channel 526 and the U-shaped spring 56. Of course, those skilled in this field can easily figure out that there may be one opening 523, one U-shaped channel 526 and one U-shaped spring 56, which means that the pressure plate 522 is fixed with respect to the gear case 22, and thus, the cartridge 52 is not influenced to select the tool bit because the connecting shaft 51 passes through the same opening 523 each time. When the connecting shaft 51 moves backward and drives the tool bit to move backward by the action of the magnet 511, the U-shaped spring 56 generates elastic deformation and is clamped on the connecting shaft 51, which means that the U-shaped spring 56 is located at the first position (as shown in FIG. 29) where the connecting shaft 51 is allowed to move. Because both the end portion of the connecting shaft 51 that is connected with the tool bit and the end portion of the tool bit that is connected with the connecting shaft 51 is chamfered or rounded, when the end portion of the connecting shaft 51 that is connected with the tool bit 9 leaves the opening 523 of the pressure plate 522, the U-shaped spring 56 recovers the free state to partly cover the opening 522, and the tool bit 9 is stopped by the U-shaped spring 56 when continuously moving backward along with the connecting shaft 51, which means that the U-shaped spring 56 is located at the second position where the tool bit 9 is restricted from moving backward (as shown in FIG. 30). Thus, the connecting shaft 51 is separated from the tool bit 9, and the cartridge can be randomly rotated to select the required another tool bit 9. When the power screwdriver is working, the connecting shaft 51 can be provided with a ring sot 512 around the connecting shaft 51 at a position axially corresponding to the U-shaped spring 56 so as to avoid the situation that the U-shaped spring 56 causes resistance to the rotation of the connecting shaft 51 and enable the U-shaped spring 56 to guide the tool bit back to the cartridge 52.

Figure 32:
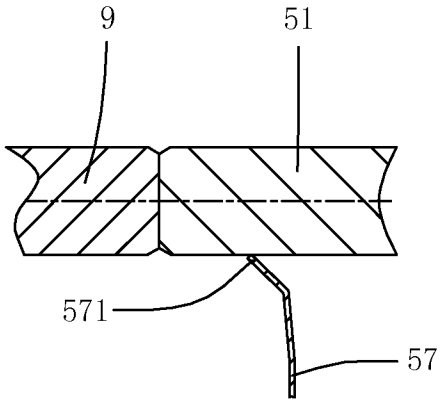
FIG. 32 is a schematic view illustrating the restriction member is located at the position where the connecting shaft is allowed to move of FIG. 31.
Figure 33:
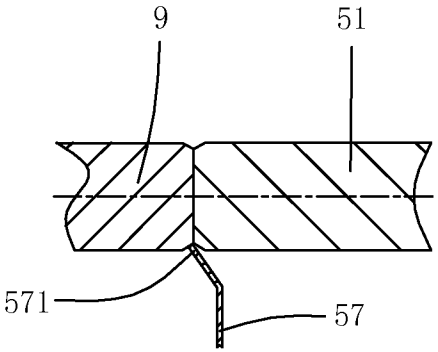
FIG. 33 is a schematic view illustrating the restriction member is located at the position where the tool bit is restricted from moving backward of FIG. 31.
Figure 31:
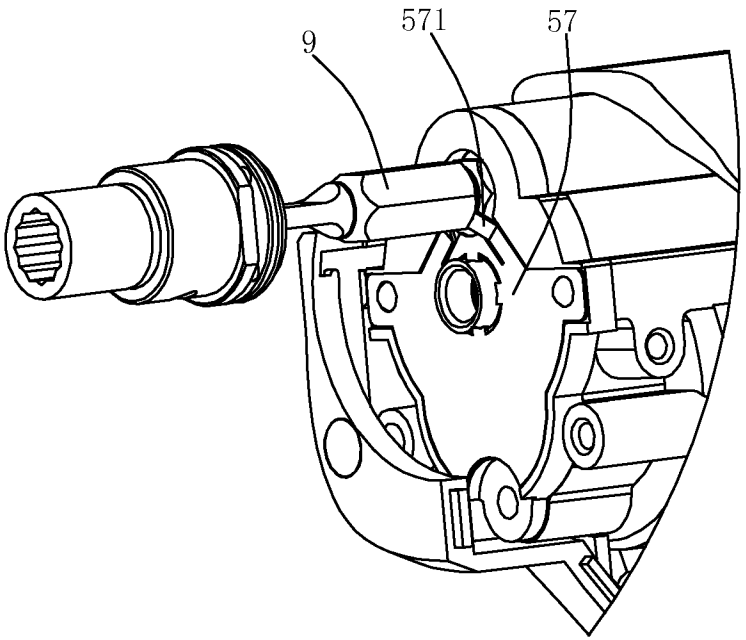
FIG. 31 is a schematic view illustrating the second embodiment of restricting the tool bit from moving backward with the connecting shaft when the power tool is changing the tool bit of FIG. 1.

FIGS. 31-33 illustrate the second embodiment of restricting the tool bit 9 from moving backward with the connecting shaft 51. The gear case cover plate 223 is fixed with a spring plate 57 which is located between the cartridge 52 and the gear case cover plate 233. The spring plate 57 is provided with at least one elastic tail end 571. The elastic tail end 571 partly extends into a hole on the gear case cover plate 223. Thus, the tool bit 9 can be clamped by the elastic deformation of the elastic tail end 571 to prevent the situation that the connecting shaft 51 drives the tool bit 9 to leave the cartridge 52 when moving backward. As shown in FIG. 32, the elastic tail end 571 is located at the first position where the connecting shaft 51 is allowed to move; as shown in FIG. 33, the elastic tail end 571 is located at the second position where the tool bit 9 is restricted from moving back. According to the this embodiment, those skilled in this field can easily figure out that the elastic tail end 571 can be directly clamped on the gear case cover plate 223 or a rigid stator can be arranged. The stator can move between the position where the stator partly shields the hole on the gear case cover plate 223 and the position where the stator leave the hole on the gear case cover plate under a elastic force so as to realize the separation between the tool bit 9 and the connecting shaft 51 and guide the tool bit 9 back to the cartridge 52.

Figure 34:
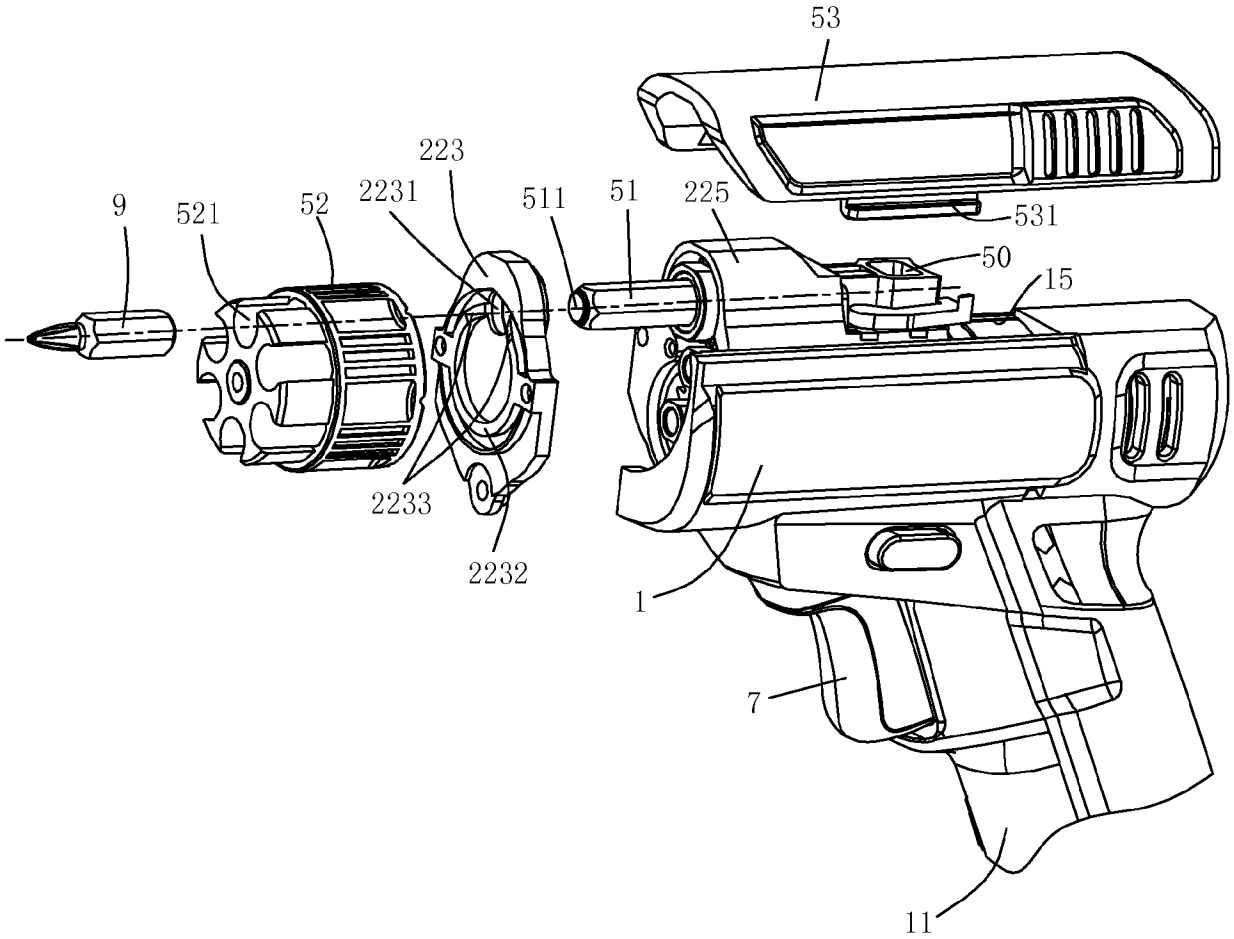
FIG. 34 is a schematic view illustrating the third embodiment of restricting the tool bit from moving backward with the connecting shaft when the power tool is changing the tool bit of FIG. 1.

FIG. 34 illustrates the third embodiment of restricting the tool bit from moving backward with the connecting shaft. A perforation 2231 is formed at the position, corresponding to the connecting shaft 51, of the gear case cover plate 223. The end face, adjacent to the cartridge 52, of the gear case cover plate 223 is provided with a step protrusion 2232 around the rotary centre of the cartridge 52 and corresponding to the tool chamber 521; the step protrusion 2232 is interrupted at the perforation 2231, and the parts of the step protrusion 2232 that locate on two sides of the perforation are provided with guide surfaces 2233. The guide surfaces 2233 rise by degrees from the perforation 2231 toward the direction of the rotation of the tool bit along with the cartridge, which means that the guide surfaces 2233 rise from the perforation 2231 toward two sides; and thus, the two guide surfaces can guide the tool bit to the position no matter the cartridge 52 rotates forward or backward.

Figure 35:
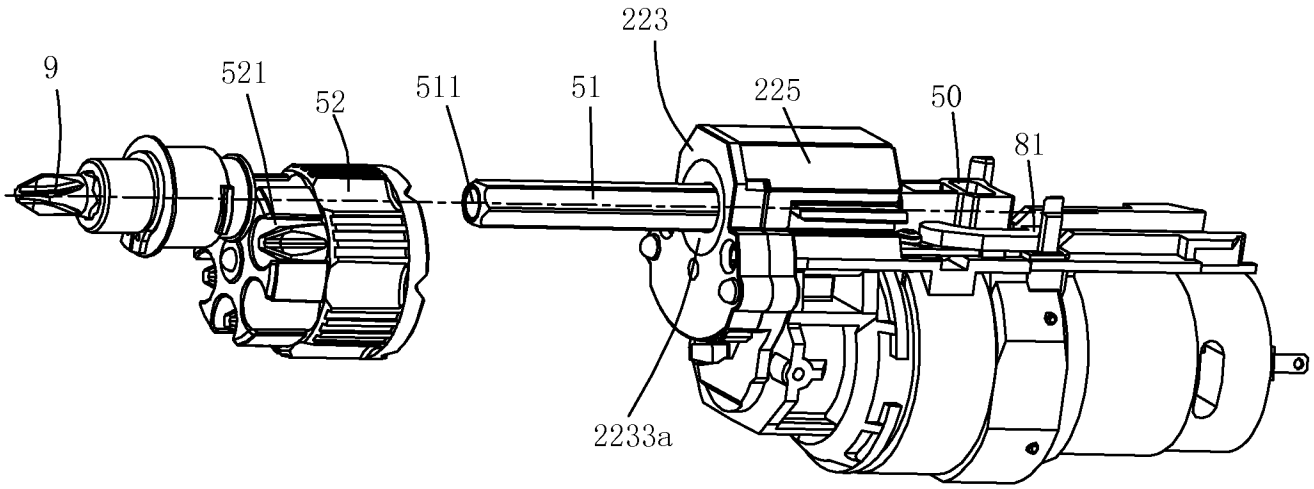
FIG. 35 is a schematic view illustrating the fourth embodiment of restricting the tool bit from moving backward with the connecting shaft when the power tool is changing the tool bit of FIG. 1.

FIG. 35 illustrates the fourth embodiment of restricting the tool bit from moving backward with the connecting shaft. A guide surface 2233*a* is directly arranged on the end face of the gear case cover plate 223, around the perforation 2231. The guide surface 2233*a* rises by degrees from the perforation 2231 towards the outside to form an annular guide surface 2233*a*, which facilitates processing and ensures that the tool pit can be guided to the position no matter the cartridge rotates forward or backward.

Figure 38:
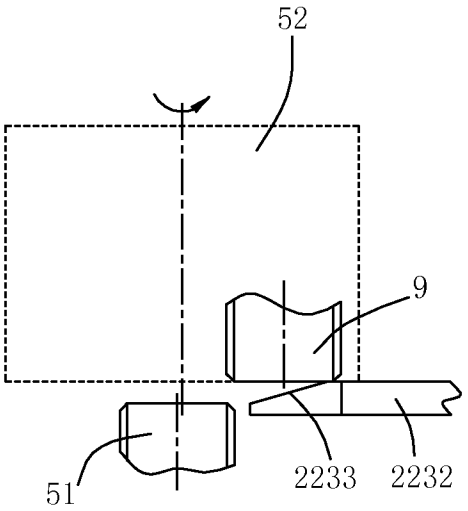
FIG. 38 is similar to FIG. 36, but the difference lies that the tool bit and the connecting shaft are separated by the action of the guide surface when the cartridge is rotated.
Figure 37:
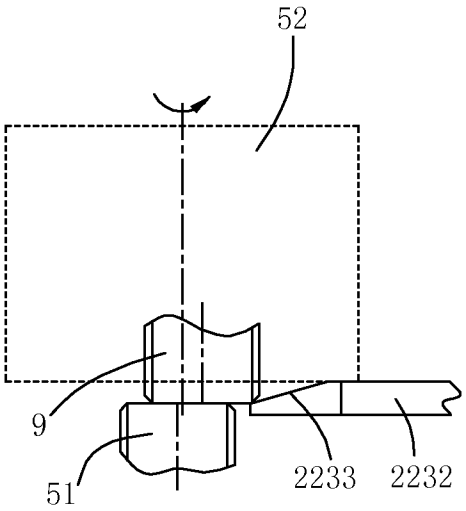
FIG. 37 is similar to FIG. 36, but the difference lies that the tool bit is pressed against the guide surface when the cartridge is rotated.
Figure 36:
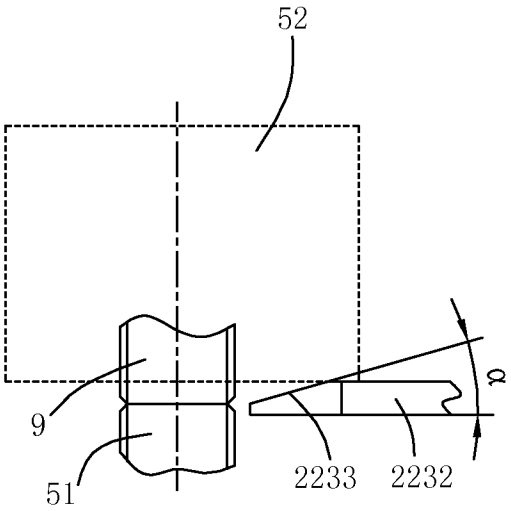
FIG. 36 is a principle schematic view of restricting the tool bit from moving backward with the connecting shaft, wherein the tool bit is guided back to the cartridge and the cartridge and the connecting shaft are separated.

In the third and fourth embodiments, when the tool bit and the connecting shaft 51 are separated and the tool bit 9 is guided back to the cartridge 52, the guide surfaces play the same role Taking the third embodiment as an example, the specific action principle of the guide surfaces 2233 can be seen in FIGS. 36-38; when the tool bit is required to be replaced, the slip cover 53 is operated to drive the connecting shaft 51 to move such that the connecting shaft 51 is axially separated from the cartridge 52 (namely not superposition in the axial direction); the tool bit is still jointed with the connecting shaft 51 by the action of the suction of the magnet 511 on the connecting shaft 51 and even a part exceeds the end face of the cartridge; when the cartridge 52 is rotated, the tool bit displaces with the cartridge 52 and is pressed against the guide surface 2233; in such circumstances, if the cartridge 52 is rotated continuously, by the action of the guide surface 2233 the tool bit 9 will slide to the position where the end face of the tool bit 9 is leveled with the end face of the cartridge 52, without influences on the rotation of the cartridge 52.

If the movement journey of the connecting shaft 51, and the dimension precision and installation precision of the cartridge 52 and the internal structure of the tool are set, the connecting shaft 51 can only drive the tool bit 9 to move to the position where the end face of the tool bit and the end face of the cartridge 52 are leveled, and the cartridge 52 can also rotated as usual. However, in such circumstances, high requirements are imposed on the processing precision and installation precision of the parts and units, which inevitably increase the cost of the electric screwdriver; meanwhile, as friction increases continuously in use, the dimensions of the parts and units generate errors, and then the accident that the tool bit 9 or the connecting shaft 51 clamps the cartridge 52 still occur to cause the cartridge 52 to fail to rotate. It also can be regarded that influenced by the factors such as manufacturing precision, shaking clearance and materials, the tool bit and the gear case cover plate 223, and the connecting shaft 51 and the cartridge 52 may interference with each other during rotation. The guide surface can facilitate the movement of the connecting shaft 51 by a large extent, and then geometric structures of the fitted parts can be improved to eliminate the possibility of interference among various members during the rotation of the cartridge 52. Thus, the requirements on the manufacturing precision and installation precision can be lowered; the cost can be greatly reduced; and the service life of the tool can be prolonged because the cartridge 52 is not easy to be clamped.

According to the movement principle between the tool bit 9 and the guide surface 2233, the guide surface 2233 may be an inclined plane, a curved plane, etc. In this embodiment, the guide surface 2233 is preferably an inclined plane; the inclination angle of the inclined plane with respect to the end face of the cartridge 52 is $\alpha$, and the movement allowance of the connecting shaft 51 is product of multiplying sin a by the length of the inclined plane, so if the angle $\alpha$ is bigger, the movement allowance of the connecting shaft 51 will be bigger, and meanwhile the force for rotating the cartridge 52 to drive the tool bit 9 to move along the inclined plane will be bigger; to achieve balance, the preferable inclination angle $\alpha$ of the inclined plane is 10-30 degrees, thus, the cartridge 52 can be rotated by a small force, and meanwhile the enough movement allowance of the connecting shaft 51 can be ensured.

Figure 40:
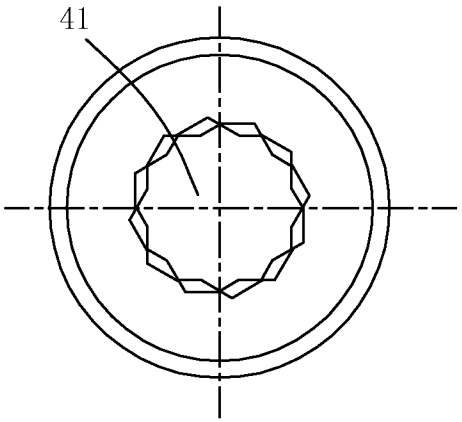
FIG. 40 is a front perspective view of the output shaft of the power tool of FIG. 39.
Figure 39:
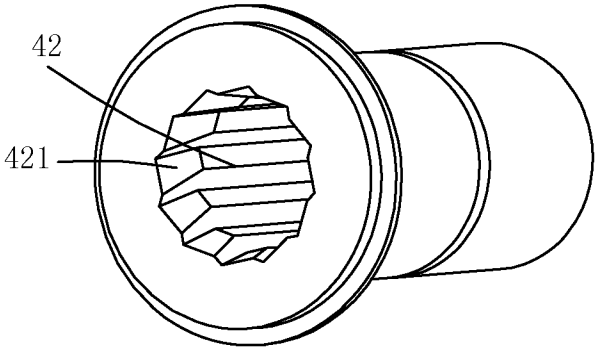
FIG. 39 is a schematic view of the first embodiment of the output shaft of the power tool of FIG. 1.

Generally, the output shaft 4 is axially provided with a hexagonal hole to drive the hexagonal tool bit 9 to rotate. However, when the tool bit 9 is driven by the connecting shaft 51 to enter the output shaft 4, if the hexagonal outline of the tool bit 9 is staggered with the inner hexagonal hole of the output shaft 4, this brings great inconvenience to the operator. To prevent the above mentioned situation, the structure of the output shaft 4 in the present invention is improved. FIG. 39 and FIG. 40 illustrate the first embodiment of the output shaft 4. The output shaft 4 is axially formed with a through-hole 41. The through-hole 41 has a torque transmission portion for transmitting the torque of the output shaft 4 to the tool bit 9 and a correction portion for driving the tool bit to be matched with the torque transmission portion inside. The torque transmission portion is at least one radial protrusion 42 arranged in the through-hole 41; and the radial protrusion 42 can be pressed against one of the surfaces of the hexagonal tool bit 9 and restricts the rotation of the tool bit 9 with respect to the output shaft 4. The correction portion is an inclined plane 421 arranged in the through-hole and close to one end of the transmission mechanism 3; when the tool bit 9 contacts with the inclined plane 421, the output shaft 4 or the tool bit 9 can be driven by the guidance of the inclined plane 421 such that the through-hole 41 is matched with the tool bit 9, that is to say the inclined plane 421 plays the role of correcting the position of the tool bit 9 with respect to the radial protrusion 42 when the tool bit 9 enters the through-hole 41, namely the relative rotation of the tool bit 9 and the output shaft 4, and thus, the situation that the ledge of the tool bit 9 is clamped by the radial protrusion 42 is avoid and the tool bit 9 can enter the through-hole 41 smoothly. The preferable inclined plane 421 in the present invention inclines along the circumference such that the guidance direction of the relative direction of the tool bit 9 and the output shaft 4 is clearer. In this embodiment, 12 radial protrusions 42 are uniformly distributed along the circumference, so the regular cross section of the output shaft 4 is formed into a dodecagon of which every angle is 150 degrees, wherein the dodecagon is formed by superposing two hexagons at an interval of 30 degrees along the circumference. When the connecting shaft 51 pushes the tool bit 9 to enter the output shaft 4, if the hexagonal outline of the tool bit 9 is staggered with the dodecagonal outline of the output shaft, the six angles of the tool bit 9 will be pressed against the inclined plane 421; the tool bit 9 axially moves, and guided by the inclined plane inclining along the circumference, the tool bit 9 or the output shaft 4 rotates until the angles of the tool bit 9 are matched with the through-hole 41 of the output shaft 4 such that the tool bit 9 can smoothly enter the output shaft 4. Besides, the radial protrusion 42 can be connected together with the inclined plane 421; the radial protrusion 42 axially moves along the output shaft 4, thus, the contact area between the radial protrusion 42 and the tool bit 9 is bigger and the torque transmission effect is better. Of course, the radial protrusion 42 and the inclined plane 421 also can be separated by means of axial interruption, circumferential staggering, etc.

Figure 42:
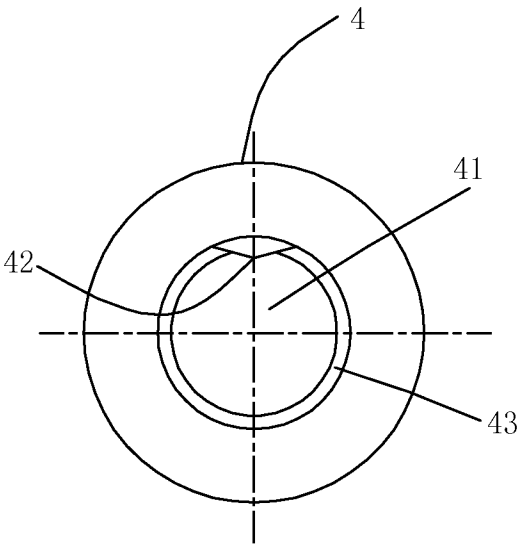
FIG. 42 is a front perspective view of the output shaft of the power tool of FIG. 41.
Figure 41:
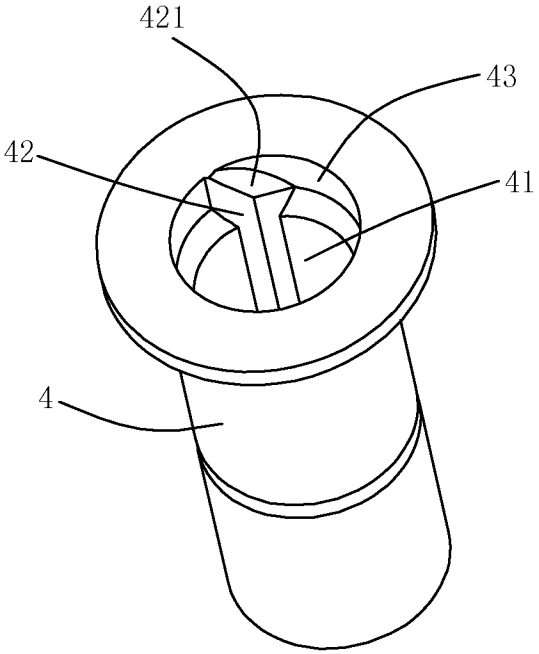
FIG. 41 is a schematic view of the second embodiment of the output shaft of the power tool of FIG. 1.

FIG. 41 and FIG. 42 illustrate the second embodiment of the output shaft 4. The through-hole 41 is provided with just one radial protrusion 42 inside which one corner of a dodecagon. Likewise, one end of the radial protrusion 42 is provided with an inclined plane 421 that inclines along the circumference. Likewise, the output shaft 4 can drive the tool bit 9 to rotate by just one radial protrusion, and the rotation of the tool bit 9 or the output shaft 4 can be realized with the guidance of the inclined plane 421 such that the tool bit 9 smoothly enters the output shaft 4. However, there is always a clearance between the tool chamber 521 and the tool bit 9; each time before the connecting shaft 51 drives the tool bit 9 to enter the output shaft, the axis of the tool bit 9 and the axis of the connecting shaft 51 are deviated, and in this way, the space for radial movement of the tool bit 9 in the output shaft 4 is very small. In order to provide a bigger space for the movement of the tool bit 9 with respect to the output shaft 4 when the tool bit 9 enters the output shaft 4, the through-hole is further provided with a guide portion inside; the guide portion is an inner step 43 which is arranged at the end, close to the cartridge 52, in the through-hole; the inner diameter of the inner step 43 is bigger than that of the through-hole 41; the inner step 43 and the through-hole 41 are in transition by the inclined plane; the height of the inner step 43 along the axial direction is basically equal to that of the inclined plane 421 along the axial direction; and thus, the tool bit 9 has a bigger space for rotation or axial movement with respect to the output shaft 4 when the tool bit 9 enters the output shaft 4 so as to enter the output shaft 4 more smoothly.

Figure 44:
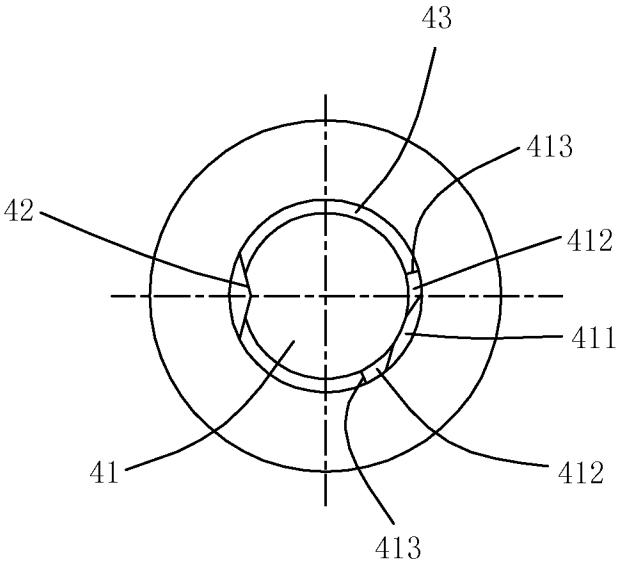
FIG. 44 is a front perspective view of the output shaft of the power tool of FIG. 43.
Figure 43:
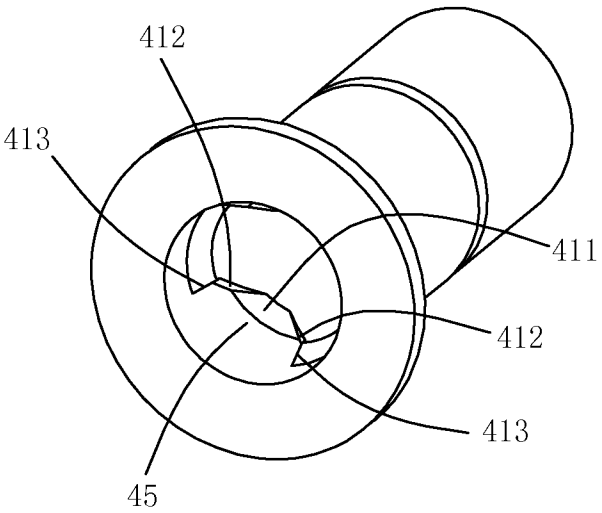
FIG. 43 is a schematic view of the third embodiment of the output shaft of the power tool of FIG. 1.

FIG. 43 and FIG. 44 illustrate the third embodiment of the output shaft 4. In order to prevent the situation that the peripheral hexagonal point of the tool bit 9 is directly aligned with tip of the radial protrusion 42 when the tool bit 9 enters the output shaft 4, a countersunk 45 communicated with the inner step 43 is arranged in the through-hole 41 of the output shaft 4 and at the position opposite to the centre of the radial protrusion 42. Here, "opposite to the centre" refers that the point symmetric to the centre of the sharp portion of the radial protrusion 42 is located between the two lateral sides 413 of the countersunk 45. The countersunk 45 has a bottom face 411 connected with the through-hole 41 and two lateral faces 412; the bottom face 411 and the through-hole 41 are in inclined transition so as to easily guide the tool bit 9 into the through-hole 41; the two lateral faces 4 are circumferentially inclined such that the tool bit 9 radially moves to the countersunk 45, rotates with the guidance of the lateral faces 412 and enters the through-hole 41 with the guidance of the bottom face 411 when the tool bit 9 enters the output shaft 4 and the peripheral hexagonal point of the tool bit 9 is directly aligned with the sharp portion of the radial protrusion 412. Thus, it is ensured that the tool bit 9 can smoothly enter the output shaft 4 from any angle.

The above description is the way that the radial protrusion 42 of the output shaft 4 is has surface contact with the tool bit 6 to drive the tool bit 9 to rotate, which ensures uniform stress on the tool bit 9 and small stress on a unit area. Of course, the linear contact between the radial protrusion 42 of the output shaft 4 and the tool bit 9 can also drive the tool bit 9 to rotate: for example, the angle of the radial protrusion 42 is not limited as long as the radial protrusion 42 can drive the tool bit 9 to rotate, and the inclined plane 421 at one end of the radial protrusion 42 circumferentially inclines, which also enables the tool bit 9 to smoothly enter the output shaft 4.

The above embodiment refers to the improvement of the output shaft itself. In another preferable embodiment of the invention, the output shaft 4 can be provided with an elastic pressing device that can adjust the relative positions of the tool bit 9 and the output shaft to enable the tool bit 9 to smoothly enter the output shaft.

Figure 45:
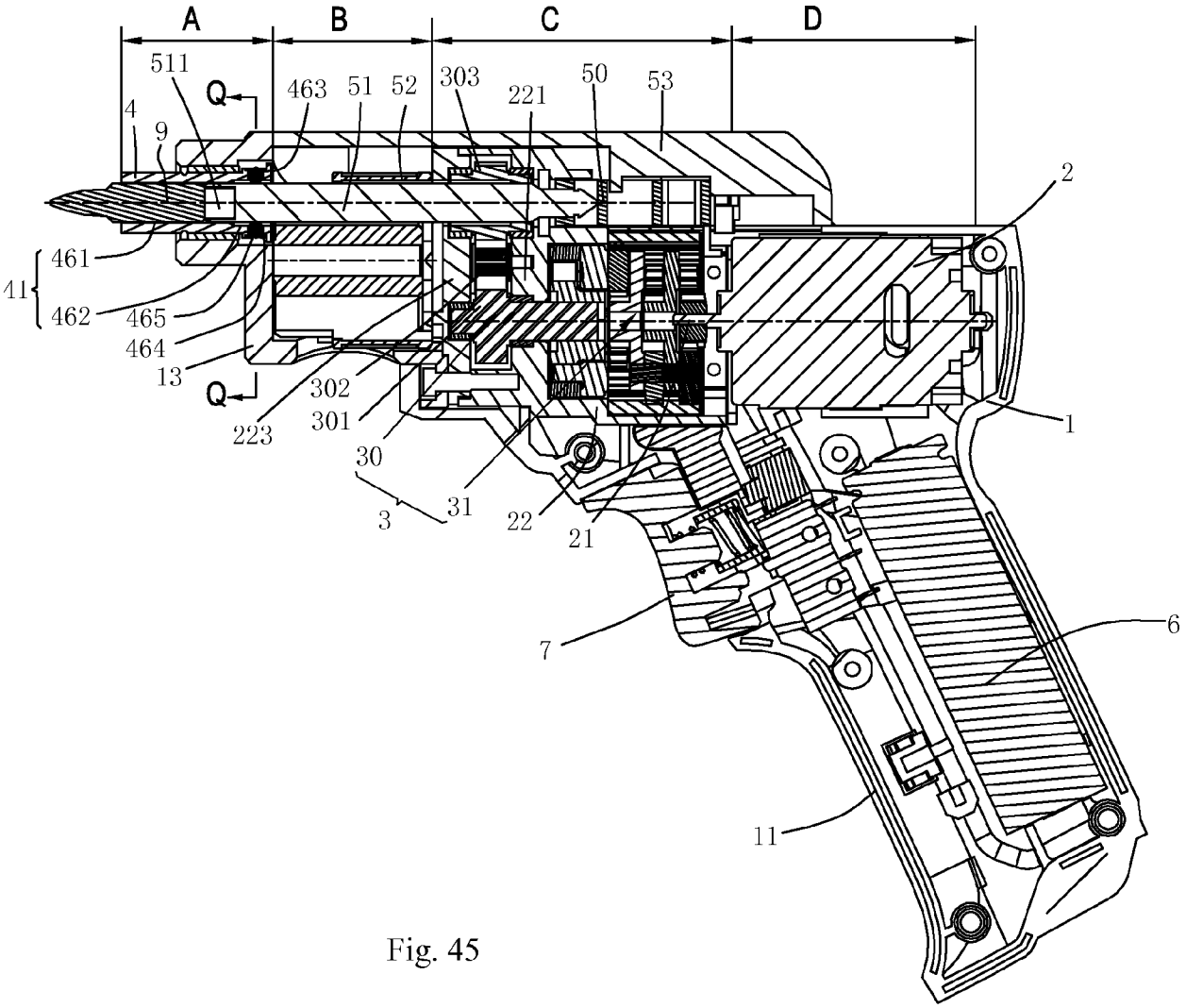
FIG. 45 is a cross-sectional view of a power tool such that the power tool is located at the working position according to a third preferred embodiment of the present invention.
Figure 46:
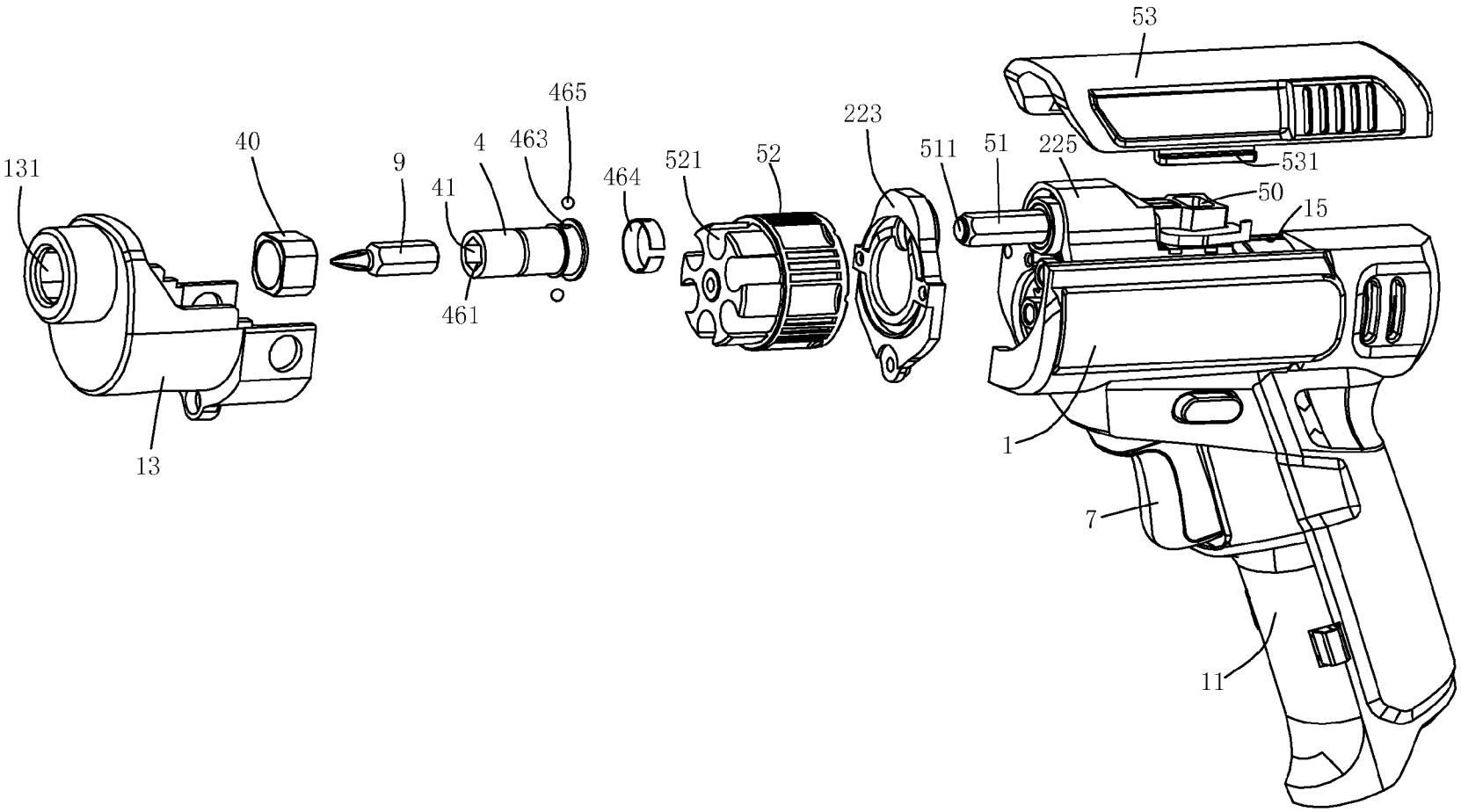
FIG. 46 is a partial exploded view of FIG. .45.
Figure 47:
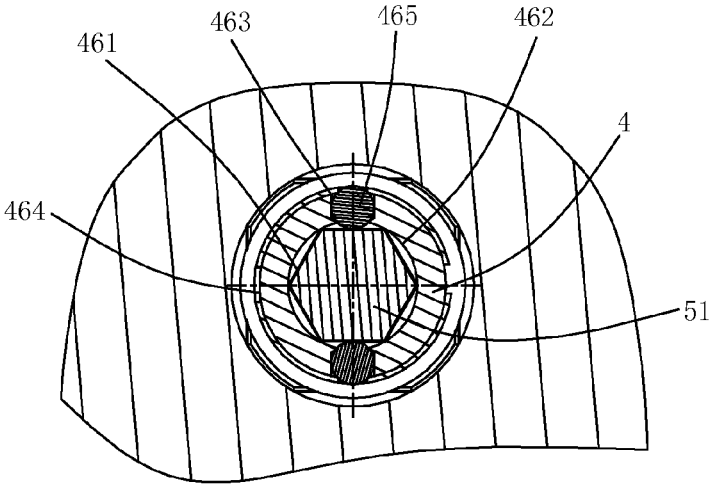
FIG. 47 is a partial cross-sectional view taking along line Q-Q of FIG. 1.
Figure 48:
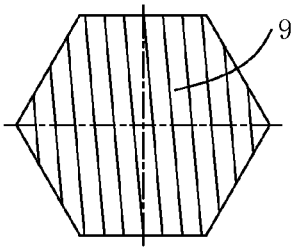
FIG. 48 is a schematic cross-sectional view of a tool bit of the power tool of the present invention.
Figure 49:
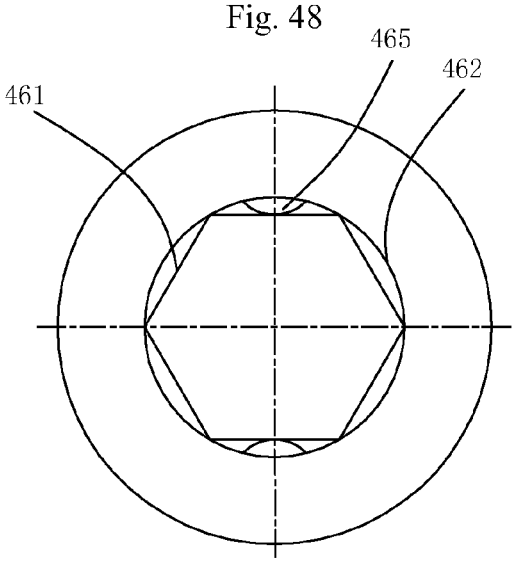
FIG. 49 is a right perspective view of the output shaft of the power tool of FIG. 45, wherein the tool bit has not entered into the output shaft.
Figure 50:
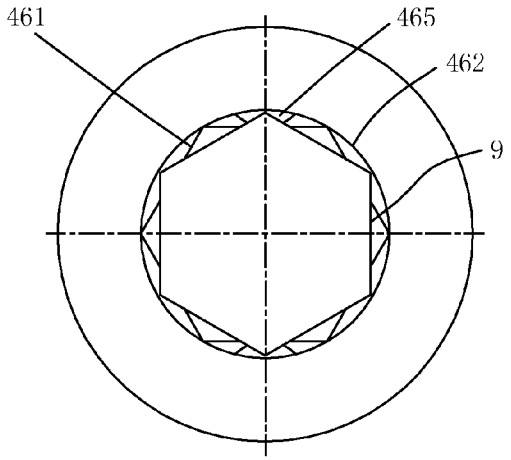
FIG. 50 is similar to FIG. 49, but the difference lies that the tool bit just enters into the corrected portion of the output shaft.
Figure 51:
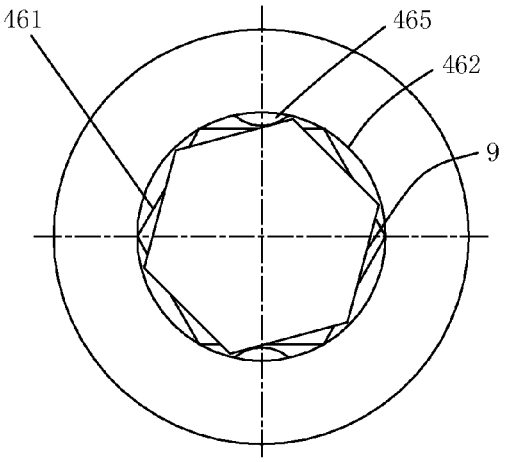
FIG. 51 is similar to FIG. 49, but the difference lies that the relative rotation is generated between the tool bit and the output shaft under the action of bias of the elastic pressing device.
Figure 52:
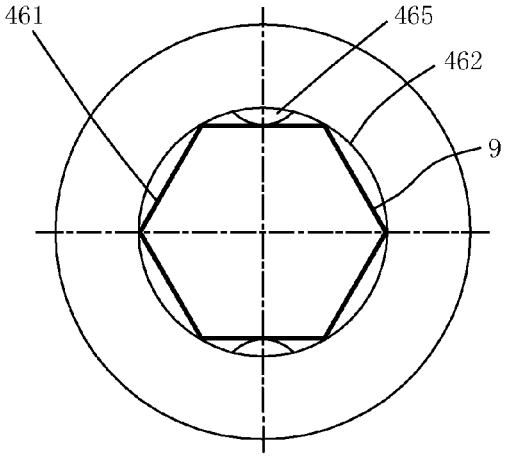
FIG. 52 is similar to FIG. 49, but the difference lies that the tool bit enters into the torque transmission portion of the output shaft.

FIGS. 45-52 illustrate the first embodiment of the elastic pressing device of the present invention. As shown in FIGS. 45-47, the hole 41 of the output shaft 4 comprises a torque transmission portion 461 and a correction portion 462 along the axial direction; the torque transmission portion 461 is configured as a hexagonal hole and drives the tool bit to rotate; the correction portion 462 is configured as a round hole and enables the tool bit 9 to smoothly enter the hole 41; the elastic pressing device is arranged at a position directly corresponding to the correction portion 462, comprising a radial through-hole 463 communicated with 41, a pressing member 465 received in the radial through-hole 463, and a C-shaped spring plate 464 sleeved on the output shaft 4 and eccentrically pressing the pressing member 465 in the radial direction; by the action of the C-shaped spring plate 464, the pressing member 465 at least partly extends into the correction portion 462 of the hole 41, while the pressing member 465 is arranged at a position axially corresponding to the extension face of one of the planes of the hexagonal hole of the torque transmission portion 461, and thus, the tool bit 9 can directly enter the torque transmission portion 461 when the tool bit 9 enters the the correction portion 462 and one of the hexagonal peripheral planes of the tool bit 9 is axially corresponding to the pressing member 465. As shown in FIGS. 48-50, one of the hexagonal peripheral planes of the tool bit 9 is axially staggered with the pressing member 465, and then the tool bit 9 enters the correction portion 462 and radially presses the pressing member 465; the pressing member 465 presses the C-shaped spring plate 464 such that the C-shaped spring plate 464 generate elastic deformation; meanwhile, the pressing member 465 is also stressed by the reverse acting force of the C-shaped spring plate 464 and presses the tool bit 9 because of the reverse acting force, and then the relative rotation is generated between the tool bit 9 and the output shaft 4; one of the hexagonal peripheral planes of the tool bit 9 is axially corresponding to the pressing member 465; at this moment, the tool bit 9 is matched with the torque transmission portion 461 so as to smoothly enter the torque transmission portion 461, and the C-shaped spring plate 464 recovers to the initial state.

Figure 53:
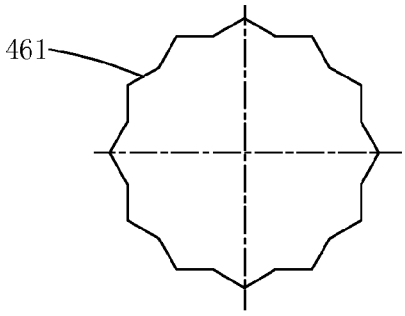
FIG. 53 is a schematic view of the second embodiment of the outline of the torque transmission portion of the output shaft.
Figure 54:
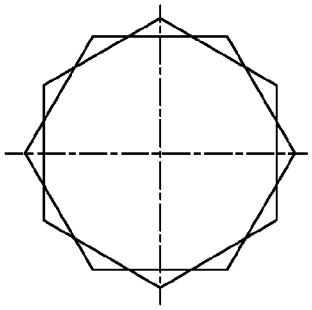
FIG. 54 is a schematic view of the formation of the torque transmission portion of the output shaft, wherein the dodecagon is formed by two regular hexagons at a phase difference of 30 degrees.
Figure 55:
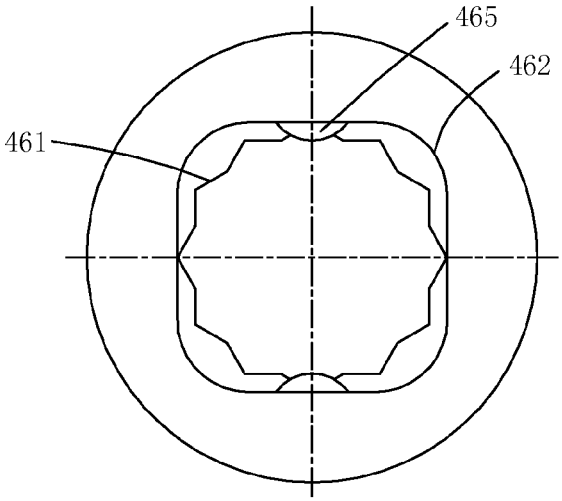
FIG. 55 is a right perspective view of the output shaft of FIG. 53, wherein the tool bit has not entered into the output shaft.
Figure 56:
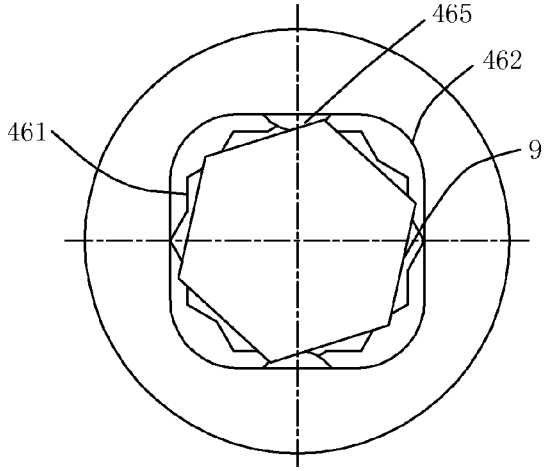
FIG. 56 is similar to FIG. 55, but the difference lies that the tool bit just enters into the corrected portion of the output shaft.
Figure 57:
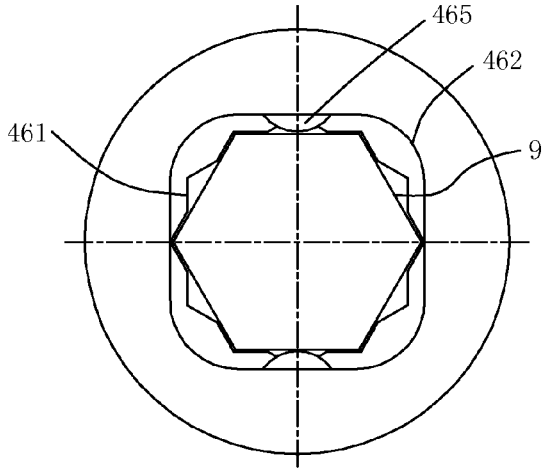
FIG. 57 is similar to FIG. 55, but the difference lies that the tool bit enters into the torque transmission portion of the output shaft.
Figure 58:
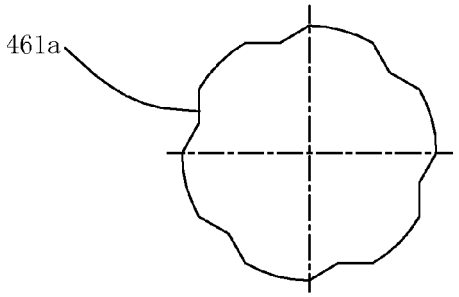
FIG. 58 is a schematic view of the third embodiment of the outline of the torque transmission portion of the output shaft.
Figure 59:
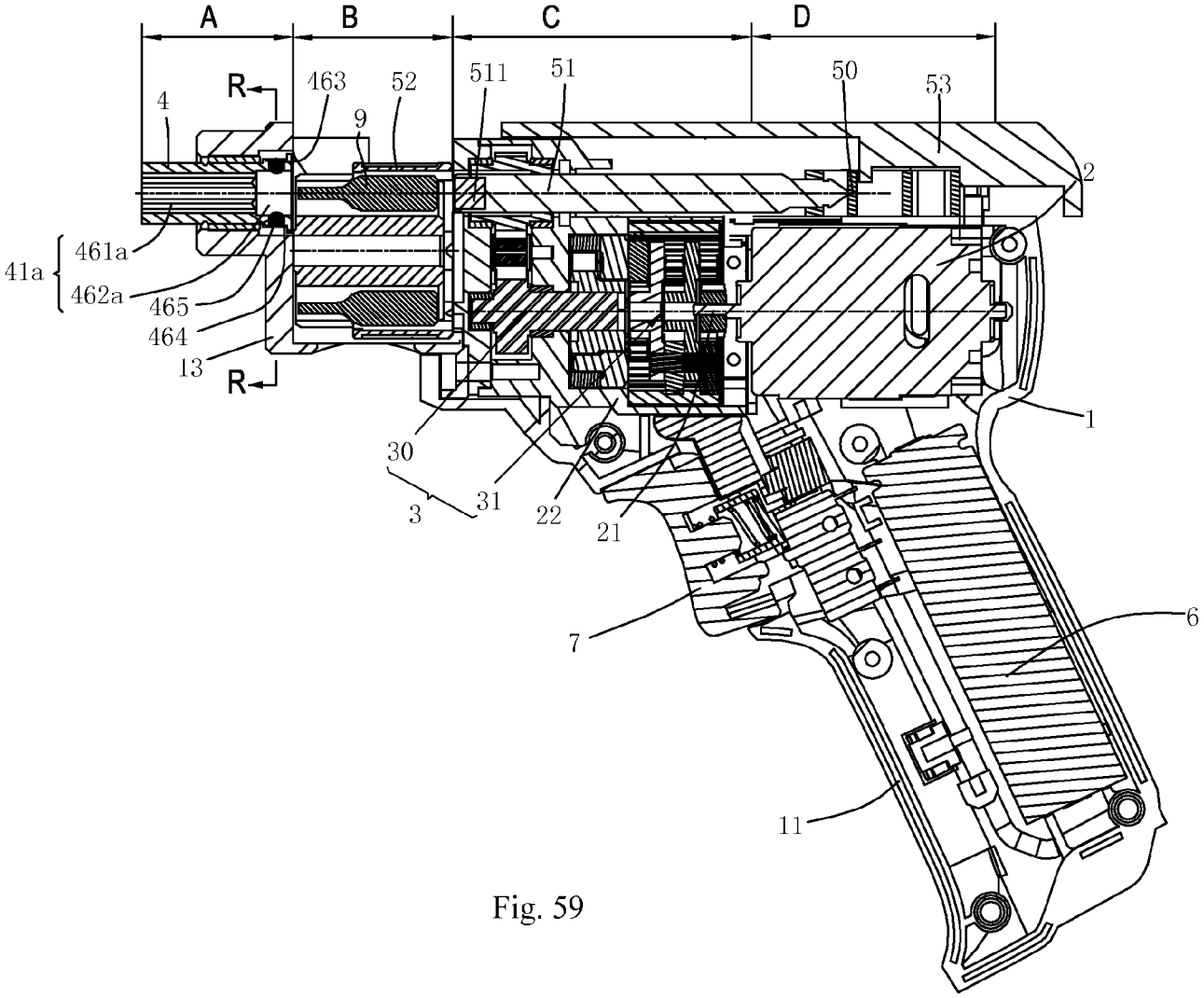
FIG. 59 is a cross-sectional view of a power tool is provided with the output shaft in FIG. 58 when the tool bit of the power tool is being replaced according to a second preferred embodiment of the present invention.
Figure 60:
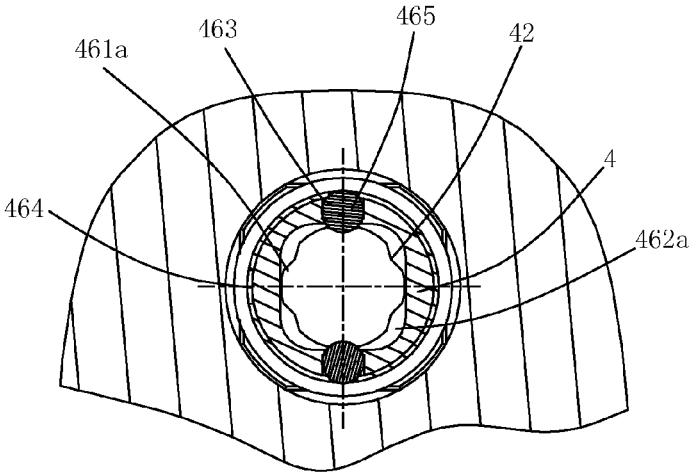
FIG. 60 is a partial cross-sectional view taking along line R-R of FIG. 59, wherein the tool bit has not entered into the output shaft.

FIG. 53 and FIG. 57 illustrate the second embodiment of the present invention. The correction portion 462*a* of the output shaft 4 is set to be a square hole, and the torque transmission portion 461*a* is set to a dodecagon. The dodecagon in this embodiment is formed by two regular hexagons at a phase difference of 30 degrees. In this way, the torque transmission portion 461*a* has 12 inward radial protrusions 42 that can be pressed against the torque stressed portion of the hexagonal tool bit 9 and restrict the rotation of the tool bit 9 with respect to the output shaft 4. Thus, the pressing member 465 can be arranged at a position aligned with the axial extension line of the joint of two adjacent radial protrusions; when the tool bit 9 enters the correction portion 462*a*, if one of the hexagonal peripheral faces of the tool bit 9 is axially corresponding to the pressing member 465, the tool bit 9 can directly enter the torque transmission portion 461*a*. As shown in FIG. 56 and FIG. 57, one of the hexagonal peripheral faces of the tool bit 9 is axially staggered with the pressing member 465, and then tool bit 9 rotates with respect to the output shaft 4 by the action of the pressing member 465 and the C-shaped spring plate 464 to enter the torque transmission portion 461*a* as long as the radial protrusion 42 is fitted with one of the faces of the tool bit 9. According to the above arrangement, those skilled in this field can easily figure out that the output shaft can drive the tool bit to rotate by just at least one radial protrusion 42. Such radial protrusions can be a pair, radially opposite along the circumference, which means that the radial protrusion pair is symmetrically distributed such that the tool bit is driven by the output shaft 4 to rotate and is uniformly stressed. Of course, two or three pairs can be arranged, wherein two radial protrusions 42 in each pair are radially opposite, and the radial protrusion 42 can be pressed against one of the faces of the hexagonal tool bit 9 and restrict the rotation of the tool bit 9 with respect to the output shaft 4.

The above description is the way that the radial protrusion 42 of the output shaft 4 is has surface contact with the tool bit 6 to drive the tool bit 9 to rotate, which ensures uniform stress on the tool bit 9 and small stress on a unit area. Of course, the linear contact between the radial protrusion 42 of the output shaft 4 and the tool bit 9 can also drive the tool bit 9 to rotate: for example, the angle of the radial protrusion 42 is not limited as long as the radial protrusion 42 can drive the tool bit 9 to rotate, or the pressing member 465 is arranged at a position axially corresponding to the extension portion of the radial protrusion 42, which also enables the tool bit 9 to smoothly enter the output shaft 4. Here, the pressing member refers to the steel ball, steel column, etc.; in case of the steel ball, two steel balls can be arranged as long as one of the two is axially corresponding to the radial protrusion 42, so symmetric and unsymmetrical distribution both can enable the tool bit to smoothly enter the output shaft 4.

Figure 61:
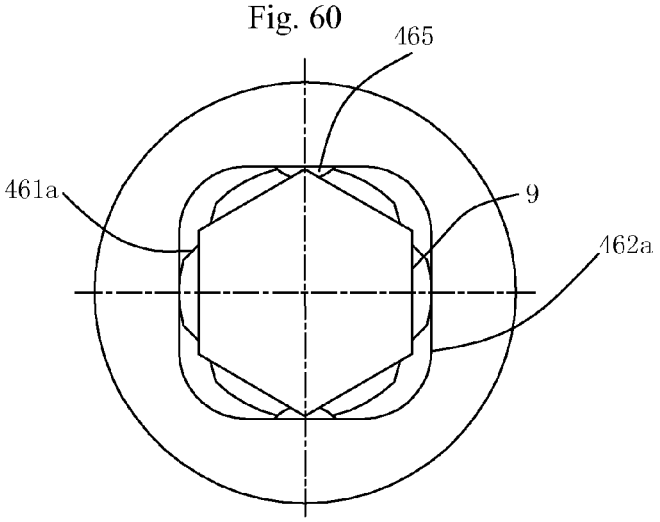
FIG. 61 is a right perspective view of the output shaft of FIG. 58, wherein the tool bit just enters into the corrected portion of the output shaft.
Figure 62:
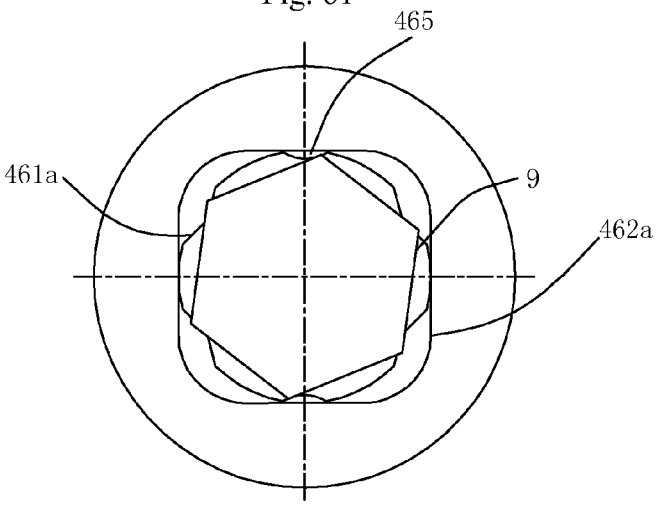
FIG. 62 is similar to FIG. 61, but the difference lies that the relative rotation is generated between the tool bit and the output shaft under the action of bias of the elastic pressing device.
Figure 63:
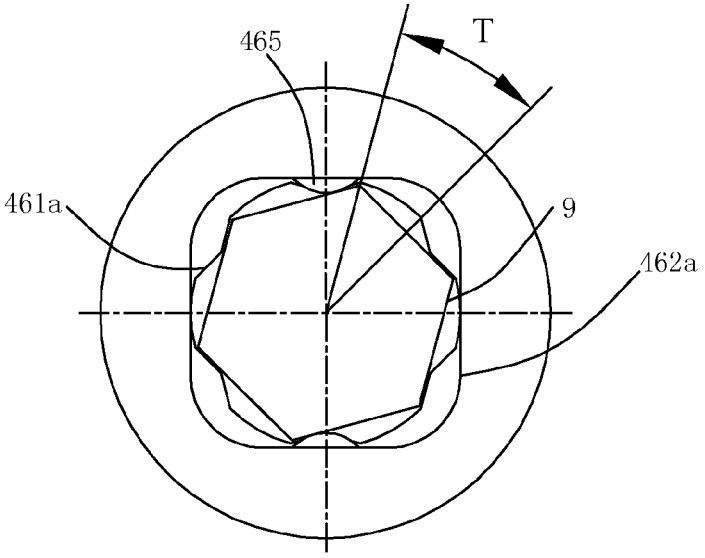
FIG. 63 is similar to FIG. 61, but the difference lies that the tool bit enters into the torque transmission portion of the output shaft.

In the above embodiments, no matter the torque transmission portion is hexagonal or dodecagonal, the hexagonal outline of the tool bit shall be completely corresponding to the torque transmission portion of the output shaft 4; and any tiny deviation will cause the tool bit 9 to fail to smoothly enter the output shaft 4. To solve this problem, FIGS. 58-63 illustrate the third embodiment of the present invention. The torque transmission portion only adopts odd number or even number of the 12 radial protrusions such that the torque transmission portion has 6 radial protrusion and every two radial protrusions 42 are in arc transition. The pressing member 465 is arranged at a position wherein the pressing member 465 is aligned with the axial extension portion of one of the radial protrusions. As shown in FIG. 61, when the hexagonal outline of the tool bit 9 is staggered with the torque transmission portion, the tool bit 9 is restricted by the pressing member 465; if the tool bit 9 continuously moves forward, the pressing member 465 forces the C-shaped spring plate 464 to generate elastic deformation; meanwhile, the elastic deformation of the C-shaped spring plate 464 acts on the pressing member 465 such that the tool bit 9 and the output shaft 4 rotate relatively. As shown in FIG. 62, one face of the hexagonal outline of the tool bit 9 is fitting to one of the radial protrusions. As shown in FIG. 63, the tool bit 9 can smoothly enter the torque transmission portion of the output shaft. Actually, both the tool bit 9 and the output shaft 4 need to rotate a very small angle relatively, and the arc transition can leave enough space for the relative rotation of the tool bit 9 and the output shaft 4. Meanwhile, as long as the ledge of the hexagonal outline of the tool bit 9 is corresponding to the arc part, the tool bit 9 can directly enter the torque transmission portion of the output shaft, which means that the angle T corresponding to the arc part is the non-interference angle scope for the tool bit 9 to enter the output shaft. In this embodiment, T is 30 degrees, and then 6 arcs has 180 degrees. That is to say, the tool bit can directly enter the torque transmission portion of the output shaft without correction at a 50% probability. Thus, the service life of the elastic pressing device can be increased.

Figure 64:
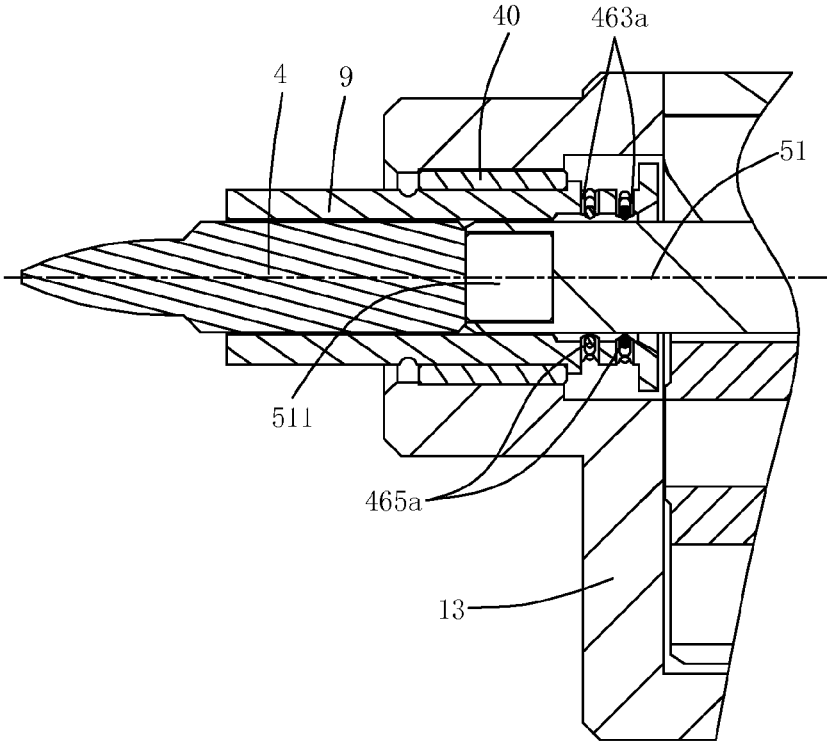
FIG. 64 is a partial cross-sectional view of a power tool such that the power tool is located at the working position according to a fourth preferred embodiment of the present invention.
Figure 65:
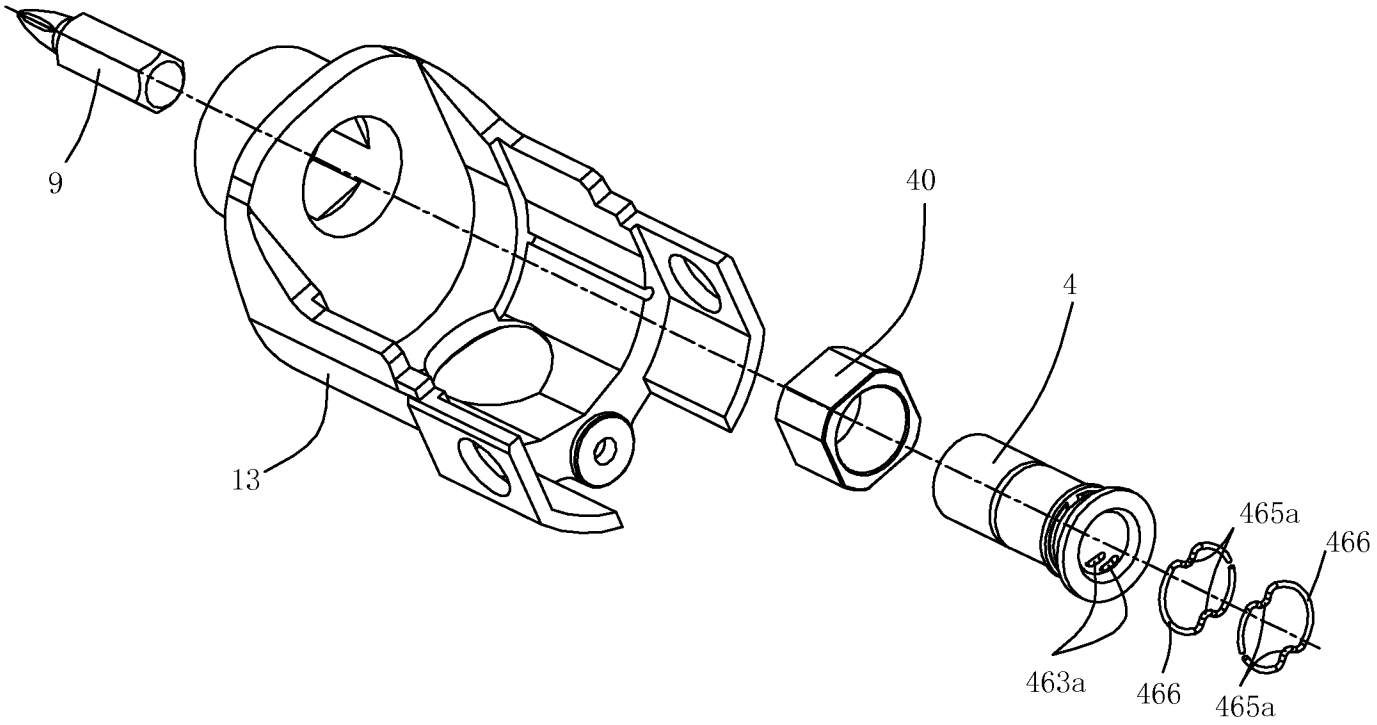
FIG. 65 is a partial exploded view of the power tool of FIG. 64.

FIGS. 64-65 illustrate the fourth embodiment of the present invention. The elastic pressing device comprises a radial through-hole 463*a* which is arranged at the position of the correction portion 462 of the output shaft 4 to be communicated with the hole 41; an annular steel wire 466 with an opening is sleeved at the position of the radial trough-hole 463*a* on the output shaft 4; the annular steel wire 466 is provided with a protrusion portion 465*a* which is received in the radial through-hole 463*a* and partly extends into the correction portion 462. In this embodiment, the preferably radial through-hole 463*a* is a waist-shaped hole; in the longitudinal direction, the through-hole extends along the circumference of the output shaft 4, which reduces the length of the output shaft and makes the structure compacter. Of course, the through-hole may be round, square, etc. according to the needs. When the tool bit 9 enters the correction portion 462, if one of the hexagonal peripheral faces of the tool bit 9 is circumferentially corresponding to the protrusion portion 465*a*, the tool bit 9 can directly enter the torque transmission portion 461; and if one of the hexagonal peripheral faces of the tool bit 9 is circumferentially staggered with the protrusion portion 465*a*, the tool bit 9 can rotate with respect to the output shaft 4 by the action of the annular steel wire 466 to enable the hexagonal outline of the tool bit 9 to be matched with the torque transmission portion 461 such that the tool bit 9 can smoothly enter the output shaft 4.

In the above embodiment, the two radial through-holes 463*a* and correspondingly two annular steel wires 466 are preferably provided and arranged at an interval along the axial direction of the output shaft 4, which further strengthens the guidance and correction for the tool bit 9 to enter the output shaft 4. Besides, two radial through-holes 463*a* can be circumferentially staggered, which means that the relative phase difference of the two radial through-holes 463*a* is less than 30 degrees and that the relative phase difference is generated if the interval between two radial through-holes 463*a* is +/−60 degrees. Thus, it is ensured that the one of the ledges of the hexagonal outline of the tool bit 9 is directly aligned with the protrusion portion of one of the two annular steel wires and that the protrusion portion of the other annular steel wire can be just staggered with other ledges of the hexagonal outline of the tool bit. Then, the tool bit 9 can be guided when entering the correction portion 462 from any angle such that the outline of the tool bit 9 is matched with the torque transmission portion 461.

Figure 66:
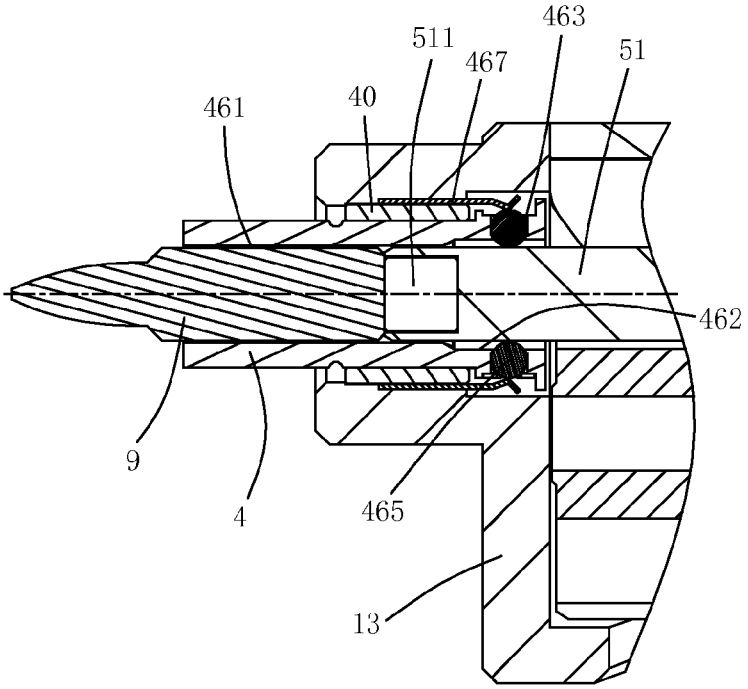
FIG. 66 is a partial cross-sectional view of a power tool such that the power tool is located at the working position according to a fifth preferred embodiment of the present invention.

FIG. 66 illustrates the fifth embodiment of the present invention, the elastic pressing device comprises a radial through hole 463 which is arranged at the position of the correction 462 on the output shaft 4 to be communicated with the hole 41, a pressing member 465 received in the through-hole 463 and a spring plate 467 radially eccentrically pressing the pressing member 465; the spring plate 467 is a leaf spring extending along the axial direction of the output shaft 4; one end of the spring plate 467 is fixed between the output shaft 4 and the housing 1, and the other end is a free end with a bending portion for pressing against the pressing member 465 so as to increase the spring force of the spring plate 467 on the pressing member 465. In this embodiment, the principle that the tool bit 9 is guided when entering the output shaft 4 is identical with that in the first embodiment and therefore the description thereof is omitted here.

Figure 67:
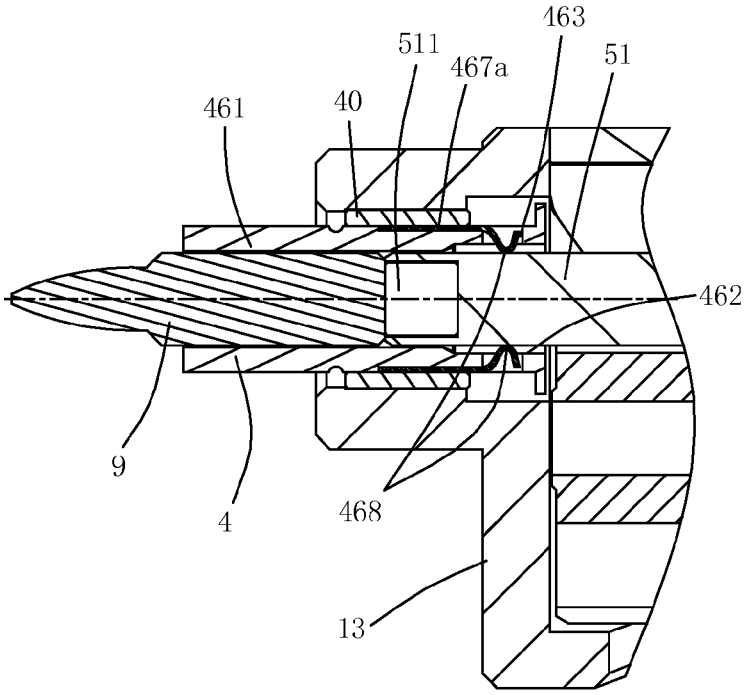
FIG. 67 is a partial cross-sectional view of a power tool such that the power tool is located at the working position according to a sixth preferred embodiment of the present invention.
Figure 68:
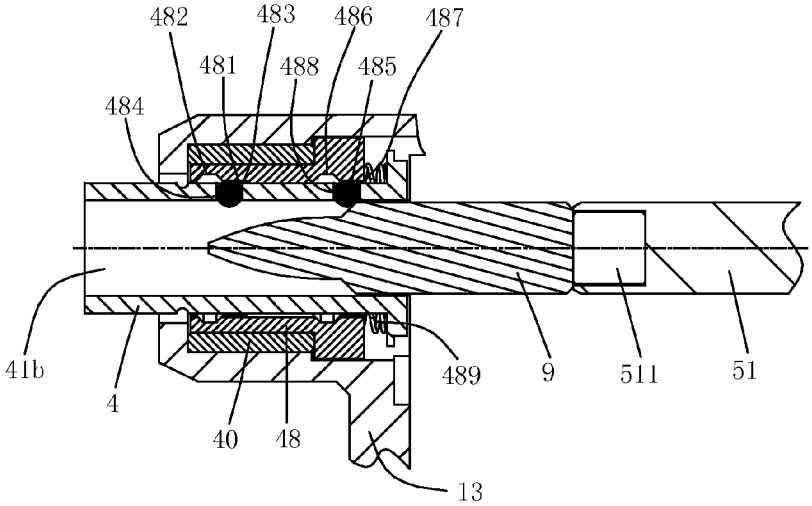
FIG. 68 is a partial cross-sectional view of a power tool such that the power tool is located at the working position according to a seventh preferred embodiment of the present invention, wherein the tool bit just enters into the corrected portion of the output shaft.
Figure 69:
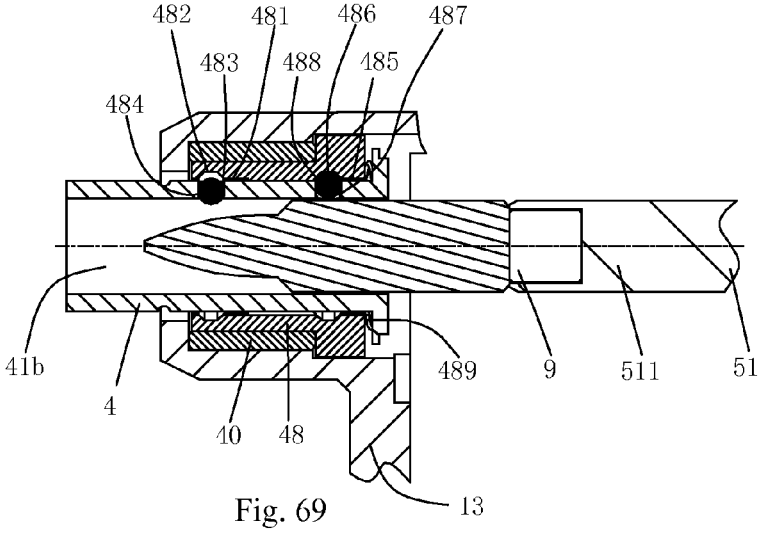
FIG. 69 is similar to FIG. 68, but the difference lies that the tool bit crosses the first locking member.
Figure 70:
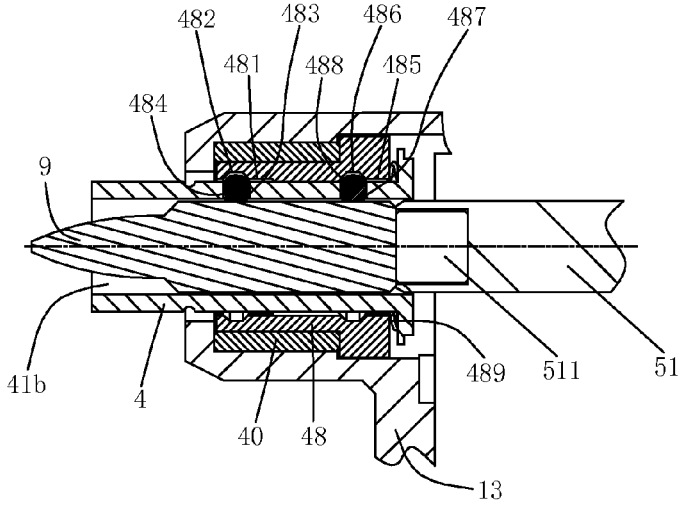
FIG. 70 is similar to FIG. 68, but the difference lies that the tool bit crosses the second locking member.
Figure 71:
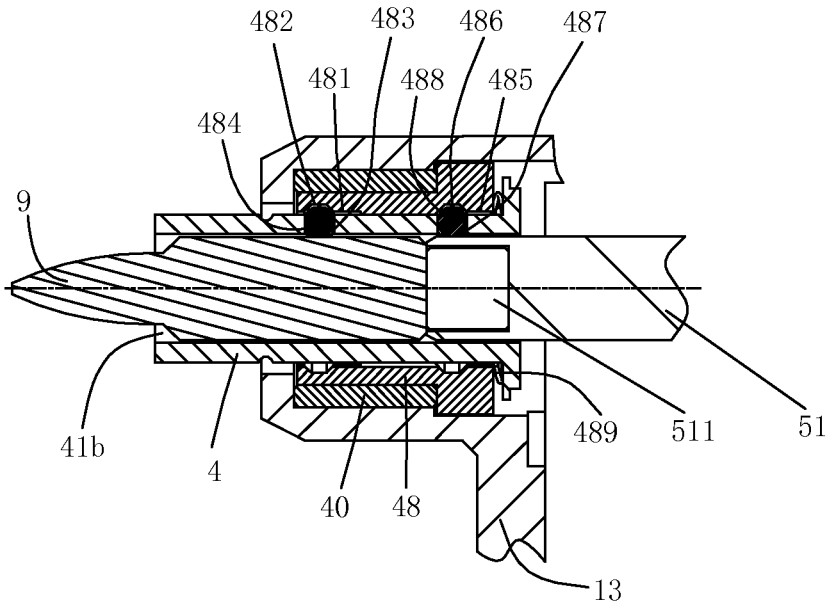
FIG. 71 is similar to FIG. 68, but the difference lies that the connecting shaft crosses the first locking member.
Figure 72:
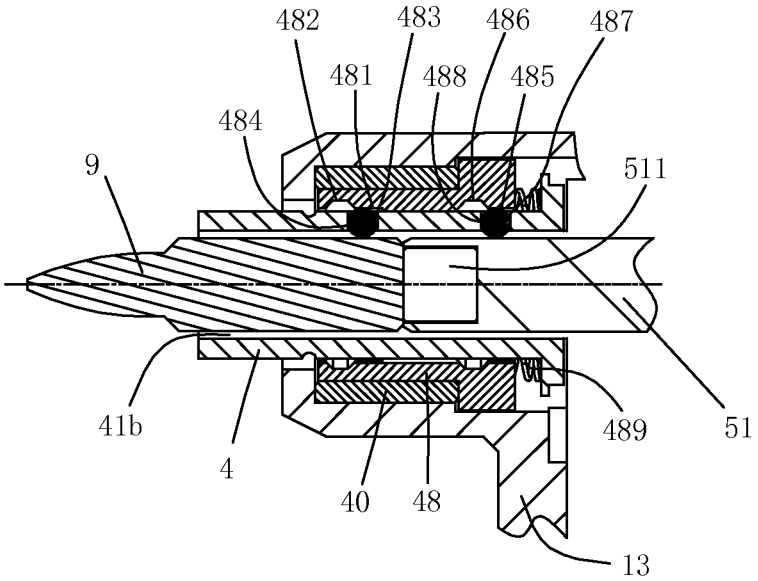
FIG. 72 is similar to FIG. 68, but the difference lies that the output shaft resets and can drive the tool bit to rotate together.

FIG. 67 illustrates the sixth embodiment of the present invention. The elastic pressing device comprises a radial through-hole 643 which is formed at the position of the correction portion 462 on the output shaft 4 to be communicated with the hole 41 and a spring plate 467*a* which is partly received in the radial through-hole 463 and extends into the correction portion 462; one end of the spring plate 467*a* is fixed between the output shaft 4 and the housing 1, while the other end is a free end with a bending portion 468, wherein the bending portion 468 extends into the correction portion 462. Here, the bending portion 468 is equivalent to the pressing member, which means that the integration of pressing member and the elastic member can also function as a guide of the tool bit.

FIGS. 68-72 illustrate the seventh embodiment of the present invention. In this embodiment, the output shaft 4 has a hole 41*b* which is formed axially. The hole 41*b* is a round hole. The output shaft 4 is provided with a first tool groove 483 which is communicated with the hole 41*b;* the first tool groove 483 receives part of a first locking member which extends into the hole 41*b;* the first locking member 484 is pressed against one of the circumferential surfaces of the tool bit which is received in the hole 41*b* to restrict the rotation of the tool bit with respect to the output shaft 4. The tool bit 9 can smoothly enter the output shaft 4 as along as one of the faces of the hexagonal outline of the tool bit 9 is corresponding to the first locking member 484, and then the output shaft 4 drives the tool bit to rotate via the first locking member 484.

With the first tool groove 483, the first locking member 484, etc., the output shaft 4 can drive the tool bit 9, which means that if the output shaft is directly driven to rotate by the gear, then the tool bit can smoothly enter the output shaft. To enable the connecting shaft 51 to drive the output shaft 4 to rotate, the output shaft 4 can be provided with a second tool groove 487 at an interval with the first tool groove 483; the second tool groove 487 receives part of a second locking member 488 which extends into the hole 41*a;* and the second locking member is pressed against one of the faces of the hexagonal outline of the connecting shaft 51 which extends into the hole 41*b* so as to drive the output shaft 4 to rotate. As long as one of the faces of the hexagonal outline of the connecting shaft 51 is corresponding to the first locking member 484, the connecting shaft 51 can smoothly enter the output shaft 4 so as to drive the output shaft 4 to rotate by the second locking member 488.

However, when the circumferential surface of the hexagonal outline of the tool bit 9 is staggered with the first locking member 484, the tool bit 9 is restricted by the first locking member 484 when entering the output shaft 4; the first locking member 484 can be set to move radially such that the tool bit 9 is allowed to enter the output shaft 4 and meanwhile the output shaft 4 also can drive the tool bit 9 to rotate by the first locking member 484. Specifically, a restricting member 48 can be arranged between the output shaft 4 and the front housing 13; the output shaft 4 can axially move with respect to the restricting member 48; the first locking member 484 is allowed to move radially or restricted from moving radially by the restricting member along with the axial movement of the output shaft 4; the restricting member 48 is axially provided with a first clamping portion 481 and a first release portion 482; when allowed to move radially, the first locking member 484 can be engaged with the first release portion 482; and when restricted from moving radially, the first locking member 484 is engaged with the first clamping portion 481. Besides, an elastic member 489 is arranged between the output shaft 4 and the restricting member 48; the output shaft 4 moves axially to compress the elastic member 489; after the tool bit 9 enters the output shaft 4, by the action of the elastic force the output shaft 4 can return to the position where the first locking member 484 and the first clamping portion 481 are engaged such that the output shaft drives the tool bit to rotate by the locking member.

Likewise, to prevent the situation that the connecting shaft 51 is stopped by the second locking member 488 when entering the output shaft 4, the position, corresponding to the second locking member 488, on the restricting member 48 can be axially provided with a second release portion 486 and a second clamping portion 485; when one of the surfaces of the hexagonal outline of the connecting shaft 51 is aligned with the second locking member 488, the connecting shaft 51 will not be stopped and can be smoothly inserted into the output shaft 4; the second locking member 488 can be rotated to function as a hexagonal hole to clamp the connecting shaft so as to rotate together. When the ledge portion of the hexagonal outline of the connecting shaft 51 is aligned with the second locking member 488, the connecting shaft 51 stopped by the second locking member 488 drives the second locking member 488 and the output shaft 4 to overcome the elastic force to move forward so as to reach the second release portion 486 of the restricting member 48; then, the second locking member 488 radially moves to be engaged with the second release portion 486; and the connecting shaft 51 smoothly enters the output shaft 4. After being powered on, when the connecting shaft 51 rotates to the straight side thereof to be corresponding to the second locking member 488, by the action of the elastic force the output shaft 4 drives the second locking member 488 to return to the position where the second locking member 488 is engaged with the second clamping portion 485.

The specific process is as follows: when the straight surface of the hexagonal outline of the tool bit 9 is aligned with the first locking member 484, the tool bit 9 is not stopped and can smoothly enter the output shaft 4; if one of the faces of the hexagonal outline of the connecting shaft 51 is also aligned with the second locking member 488, the connecting shaft 51 also can smoothly enter the output shaft 4; when rotating, the connecting shaft 51 drives the output shaft 4 to rotate by the second locking member 488; and then the output shaft 4 drives the tool bit 8 to rotate together by the first locking member 484. When one of the surfaces of the hexagonal outline of the connecting shaft 51 is staggered with the second locking member 488, the connecting shaft 51 drives the second locking member 488 and the output shaft 4 to overcome the elastic force to move forward until the second locking member 488 is separated from the second clamping portion 485 of the restricting member 48; the second locking member 488 moves radially to be engaged with the second release portion; and then the connecting shaft 51 can smoothly enter the output shaft 4. After being powered on, the connecting shaft 51 is driven to rotate; the restricting member 48 is pressed against the second member 488 by the action of the elastic force; the second locking member 488 radially moves to be separated from the second release portion 486; by the action of the elastic force, the output shaft 4 drives the second locking member 488 to move axially; the second locking member 488 returns to the position where the second locking member 488 is engaged with the second clamping portion 485; and then the connecting shaft 51 can drive the output shaft 4 to rotate by the second locking member 488.

When the straight surface of the hexagonal outline of the tool bit 9 is staggered with the first locking member 484, the tool bit 9 stopped by the first locking member 484 drives the first locking member 484 and the output shaft 4 to overcome the elastic force to move forward until the first locking member 484 is separated from the first clamping portion 481 of the restricting member 48; the first locking member 484 radially moves to be engaged with the first release portion 482; the tool bit 9 smoothly enters the output shaft 4, wherein at this moment, the second locking member 488 is separated from the second clamping portion 485, and no matter whether one of the straight surfaces of the hexagonal outline of the connecting shaft 51 is aligned with the second locking member 488, the connecting shaft 51 can smoothly enter the output shaft. After being powered on, the connecting shaft 51 is driven to rotate; the tool bit 9 also rotates a small angle by the action of the magnet 511; the restricting member 48 is pressed against the first pressing member 484 and the second locking member 488 by the action of the elastic force; along with the rotation of the tool bit 9 and the connecting shaft 51, the first locking member 484 and the second locking member 488 under the movement of the output shaft 4 return to the positions where the two are engaged with the first clamping portion 481 and the second clamping portion 485 respectively; thus, the connecting shaft 51 can drive the output shaft 4 to rotate by the second locking member 488, and the output shaft 4 also can drive the tool bit 9 to rotate together by the first locking member 484.

The following are detailed descriptions of the quick replacement of the tool bit of the present invention.

As shown in FIG. 1, the electric screwdriver is working, and the work of fastening screws can be down by pressing the button switch 7. When another type of the tool bit 9 is replaced, the slip cover 53 is operated to move toward the motor 2. First, as shown in FIG. 5, FIG. 10 and FIG. 11, the inclined plane 533 on the slip cover 53 contacts with a lateral surface 813 on the restricting member 81; along with the movement of the slip cover 53, the restricting member 81 pivotally rotates to the position as shown in FIG. 13 by the action of the inclined plane 533; at this moment, the restricting member 81 releases the restriction on the axial movement of the fixed block 50, and meanwhile the slip cover 53 moves to the position where the first protrusion 535 contacts with the fixed block 50. Next, the slip cover 53 continuously moves towards the motor 2; the slip cover 53 drives the connecting shaft 51 to move forward together by the fixed block 50; the ring slot 512 on the connecting shaft 51 crosses the U-shaped spring 56; the hexagonal part of the connecting shaft 51 contacts with the U-shaped spring and moves backward with the connecting shaft 51 to force the U-shaped spring 56 to generate elastic deformation until the connecting shaft 51 moves to leave the U-shaped spring; U-shaped spring 56 recovers to the free state (s shown in FIG. 30); the slip cover 53 continuously moves the connecting shaft 51 to move to the extreme position; however, the tool bit 9 cannot cross the U-shaped spring 56 to stay in the cartridge 52; in such circumstances, the tool bit 9 required to be replaced is found by the open portion of the tool chamber 521 arranged on the cartridge 52; by rotating the cartridge 52, the required tool bit 9 is rotated to the position axially opposite to the output shaft 4, as shown in FIG. 5.

Then, further as shown in FIG. 5, the slip cover 53 moves towards the output shaft 4; the slip cover 53 is pressed against the fixed block 50 by the second protrusion 536 to drive the connecting shaft 51 to move toward the output shaft 4; one end, with the magnet 511, of the connecting shaft 51 contacts with the tail of the selected tool bit 9 and absorbs the tool bit 9; the slip cover 53 drives the connecting shaft 51 toward the output shaft 4; as shown in FIG. 41 and FIG. 45, the tool bit 9 can smoothly enter the output shaft 4 with the guidance of the inclined plane 421 or by the action of the elastic pressing device, while the connecting shaft 51 continuously moves along with the slip cover 53 until the tool bit 9 is exposed from the front end of the output shaft 4, and then the slip cover 53 returns to the position where the slip cover 53 is pressed against the front housing 13; in such circumstances, the inclined plane 533 on the slip cover 53 is separated from the restricting member 81, while by the action of the elastic force the restricting member 81 returns to the position where the restricting member is axially pressed against the fixed block 50; and thus, the electric screwdriver recovers to the working state as shown in FIG. 1. The whole process of replacing the tool bit is simple and quick, which can greatly improve the working efficiency for users.

The definitions of the above members are not limited to those structures or shapes mentioned in the above embodiments, and those skilled in the field may make simple substitutes, for example: the electric machine as the motor can be replaced by a gasoline engine or a diesel engine; the tool bit maybe any regular polygon with any cross section. Besides, in the above embodiments, the relative axial movement between the tool bit and the cartridge may be the way that the connecting shaft is fixed and the cartridge axially or rotates, or the connecting shaft may be arranged coaxial with the motor. Besides, the restricting mechanism is mainly used for restricting the axial movement of the connecting shaft, no particular requirements on structure thereof. The configuration can be correspondingly changed according to the internal structure of the housing, such increasing new members or reducing unnecessary members.

The invention claimed is:

1. A power tool, comprising:

a housing;

a motor arranged in the housing, the motor being configured to output a rotary force;

an output shaft having a through hole configured to receive a first tool bit of a plurality of tool bits;

a transmission arranged between the motor and the output shaft, the transmission being configured to transmit the rotary force output by the motor to the output shaft;

a cartridge arranged in the housing, the cartridge comprising a tool chamber configured to receive the tool bits of the plurality of tool bits which are arranged in parallel;

a connecting shaft configured to move axially between a working status wherein the connecting shaft is coupled with the first tool bit of the plurality of tool bits by passing through the tool chamber, and a release status wherein the connecting shaft is separated from the first tool bit of the plurality of tool bits;

a restrictor arranged between the housing and the connecting shaft, the restrictor being configured to move between a first position and a second position; and a slider coupled with the housing, the restrictor and the connecting shaft, wherein the slider is configured to cause the restrictor to be moved between the first position and the second position based on a movement of the slider, the slider is configured to cause the connecting shaft to be moved between the working status and the release status based on the movement of the slider, the restrictor is configured to limit the movement of the connecting shaft in a direction away from the first tool bit of the plurality of tool bits if the restrictor is in the first position, the restrictor is configured to allow the connecting shaft to move in a direction away from the first tool bit of the plurality of tool bits so that the connecting shaft is located at the release status if the restrictor is in the second position, and the slider is configure to move along an axial direction of the connecting shaft to cause the connecting shaft to move axially.

2. The power tool according to claim 1, wherein the slider is provided with a release portion against the restrictor;

wherein the release portion drives the restrictor to move from the first position to the second position.

3. The power tool according to claim 2, wherein one part of the cartridge is received in the housing, and the other part of the cartridge is covered by the slider and exposed along with the axial movement of the slider.

4. The power tool according to claim 3, wherein one of the slider and the housing is provided with a guide slot along the axial direction of the connecting shaft, and the other one of the slider and the housing is provided with a guide rail matched with the guide slot; and wherein the slider moves axially along the connecting shaft with respect to the housing by sliding of the guide rail in the guide slot.

5. The power tool according to claim 3, wherein the slider is provided with a first protrusion and a second protrusion axially spaced apart from the first protrusion along the axial direction of the connecting shaft;

wherein the connecting shaft is provided with a fixed member at its one end, away from the cartridge; and wherein the fixed member is axially fixed with respect to the connecting shaft and located between the first protrusion and the second protrusion and is capable of axially moving there-between.

6. The power tool according to claim 3, wherein the housing can be divided into a motor portion for the motor, a transmission portion for the transmission and a storage portion for the cartridge along the axial direction of the connecting shaft;

wherein when the connecting shaft is located at the working status, the slider is axially overlapped with the transmission portion and the storage portion; and wherein when the connecting shaft is at the release position, the slider is axially overlapped with the motor portion and partly overlapped with the transmission portion.

7. The power tool according to claim 1, wherein one end of the connecting shaft is coupled with the transmission in a torque transmission way, and the other end of the connecting shaft is connected with the output shaft; and wherein the connecting shaft is configured to cause the first tool bit of the plurality of tool bits to rotate via the output shaft.

8. A method performed by a power tool comprising a housing, a motor arranged in the housing, an output shaft, a transmission arranged between the motor and the output shaft, a cartridge arranged in the housing, a connecting shaft arranged in the housing, a restrictor arranged between the housing and the connecting shaft, and a slider coupled with the housing, the restrictor and the connecting shaft, the method comprising:

moving the slider to drive the restrictor to a predetermined position;

releasing a restriction on axial movement of the connecting shaft;

moving the slider to drive the connecting shaft to a release status;

selecting a first tool bit of a plurality of tool bits which are arranged in the cartridge; and moving the slider, along an axial direction of the connecting shaft to cause the connecting shaft to move axially, to drive the connecting shaft from the release status to a working status, wherein the connecting shaft is connected with the selected tool bit via the output shaft at the working status.

9. The method according to claim 8, wherein one part of the cartridge is exposed along with a movement of the slider.

10. The power tool according to claim 1, wherein the restrictor is rotatable around a pivot in parallel or vertical to the axial direction of the connecting shaft.

11. The power tool according to claim 1, wherein the restrictor is movable linearly in a direction vertical to the axial direction of the connecting shaft.

12. The power tool according to claim 1, wherein the restrictor comprises an elastic member resisting against the restrictor towards the first position.

13. The power tool according to claim 1, wherein one end of the connecting shaft is connected with the transmission in torque transmission way, while the other end of the connecting shaft is capable of connecting with the output shaft and driving the tool bit.

14. The power tool according to claim 1, wherein one part of the cartridge is received in the housing, and the other part of the cartridge is covered by the slider, and wherein the other part of the cartridge is configured to be exposed along with the movement of the slider.

15. The power tool according to claim 14, wherein one of the slider or the housing is provided with a guide slot along the axial direction of the connecting shaft, and the other of the slider or the housing is provided with a guide rail matched with the guide slot, and wherein the slider moves axially along the connecting shaft with respect to the housing by sliding of the guide rail in the guide slot.

16. The power tool according to claim 15, wherein the slider comprises a first protrusion and a second protrusion along the axial direction of the connecting shaft, wherein the connecting shaft comprises a fixed member at one end, away from the cartridge, of the connecting shaft, and wherein the fixed member is axially fixed with respect to the connecting shaft located between the first protrusion and the second protrusion, and configured to move axially between the first protrusion and the second protrusion.

17. The power tool according to claim 16, wherein the housing comprises a motor portion housing the motor, a transmission portion housing the transmission and a storage portion housing the cartridge along the axial direction of the connecting shaft, wherein, when the connecting shaft is located at the working status, the slider is overlapped with the transmission portion and the storage portion, and when the connecting shaft is located at the release status, the slider is overlapped with the motor portion and partly overlapped with the transmission portion.

* * * * *